United States Patent [19]

Osawa et al.

[11] Patent Number: 4,991,559

[45] Date of Patent: Feb. 12, 1991

[54] FUEL INJECTION CONTROL DEVICE OF AN ENGINE

[75] Inventors: Kouichi Osawa; Hiroshi Kanai; Kouichi Hoshi; Hiroki Matsuoka, all of Susono; Michihiro Ohashi, Mishima; Yukihiro Sonoda, Susono; Hiroshi Sawada, Gotenba; Shinichi Matsumoto, Susono; Kiyoshi Asada, Okazaki; Hidehiro Oba, Aichi; Sinji Kato, Toyota; Katsushi Anzai, Toyota; Ryouichi Harada, Toyota, all of Japan

[73] Assignee: Toyota Jidosha Kabushiki Kaisha, Aichi, Japan

[21] Appl. No.: 468,902

[22] Filed: Jan. 23, 1990

[30] Foreign Application Priority Data

| | | | |
|---|---|---|---|
| Jan. 24, 1989 | [JP] | Japan | 1-13300 |
| Jan. 27, 1989 | [JP] | Japan | 1-16344 |
| Jan. 27, 1989 | [JP] | Japan | 1-16348 |
| Apr. 3, 1989 | [JP] | Japan | 1-81524 |

[51] Int. Cl.[5] ..... F02D 41/14; F02D 41/10; F02D 41/12

[52] U.S. Cl. ..... 123/489; 123/492; 123/493

[58] Field of Search ..... 123/489, 492, 493

[56] References Cited

U.S. PATENT DOCUMENTS

| | | | |
|---|---|---|---|
| 4,416,237 | 11/1983 | Aoki et al. | 123/438 |
| 4,499,882 | 2/1985 | Saito et al. | 123/492 |
| 4,616,619 | 11/1986 | Saito et al. | 123/489 |
| 4,627,404 | 12/1986 | Saito et al. | 123/492 |
| 4,633,840 | 1/1987 | Saito et al. | 123/489 |
| 4,635,200 | 1/1987 | Egami et al. | 364/431.05 |
| 4,667,631 | 5/1987 | Kinugasa | 123/492 |
| 4,907,558 | 3/1990 | Manaka et al. | 123/492 |

FOREIGN PATENT DOCUMENTS

| | | |
|---|---|---|
| 57-18440 | 1/1982 | Japan . |
| 58-104335 | 6/1983 | Japan . |
| 58-104336 | 6/1983 | Japan . |
| 58-165528 | 9/1983 | Japan . |
| 60-1346 | 1/1985 | Japan . |
| 60-17237 | 1/1985 | Japan . |
| 60-116836 | 6/1985 | Japan . |

*Primary Examiner*—Andrew M. Dolinar
*Attorney, Agent, or Firm*—Kenyon & Kenyon

[57] ABSTRACT

A fuel injection control device in which the amount of fuel injected by the fuel injector is increased at the time of acceleration. Namely, at the time of acceleration, the lean time and the rich time of the air-fuel mixture are calculated during the lean-rich discriminating time, which is basically equal to a time of an occurence of the lean time and the rich time when the air-fuel ratio is maintained at the stoichiometric air-fuel ratio at the time of acceleration. When the lean time becomes considerably longer than the rich time, the amount of fuel injected by the fuel injector is further increased.

37 Claims, 38 Drawing Sheets

PM
PM2
PM1
ΔPM
+39mmHg
0
-39mmHg
CLRN1
B1
A1
0
CLRN2
B2
A2
0
RICH
LEAN
CAC
C1
C2
0
D1
D2
KAC
KDC

| Fig. 9A |
| --- |
| Fig. 9B |

CALCULATION OF DEPOSIT LEARNING COEFFICIENT
400
ΔPM ← PM - PM1
401
HAS FEEDBACK CONTROL BEEN CARRIED OUT ?
NO
3
YES
403
CLRN1 = 0 ?
YES
NO
404
CLRN2 = 0 ?
YES
NO
405
ΔPM ≥ 39mmHg ?
NO
YES
407
CLRN1 ← 1
424
ΔPM ≥ 5mmHg ?
YES
3
NO
408
ΔPM ≤ -5mmHg ?
YES
3
NO

CALCULATION OF DEPOSIT LEARNING COEFFICIENT
500
ΔPM ← PM-PM1
501
HAS FEEDBACK CONTROL BEEN CARRIED OUT ?
NO
3
YES
504
IS FLAG F1 SET ?
YES
NO
505
IS FLAG F3 SET ?
YES
NO
506
ΔPM ≥ 39mmHg ?
YES
NO
508
FLAG F1 SET
520
ΔPM ≥ 5mmHg
YES
3
NO
509
ΔPM ≤ -5mmHg ?
YES
3
NO

1
LEAN ?
511
YES
NO
CAC ← CAC + 1
512
CAC ← CAC − 1
514
CLRN ≥ B ?
513
YES
NO
4
CAC ≥ C1 ?
515
YES
NO
KAC ← KAC+0.1
517
CAC ≤ D1 ?
516
YES
NO
2
RICH ?
522
YES
NO
CAC ← CAC + 1
523
CAC ← CAC − 1
525
CLRN ≥ B ?
524
YES
NO
4
CAC ≥ C2 ?
526
YES
NO
KDC ← KDC+0.1
528
CAC ≤ D2 ?
527
YES
NO

1
LEAN ?
211
YES
NO
CAC ← CAC+1
212
CAC ← CAC−1
214
CLRN1 ≥ B1 ?
213
YES
NO
4
CAC ≥ C1 ?
215
YES
NO
KAC ← KAC+0.1
217
CAC ≤ D1 ?
216
YES
NO
KAC ← KAC−0.1
218
2
RICH ?
223
YES
NO
CAC ← CAC+1
224
CAC ← CAC−1
226
CLRN2 ≥ B2 ?
225
YES
NO
4
CAC ≥ C2 ?
227
YES
NO
KDC ← KDC+0.1
229
CAC ≤ D2 ?
228
YES
NO
KDC ← KDC−0.1
230

CALCULATION OF DEPOSIT LEARNING COEFFICIENT
199
CALCULATION OF Q/N
200a
Δ(Q/N) ← (Q/N)1 − (Q/N)1
201
HAS FEEDBACK CONTROL BEEN CARRIED OUT ?
NO
3
YES
203
CLRN1 = 0 ?
NO
YES
204
CLRN2 = 0 ?
NO
YES
205a
Δ(Q/N) ≥ L ?
NO
YES
207
CLRN1 ← 1
220a
Δ(Q/N) ≥ M ?
NO
YES
3
208a
Δ(Q/N) ≤ −M ?
NO
YES
3

1
LEAN ?
211
YES
NO
CAC ← CAC+1
212
CAC ← CAC−1
214
CLRN1 ≥ B1 ?
213
YES
NO
4
CAC ≥ C1 ?
215
YES
NO
KAC ← KAC+0.1
217
CAC ≤ D1 ?
216
YES
NO
KAC ← KAC−0.1
218
2
RICH ?
223
YES
NO
CAC ← CAC+1
224
CAC ← CAC−1
226
CLRN2 ≥ B2 ?
225
YES
NO
4
CAC ≥ C2 ?
227
YES
NO
KDC ← KDC+0.1
229
CAC ≤ D2 ?
228
YES
NO
KDC ← KDC−0.1
230

FUEL INJECTION CONTROL DEVICE OF AN ENGINE

BACKGROUND OF THE INVENTION

1. Field of the Invention

The present invention relates to a fuel injection control device of an engine.

2. Description of the Related Art

In a fuel injection type engine, the basic amount of fuel injected by a fuel injector is usually calculated from the engine speed and the level of vacuum in the intake passage, or from the engine speed and the amount of air fed into the engine cylinder, and the actual amount of fuel injected by the fuel injector is feedback-controlled so that the air-fuel ratio of mixture fed into the engine cylinder becomes equal to a predetermined desired air-fuel ratio, for example, the stoichiometric air-fuel ratio, by correcting the basic amount of fuel on the basis of the output signal of the oxygen concentration detector (hereinafter referred to as an $O_2$ sensor) arranged in the exhaust passage of the engine. Nevertheless, even if such a feedback control is carried out, when the amount of fuel injected by the fuel injector is abruptly increased as at the time of acceleration, the amount of fuel adhering to the inner wall of the intake port in the form of a liquid fuel is increased, and since this liquid fuel is not fed into the engine cylinder immediately after adhering to the inner wall of the intake port, the air-fuel mixture fed into the engine cylinder temporarily becomes lean. Conversely, when the engine is decelerated, the absolute pressure in the intake port becomes low, and as a result, since the amount of vaporization of the liquid fuel adhering to the inner wall of the intake port is increased, the air-fuel mixture fed into the engine cylinder temporarily becomes rich.

Consequently, in a fuel injection type engine, the amount of fuel injected by the fuel injector is usually increased at the time of an acceleration and decreased at the time of a deceleration, so that the air-fuel ratio of the mixture fed into the engine cylinder becomes equal to a desired air-fuel ratio, for example, the stoichiometric air-fuel ratio, even if the engine is operating in a transition state such as an acceleration state and a deceleration state. Consequently, in such a fuel injection type engine, the air-fuel ratio of mixture fed into the engine cylinder is controlled so that it becomes approximately equal to the desired air-fuel ratio, regardless of the operating state of the engine.

Nevertheless, in such a fuel injection type engine, blowby gas and lubricating oil, for example, pass through the clearance between the valve stem and the stem guide of the intake valve and flow into the intake port, and thus, when the engine is run for a long time, carbon particles, etc., contained in the blowby gas and the lubricating oil are gradually deposited on the inner wall of the intake port and the rear face of the valve head of the intake valve. These deposited carbon particles, i.e., the carbon deposit, have a physical characteristic of retaining liquid fuel, and thus, if the carbon deposit is deposited on the inner wall of the intake port etc., the amount of liquid fuel adhering to the inner wall of the intake port, etc., is increased, and this increases the time taken by the liquid fuel to flow into the engine cylinder, after the liquid fuel adheres to the inner wall of the intake port, etc. Consequently, although the air-fuel ratio of mixture fed into the engine cylinder can be controlled so that it becomes approximately equal to the stoichiometric air-fuel ratio, regardless of the engine operating state, while the engine is relatively new, if the deposit is deposited on the inner wall of the intake port, etc., after the engine has been run for a long time, since the time taken by the liquid fuel to flow into the engine cylinder is increased, as mentioned above, the air-fuel mixture fed into the engine cylinder becomes lean at the time of acceleration. In addition, since the amount of the liquid fuel adhering to the inner wall of the intake port etc. is increased, the air-fuel mixture fed into the engine cylinder becomes rich at the time of deceleration. At this time, since the amount of the deposit is increased, the air-fuel mixture becomes even leaner at the time of acceleration and even richer at the time of deceleration. In this case, for example, the leaner the air-fuel mixture at the time of acceleration, the longer the time for which the air-fuel mixture remains lean.

Consequently, in a known fuel injection type engine, the time during which the air-fuel mixture becomes lean (hereinafter referred to as a lean time) within a fixed time after the accelerating operation of the engine is started and the time during which the air-fuel mixture becomes rich (hereinafter referred to as a rich time) within the fixed time after the accelerating operation is started, are calculated, and the acceleration increase in the amount of fuel fed by the fuel injector is corrected on the basis of the lean time and the rich time, so that the air-fuel ratio of mixture fed into the engine cylinder becomes a desired air-fuel ratio even if the accelerating operation of the engine is carried out (see U.S. Pat. No. 4499882).

As mentioned above, at the time of acceleration, the lean time becomes longer as the air-fuel mixture becomes leaner. Consequently, at this time, when comparing the lean time with the rich time, if the lean time becomes longer than the rich time, it appears that the air-fuel mixture becomes lean at the time of acceleration. In practice, however, in some cases, when the lean time becomes long, the rich time also becomes long. In such cases, when comparing the lean time with the rich time in the fixed time after the accelerating operation of the engine is started, as in the abovementioned known fuel injection type engine, the lean time becomes equal to the rich time, and thus a problem occurs in that a wrong determination is made, i.e., that the air-fuel mixture has not become lean.

In addition, where the air-fuel ratio of mixture is maintained at approximately the stoichiometric air-fuel ratio at the time of acceleration, the air-fuel mixture alternately becomes lean and rich at an approximately fixed time frequency, even during the accelerating operation of the engine. In this case, when comparing the lean time with the rich time within the fixed time after the accelerating operation of the engine is started, as in the above-mentioned known fuel injection type engine, the lean time becomes longer than the rich time or the rich time becomes longer than the lean time in accordance with the amount of time predetermined as the above-mentioned fixed time. As a result, another problem occurs in that a wrong determination is made, i.e., the air-fuel mixture has becomes lean or rich, although this is not the actual case.

SUMMARY OF THE INVENTION

An object of the present invention is to provide a fuel injection control device capable of correctly determining that the air-fuel mixture actually becomes lean at the time of acceleration.

According to the present invention, there is provided a fuel injection control device of an engine having an intake passage and an exhaust passage, the device comprising: an oxygen concentration detector arranged in the exhaust passage and producing an output signal indicating whether an air-fuel mixture fed into the engine is lean or rich; feedback control means for controlling an amount of fuel fed into the engine in response to the output signal of the oxygen concentration detector to bring an air-fuel ratio of the mixture to a desired air-fuel ratio; acceleration detecting means for detecting an accelerating operation of the engine; fuel increasing means for increasing the amount of fuel fed into the engine when the accelerating operation of the engine is carried out; time calculating means for calculating a lean time and a rich time of the air-fuel mixture on the basis of the output signal of the oxygen concentration detector during a predetermined lean-rich discriminating time when the accelerating operation of the engine is carried out, the lean-rich discriminating time being an integral number of times of one time of an occurrence of either one of the lean time and the rich lean-rich discriminating time when the accelerating operation of the engine is carried out, the lean-rich discriminating time being an integral number of times of one time of an occurrence of either one of the lean time and the rich time which occur when the air-fuel ratio of mixture is maintained at the desired air-fuel ratio due to an increase in the amount of fuel by the fuel increasing means; difference calculating means for calculating a difference between the lean time and the rich time; and correction means for correcting an increase in the amount of fuel, which increase is caused by the fuel increasing means, to increase the increase in the amount of fuel when the lean time is longer than the rich time and when the difference is larger than a predetermined value and to reduce the increase in the amount of fuel when the rich time is longer than the lean time and when the difference is larger than a predetermined value.

The present invention may be more fully understood from the description of preferred embodiments of the invention set forth below, together with the accompanying drawings.

Figure 8:
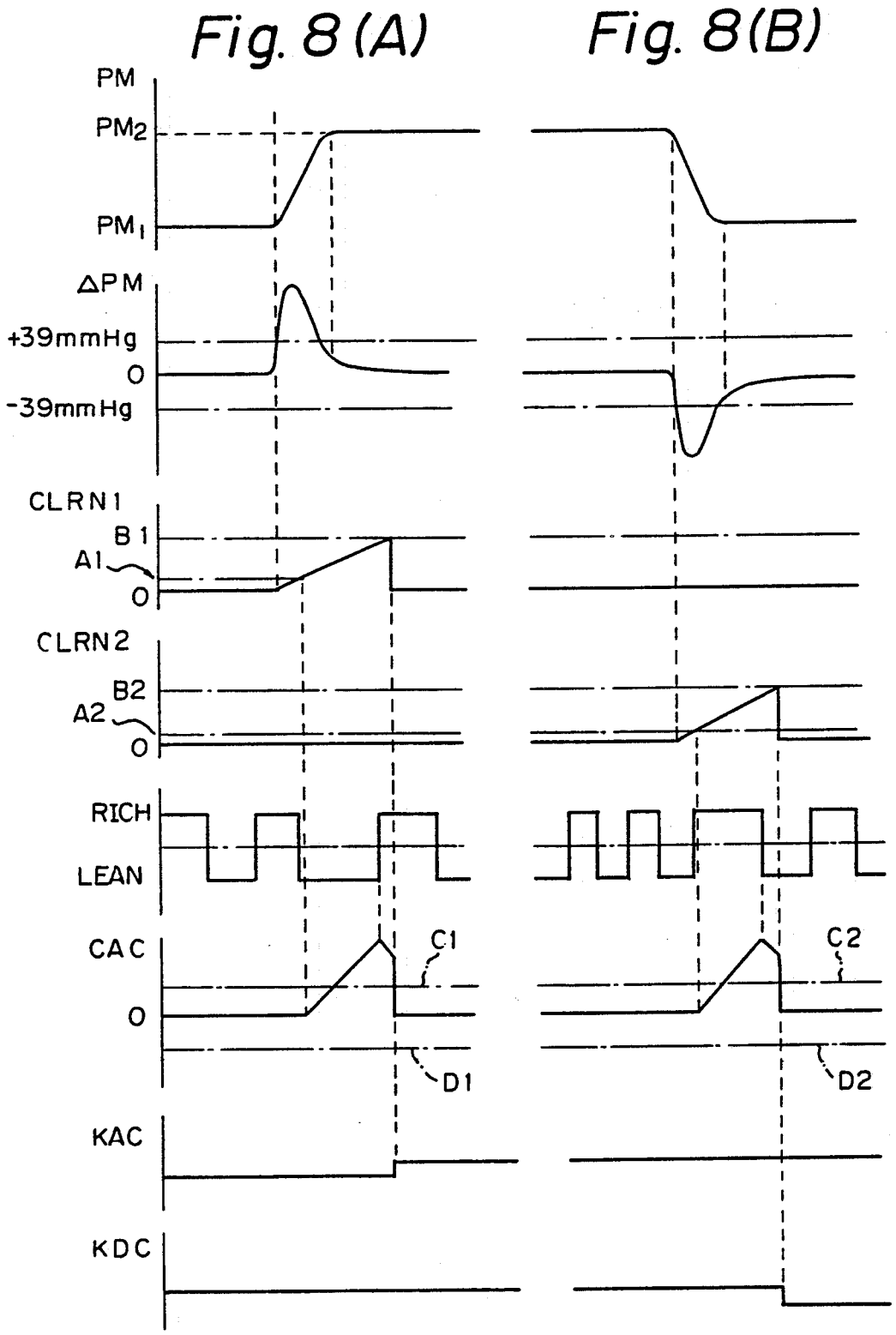
Figure 11:
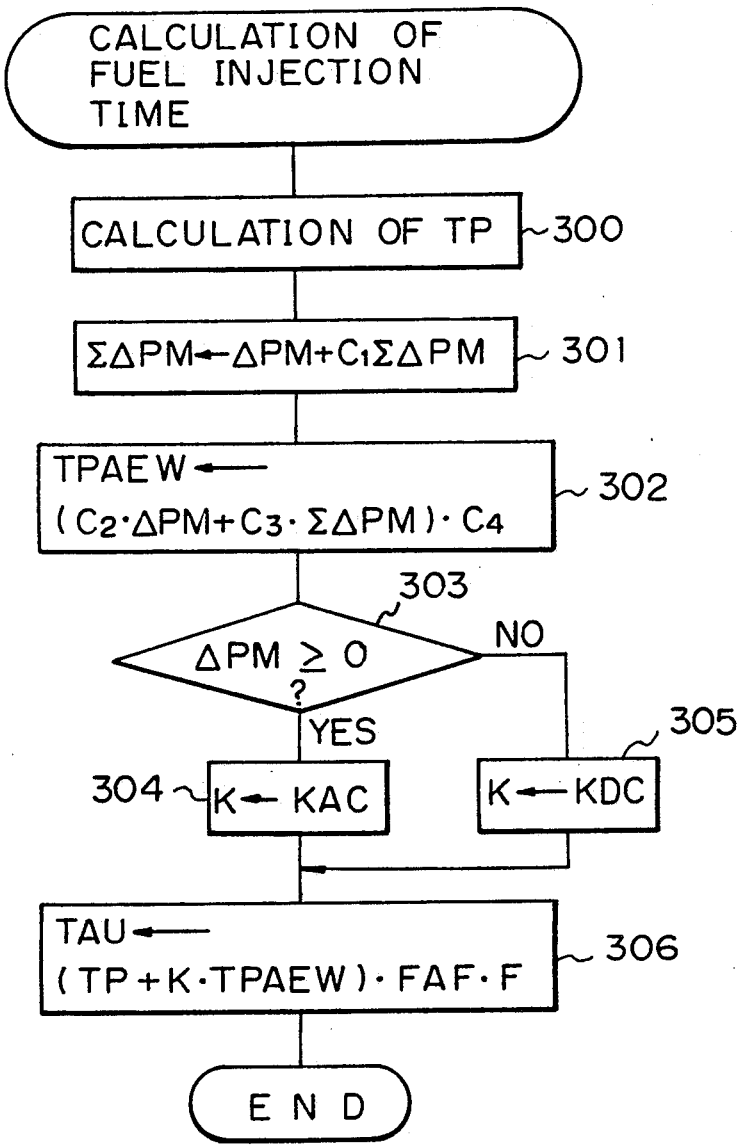
Figures 12A, 12B:
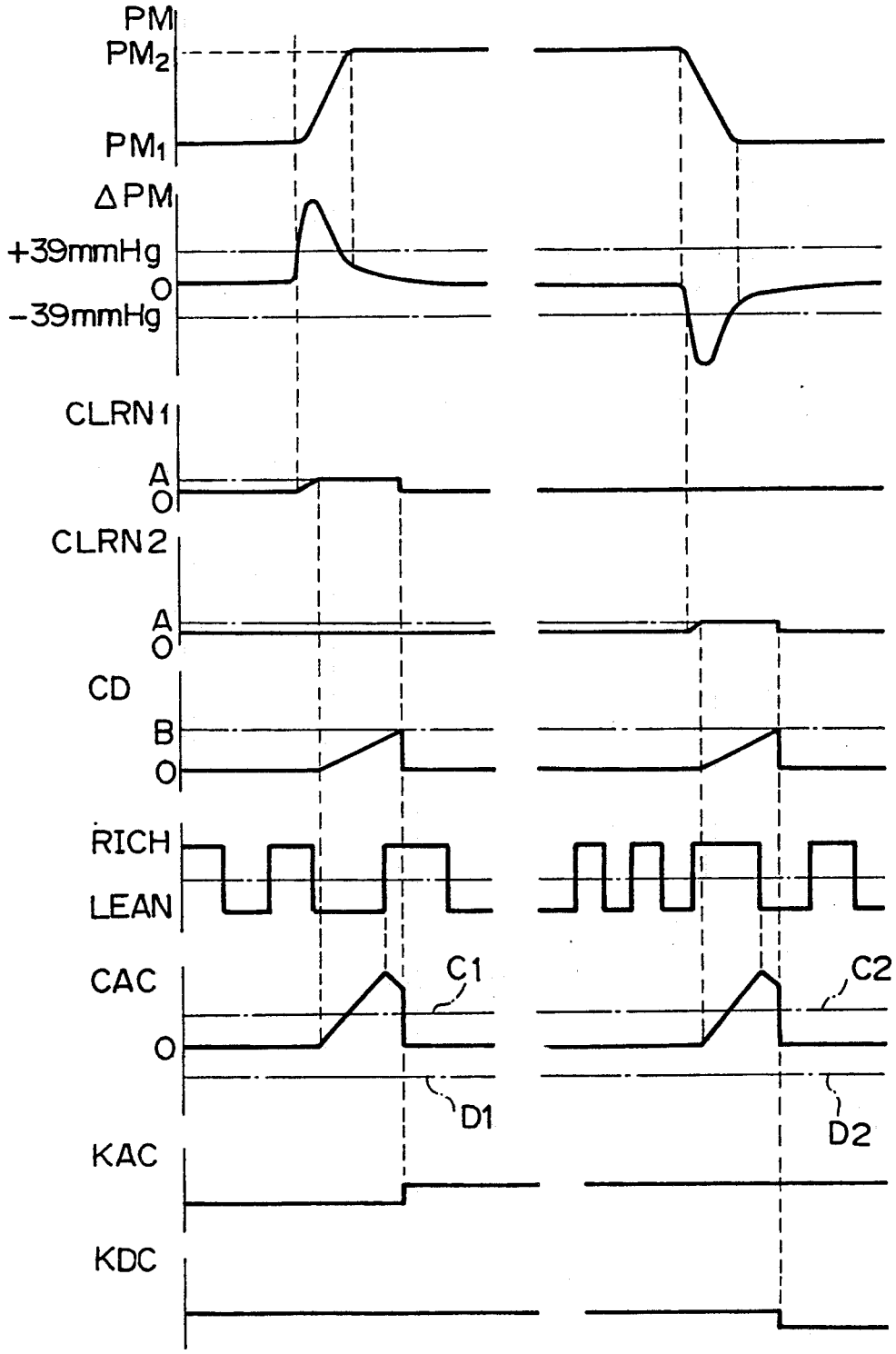
Figure 15:
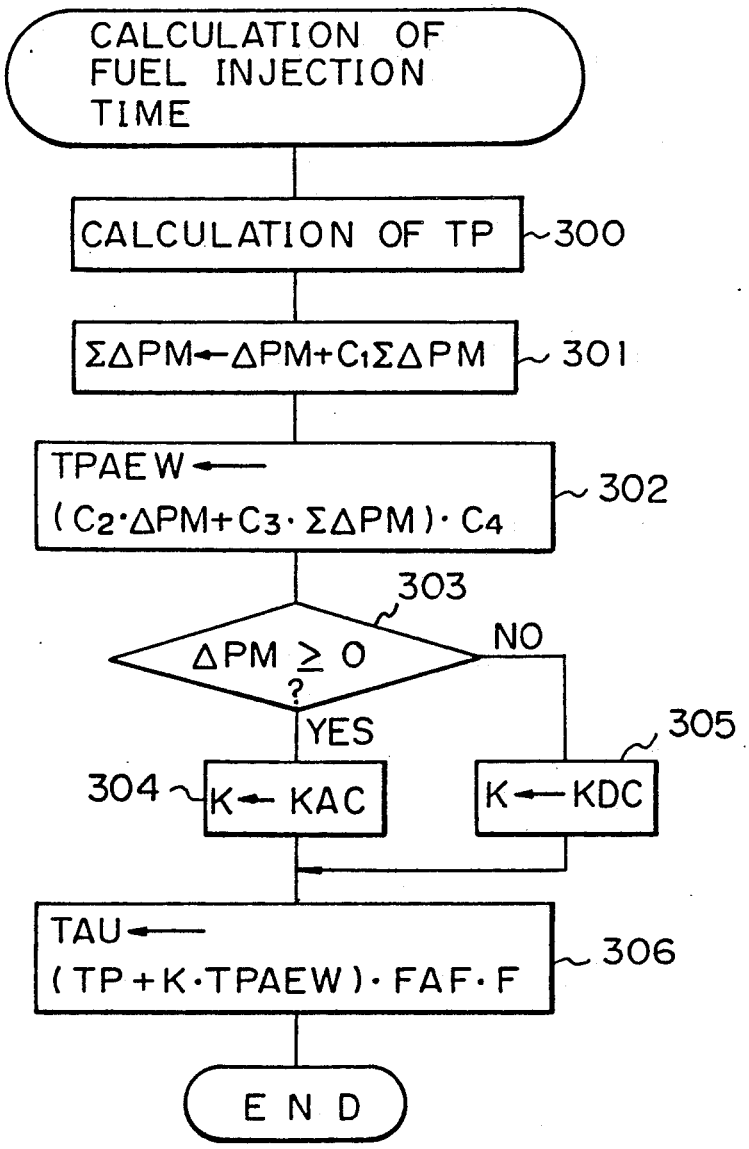
Figure 16:
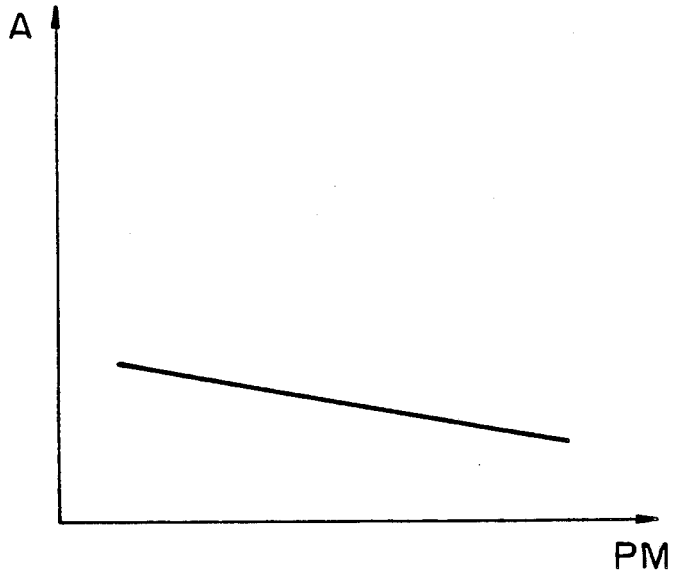
Figure 17:
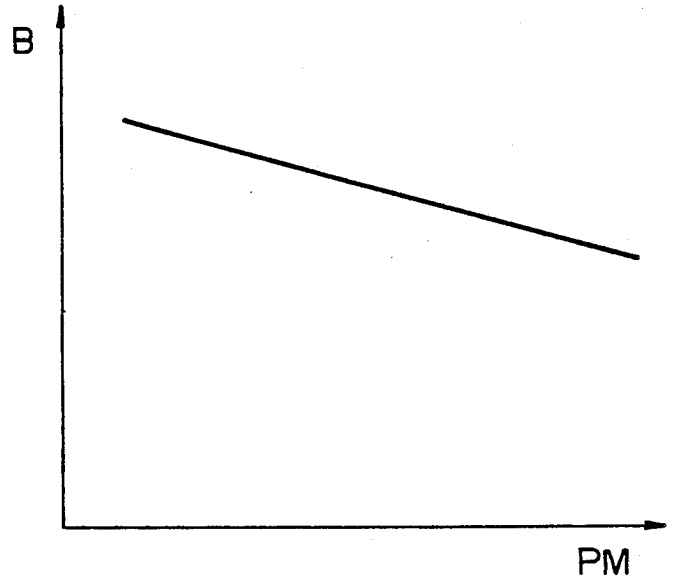
Figure 18A:
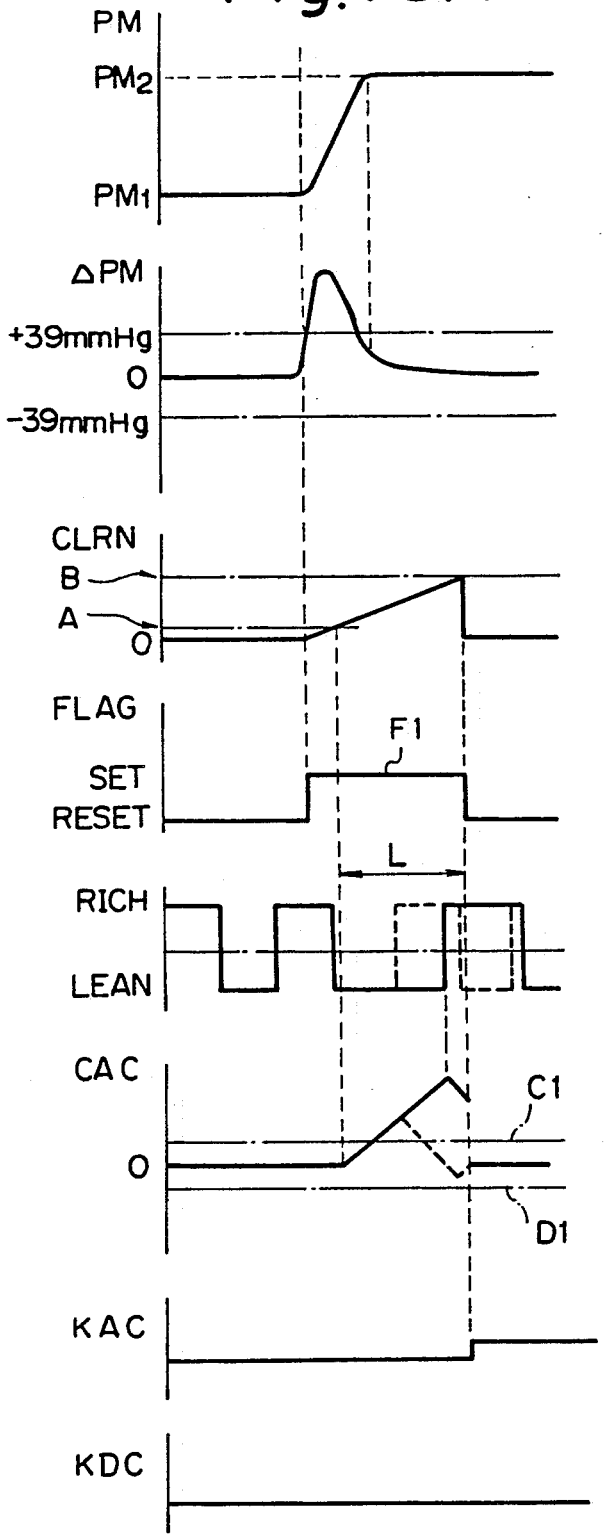
Figure 18B:
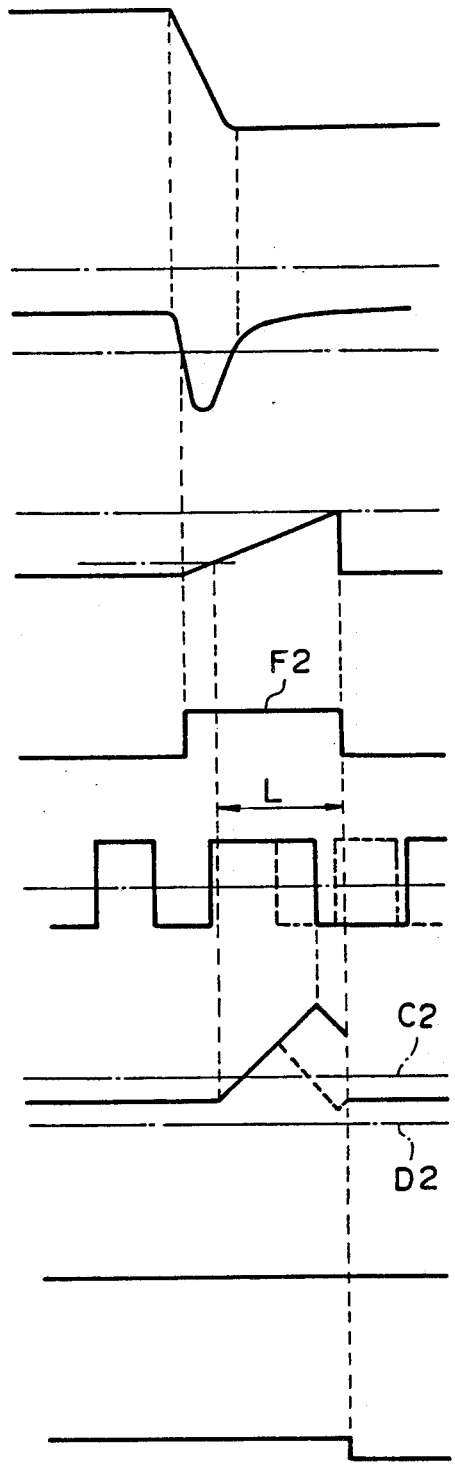
Figure 21:
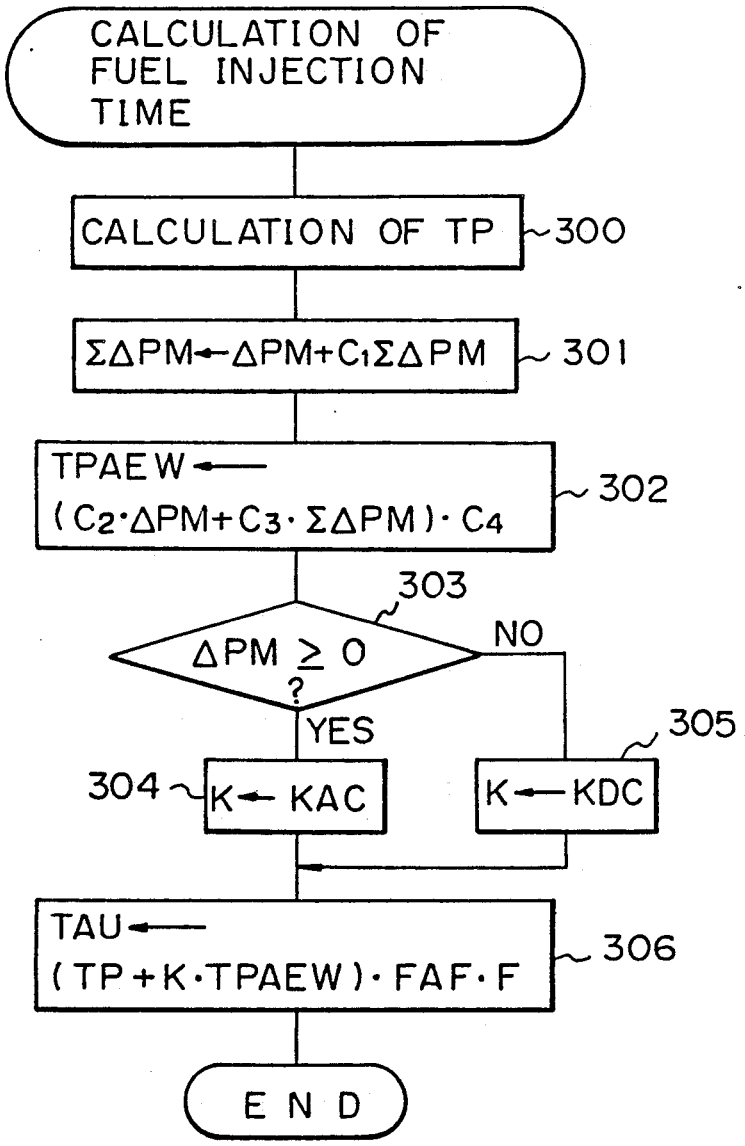
Figure 22:
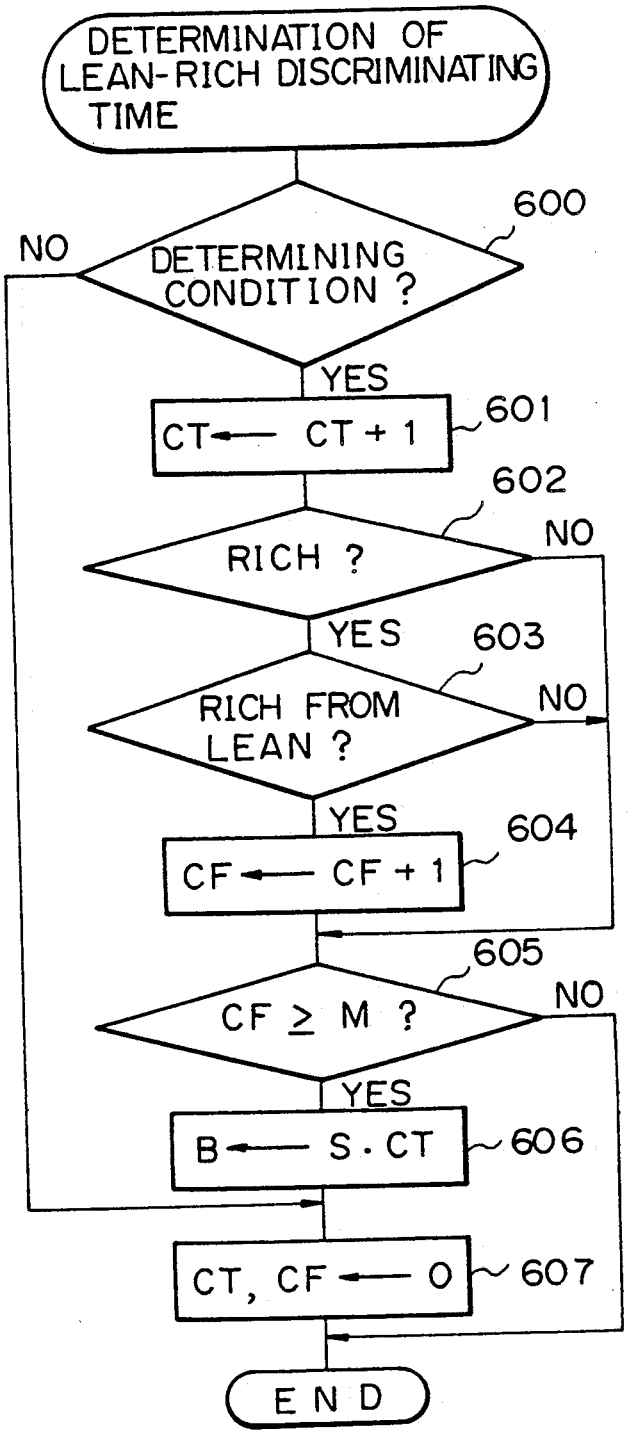
Figure 23:
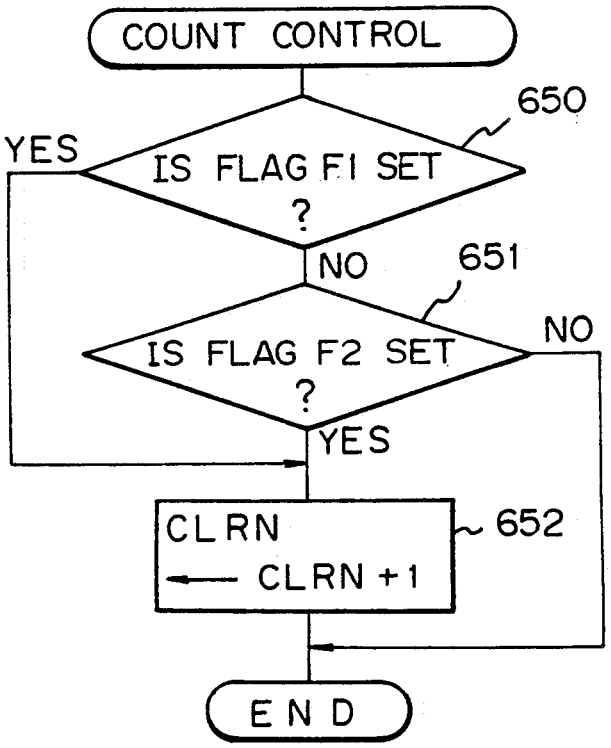
Figure 24A:
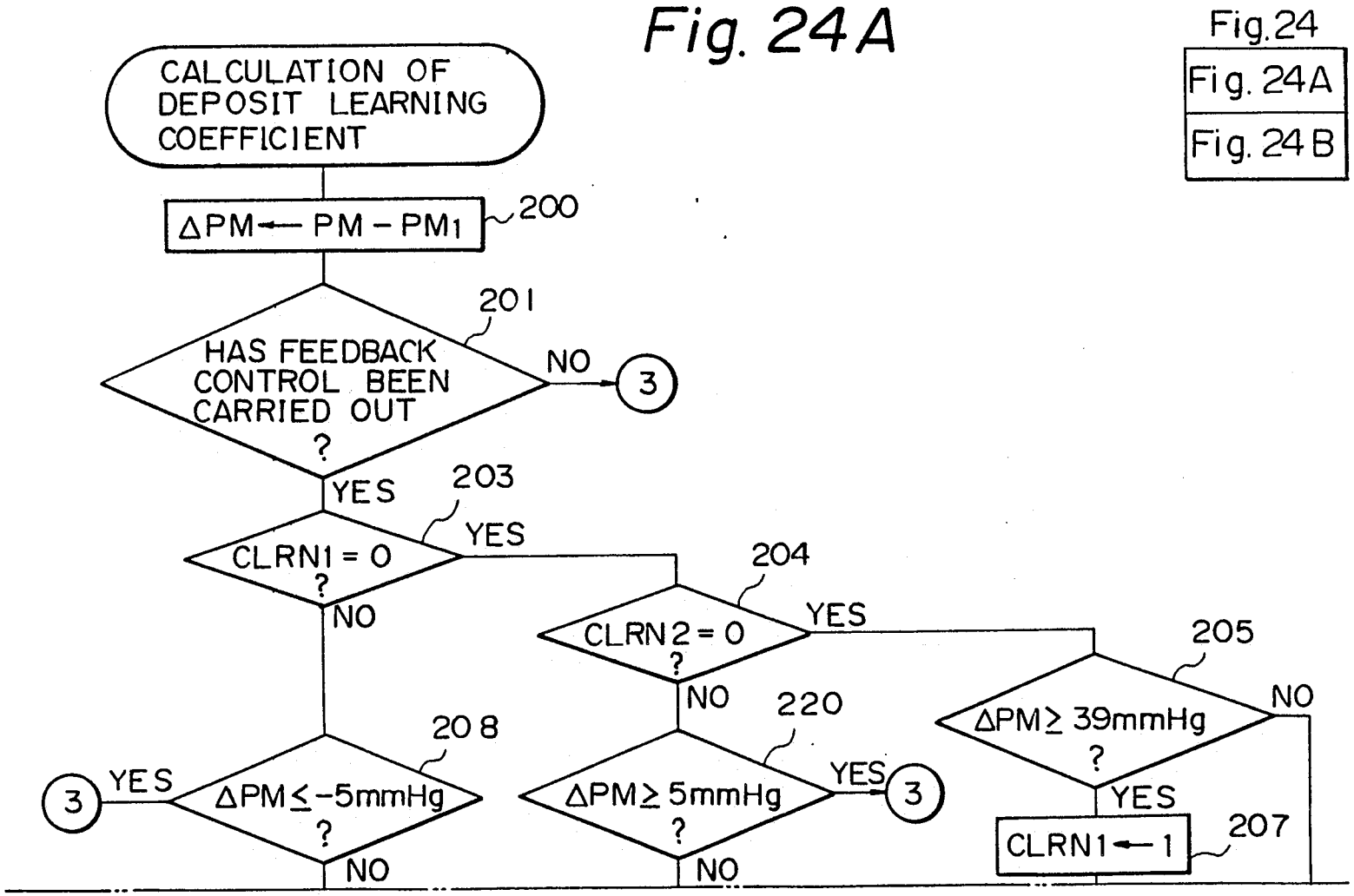
Figure 24B:
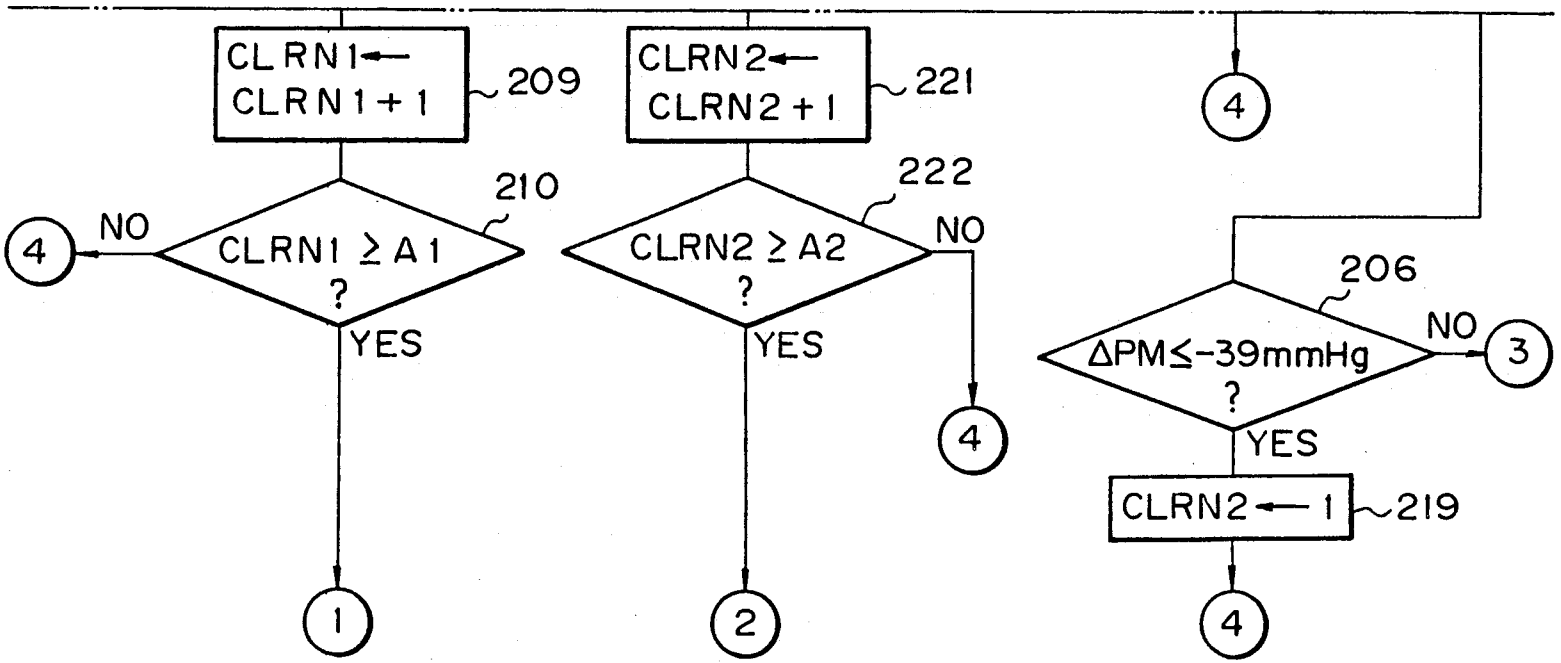
Figure 26:
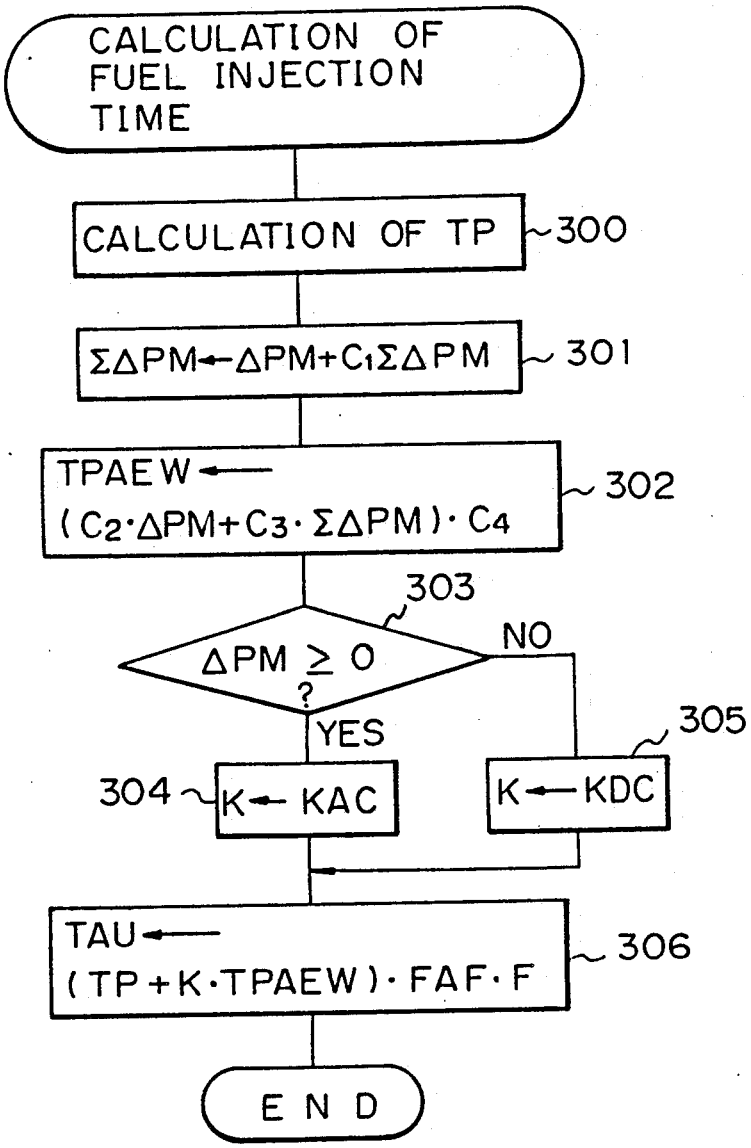
Figure 27:
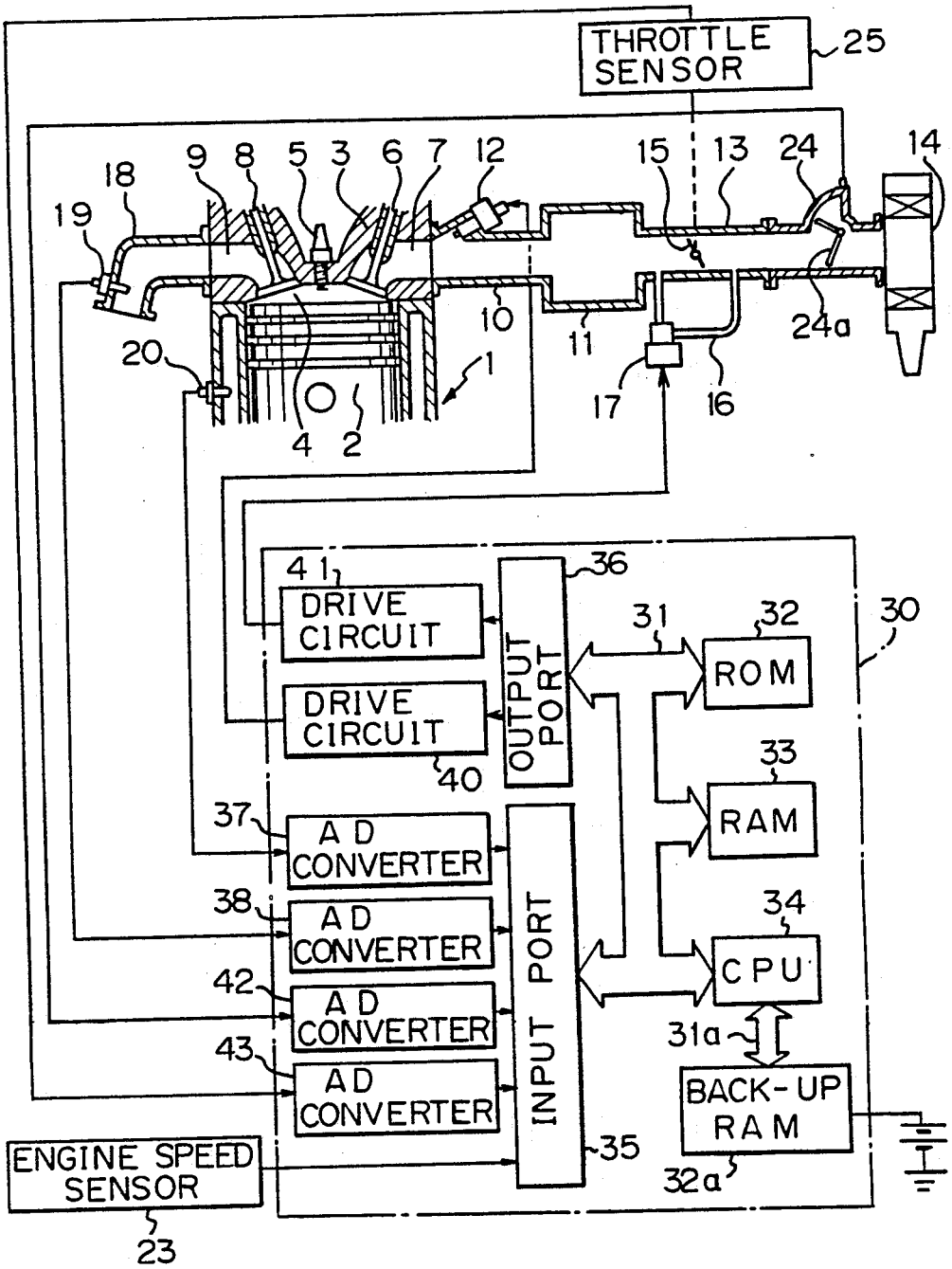
Figures 28, 28A, 28B:
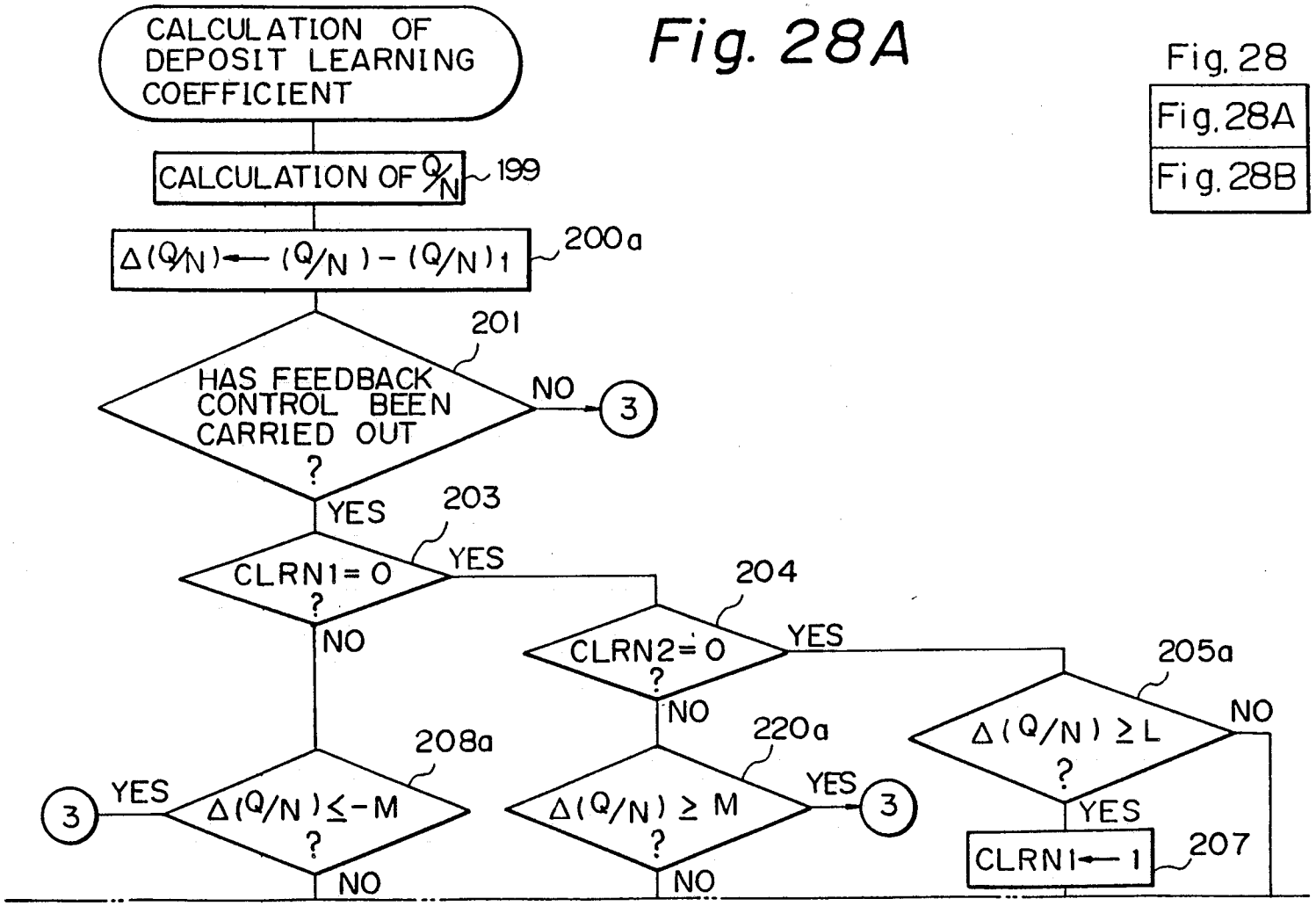
Figure 28B:
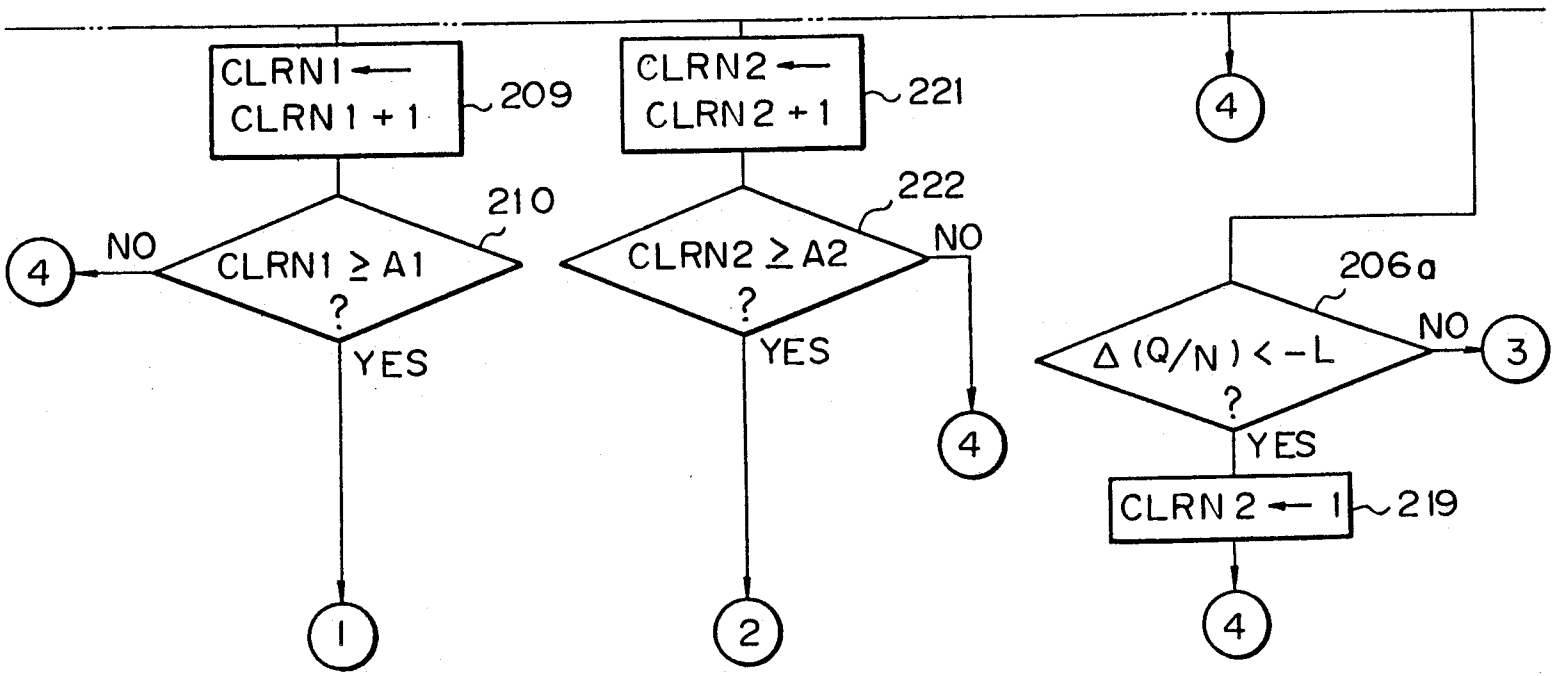
Figures 29, 29A, 29B:
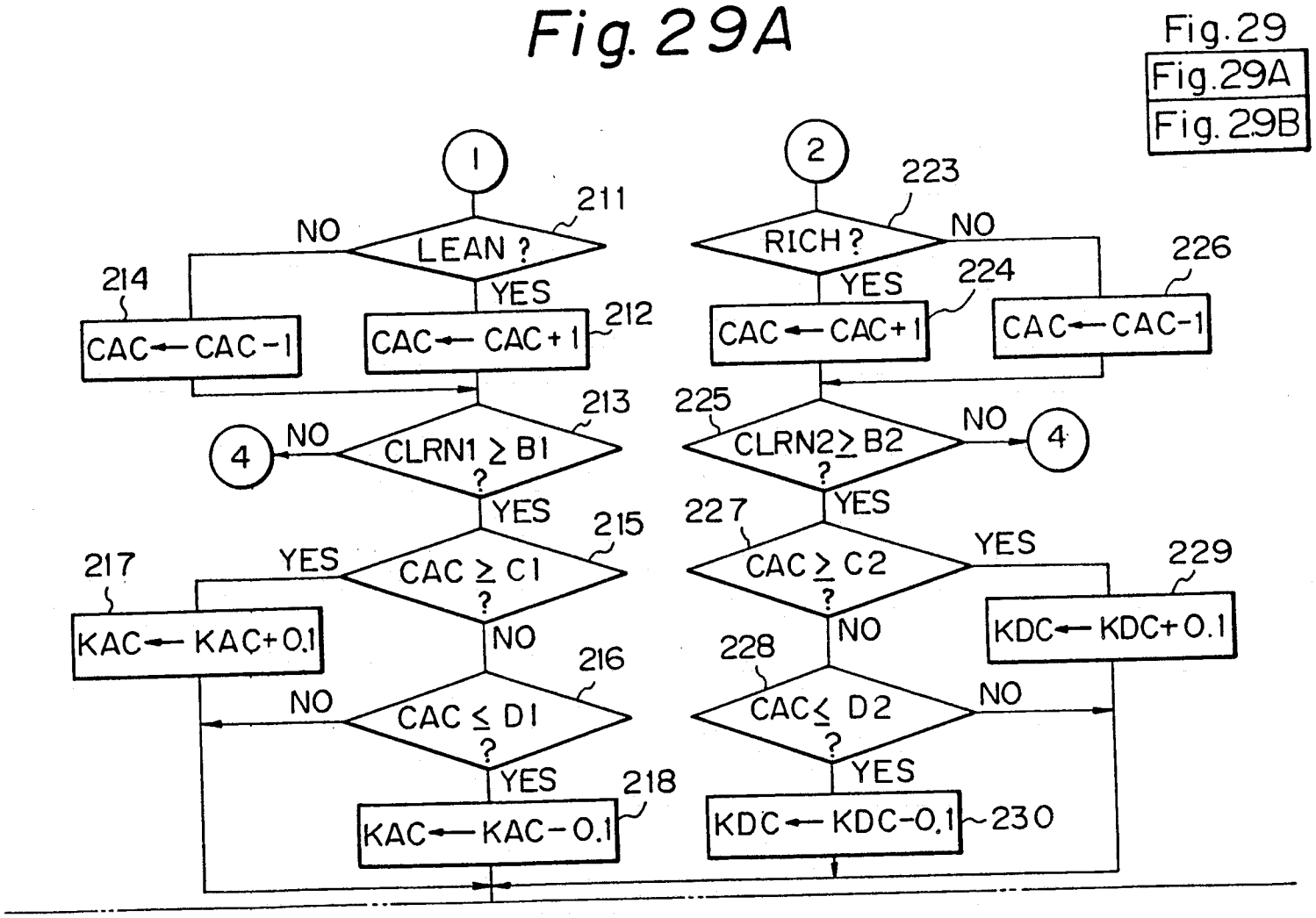
Figure 29B:
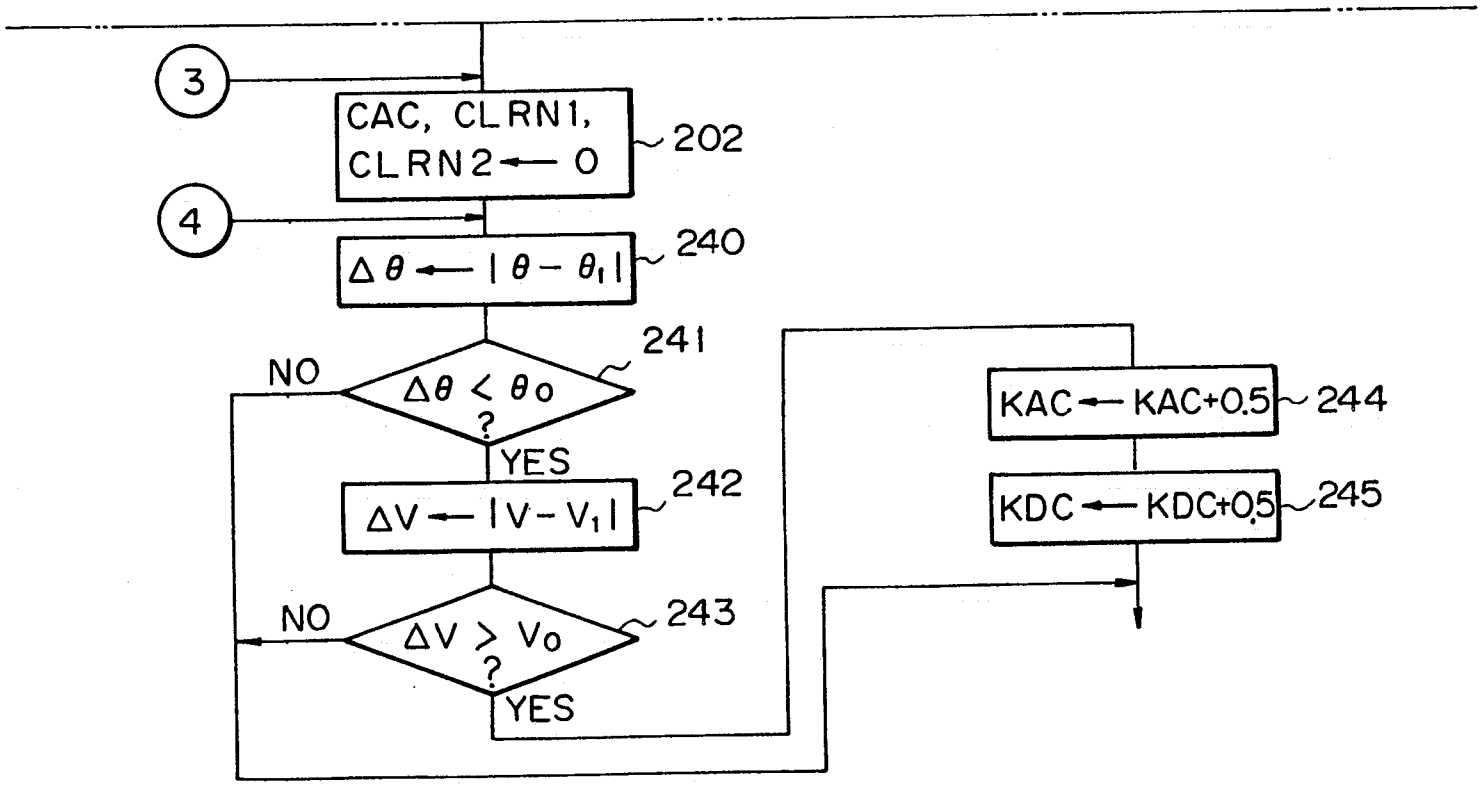
Figure 30:
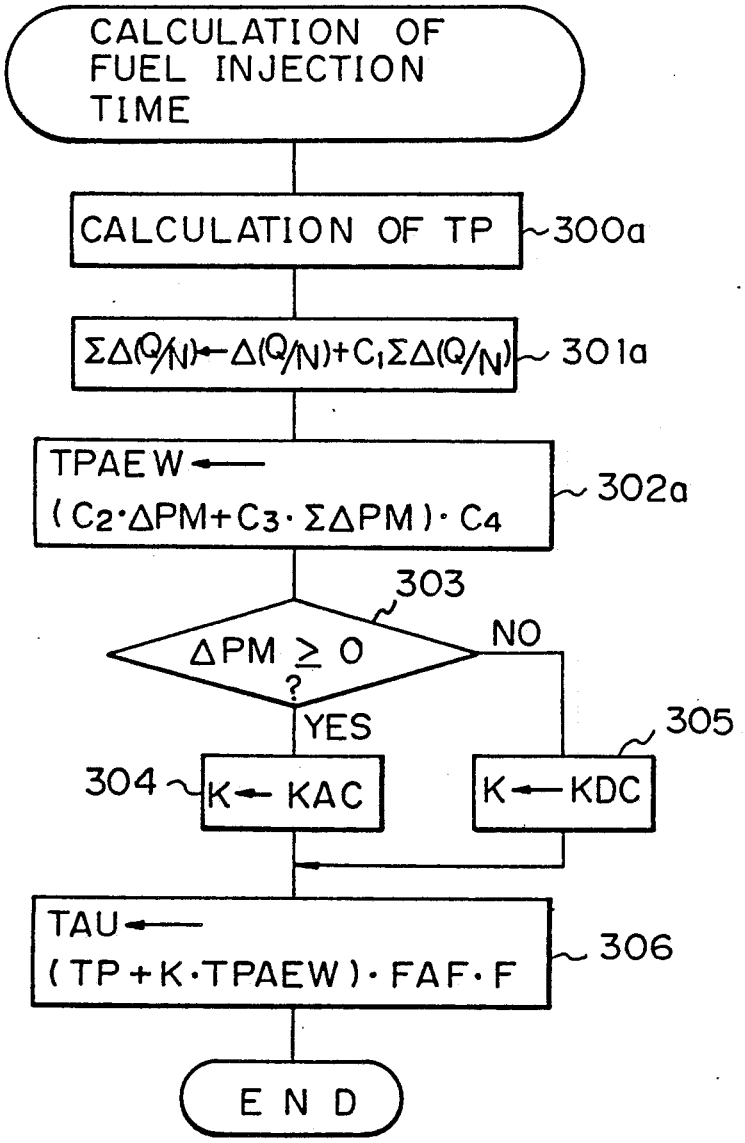

FIGS. (8A) and 8(B) are a time chart of an embodiment, illustrating a method of calculating the deposit learning coefficient;

FIGS. 9, 9A, 9B and 10 are a flow chart for calculating the deposit learning coefficient by the method illustrated in FIG. 8;

FIG. 11 is a flow chart for calculating the fuel injection time;

FIGS. 12(A) and 12′(B) are a time chart of another embodiment, illustrating a method of calculating the deposit learning coefficient;

FIGS. 13, 13A, 13B and 14 are a flow chart for calculating the deposit learning coefficient by the method illustrated in FIG. 12;

FIG. 15 is a flow chart for calculating the fuel injection time;

FIG. 16 is a diagram illustrating the relationship between the absolute pressure PM and the delay count value A;

FIG. 17 is a diagram illustrating the relationship between the absolute pressure PM and the discriminating count value;

FIGS. 18A and 18B are a time chart of a further embodiment, illustrating a method of calculating the deposit learning coefficient;

FIGS. 19, 19A, 19B, 20, 20A and 20B are a flow chart for calculating the deposit learning coefficient by the method illustrated in FIG. 18;

FIG. 21 is a flow chart for calculating the fuel injection time;

FIG. 22 is a flow chart for determining the lean-rich discriminating time;

FIG. 23 is a flow chart for controlling the counter CLRN;

FIGS. 24, 24A, 24B, 25, 25A and 25B are a flow chart of a further embodiment for calculating the deposit learning coefficient;

FIG. 26 is a flow chart for calculating the fuel injection time;

FIG. 27 is a schematically illustrated view of another embodiment of an engine;

FIGS. 28, 28A, 28B, 29, 29A and 29B are a flow chart of a still further embodiment for calculating the deposit learning coefficient; and FIG. 30 is a flow chart for calculating the fuel injection time.

DESCRIPTION OF PREFERRED EMBODIMENTS

Figure 1:
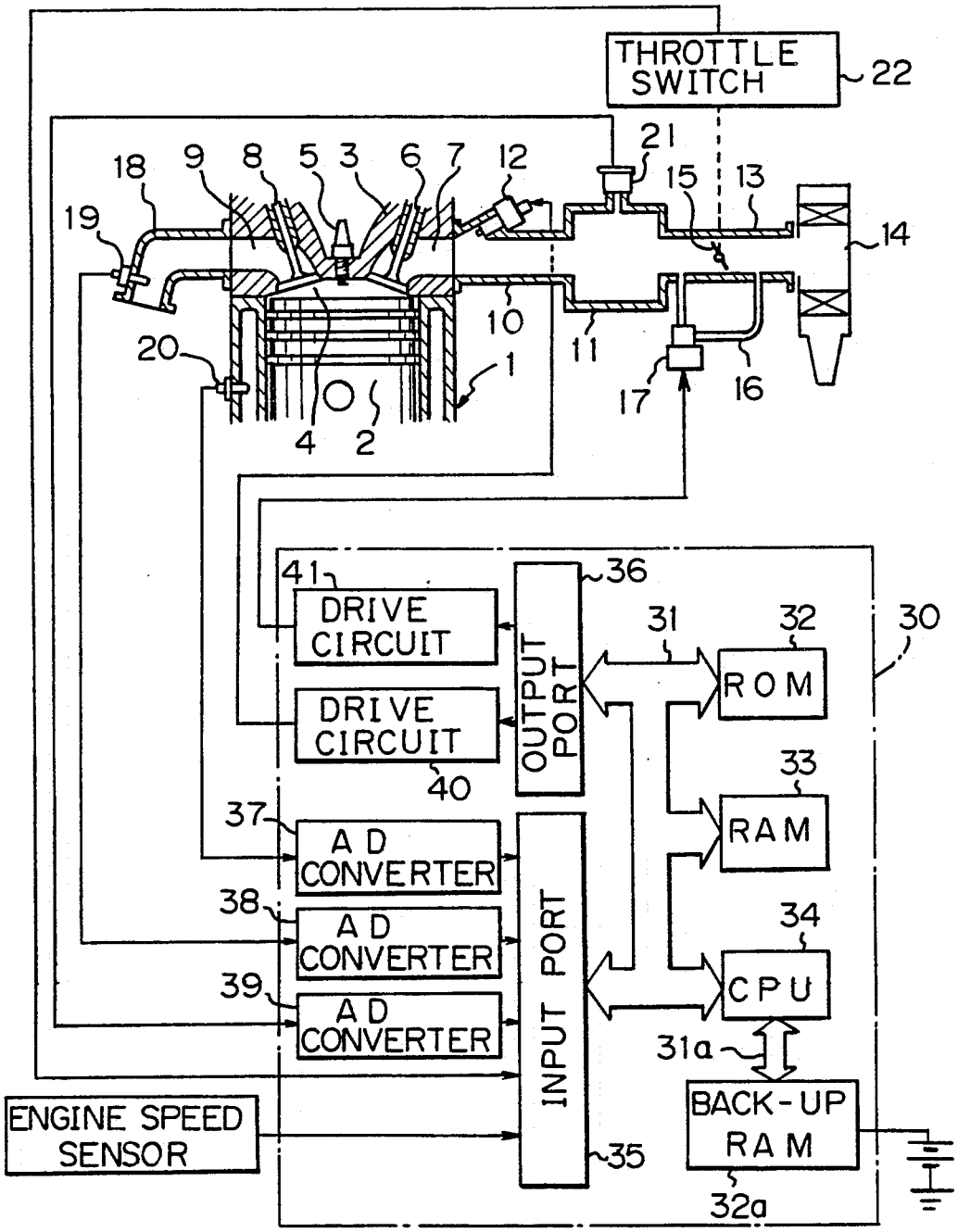
FIG. 1 is a schematically illustrated view of an engine.

Referring to FIG. 1, reference numeral 1 designates an engine body, 2 a piston, 3 a cylinder head, and 4 a combustion chamber formed between the piston 2 and the cylinder head 3; 5 designates a spark plug, 6 an intake valve, 7 an intake port, 8 an exhaust valve, and 9 an exhaust port. The intake port 7 is connected to a surge tank 11 via a corresponding branch pipe 10, and a fuel injector 12 is mounted on the branch pipe 10 to inject fuel into the corresponding intake port 7. The fuel injecting operation by the fuel injector 12 is controlled by a signal output by an electronic control unit 30. The surge tank 11 is connected to an air cleaner 14 via an intake duct 13, and a throttle valve 15 is arranged in the intake duct 13. A bypass passage 16 bypassing the throttle valve 15 is connected to the intake duct 13, and a bypass air control valve 17 is arranged in the bypass passage 16. The exhaust port 9 is connected to an exhaust manifold 18, and an $O_2$ sensor 19 is arranged in the exhaust manifold 18.

The electronic control unit 30 is constructed as a digital computer and comprises a ROM (read only memory) 32, a RAM (random access memory) 33, a CPU (microprocessor etc) 34, an input port 35, and an output port 36. The ROM 32, the RAM 33, the CPU 34, the input port 35 and the output port 36 are interconnected via a bidirectional bus 31. A back-up RAM 32*a* is connected to the CPU 34 via a bus 31*a*.

A coolant temperature sensor 20 producing an output voltage which is proportional to the cooling water temperature of the engine is mounted on the engine body 1, and the output voltage of the coolant temperature sensor 20 is input to the input port 35 via an AD converter 37. The output voltage of the $O_2$ sensor 19 is also input to the input port 35 via an AD converter 38. An absolute pressure sensor 21 producing an output voltage which is proportional to the absolute pressure in the surge tank 11 is arranged in the surge tank 11, and the output voltage of the absolute pressure sensor 21 is input to the input port 35 via an AD converter 39. A throttle switch 22 is attached to the throttle valve 15, to detect that the throttle valve 15 is completely closed, and the output signal of the throttle switch 22 is input to the input port 35. An engine speed sensor 23 produces an output pulse each time the crankshaft (not shown) is rotated by a predetermined crankangle, and the output pulse of the engine speed sensor 23 is input to the input port 35. The engine speed is calculated from this output pulse, in the CPU 34. The output port 36 is connected to the fuel injector 12 and the bypass air control valve 17 via corresponding drive circuits 40 and 41. The bypass air control valve 17 is provided for controlling the idling speed of the engine, and the amount of the bypass air flowing within the bypass passage 16 is controlled by the bypass air control valve 17 so that the engine speed becomes equal to a desired idling speed at the time of idling.

The fuel injection time TAU of the fuel injector 12 is calculated from the following equation.

$$TAU=(TP+K\cdot TPAEW)\cdot FAF\cdot F \quad (1)$$

where

TP: basic fuel injection time

TPAEW: correction fuel injection time for the transition state such as an accelerating state and a decelerating state K: correction coefficient of the correction fuel injection time TPAEW for the deposit FAF: feedback correction coefficient F: correction coefficient determined by the temperature of the engine cooling water and the temperature of air fed into the engine cylinder etc.

The basic fuel injection time TP is calculated from the engine speed NE and the absolute pressure PM in the surge tank 11. The relationship between the basic fuel injection time TP and the absolute pressure PM, the engine speed NE is experimentally determined so that the air-fuel ratio of the full and air mixture fed into the engine cylinder becomes equal to a desired air-fuel ratio, for example, the stoichiometric air-fuel ratio, when fuel is injected from the fuel injector 12 for the basic fuel injection time TP in a cruising operating state of the engine, and this relationship is stored in the ROM 32. Consequently, when the cruising operation of the engine is carried out, if fuel is injected from the fuel injector 12 for the basic fuel injection time TP, which is calculated on the basis of the relationship, stored in the ROM 32, between the absolute pressure PM and the engine speed NE, the air-fuel ratio of the mixture fed into the engine cylinder becomes essentially approximately equal to the desired air-fuel ratio. At this time, if the $O_2$ sensor 19 which can detect any air-fuel ratio is used, it is possible to freely use any air-fuel ratio as the desired air-fuel ratio. Nevertheless, the present invention will be hereinafter described with regard to the case wherein the desired air-fuel ratio is the stoichiometric air-fuel ratio, so that the present invention can be easily understood. In this case, if fuel is injected from the fuel injector 12 for the basic fuel injection time TP, the air-fuel ratio of mixture fed into the engine cylinder becomes essentially approximately equal to the stoichiometric air-fuel ratio.

When the engine operating state is not a transition state, i.e., when the cruising operation of the engine is carried out, the correction fuel injection time TPEAW becomes equal to zero. Consequently, at this time, the above-mentioned equation (1) can be represented as follows.

$$TAU=TP\cdot FAF\cdot F \quad (2)$$

Namely, at this time, the fuel injection time TAU is determined by the basic fuel injection time TP, the feedback correction coefficient FAF, and the correction coefficient F. In this case, the correction coefficient F is determined by the temperature of the engine cooling water and the temperature of air fed into the engine cylinder, etc. For example, this correction coefficient F becomes more than 1.0 before the completion of a warm-up period of the engine, wherein the cooling water temperature is low, and this correction coefficient F becomes equal to 1.0 or nearly 1.0 after the completion of a warm-up of the engine. In addition, the feedback correction coefficient FAF changes in response to the output signal of the $O_2$ sensor 19 so that the air-fuel ratio of mixture fed into the engine cylinder becomes equal to the stoichiometric air-fuel ratio.

Next, the feedback correction coefficient FAF will be described.

The $O_2$ sensor 19 produces an output voltage of about 0.1 volt when the air-fuel ratio of the mixture fed into the engine cylinder is higher than the stoichiometric air-fuel ratio, i.e., when the air-fuel mixture is lean, and the $O_2$ sensor 19 produces an output voltage of about 0.9 volt when the air-fuel ratio of the mixture is lower than the stoichiometric air-fuel ratio, i.e., when the air-fuel mixture is rich. Consequently, it can be determined, on the basis of the output signal of the $O_2$ sensor 19, whether the air-fuel mixture is lean or rich.

Figure 2:
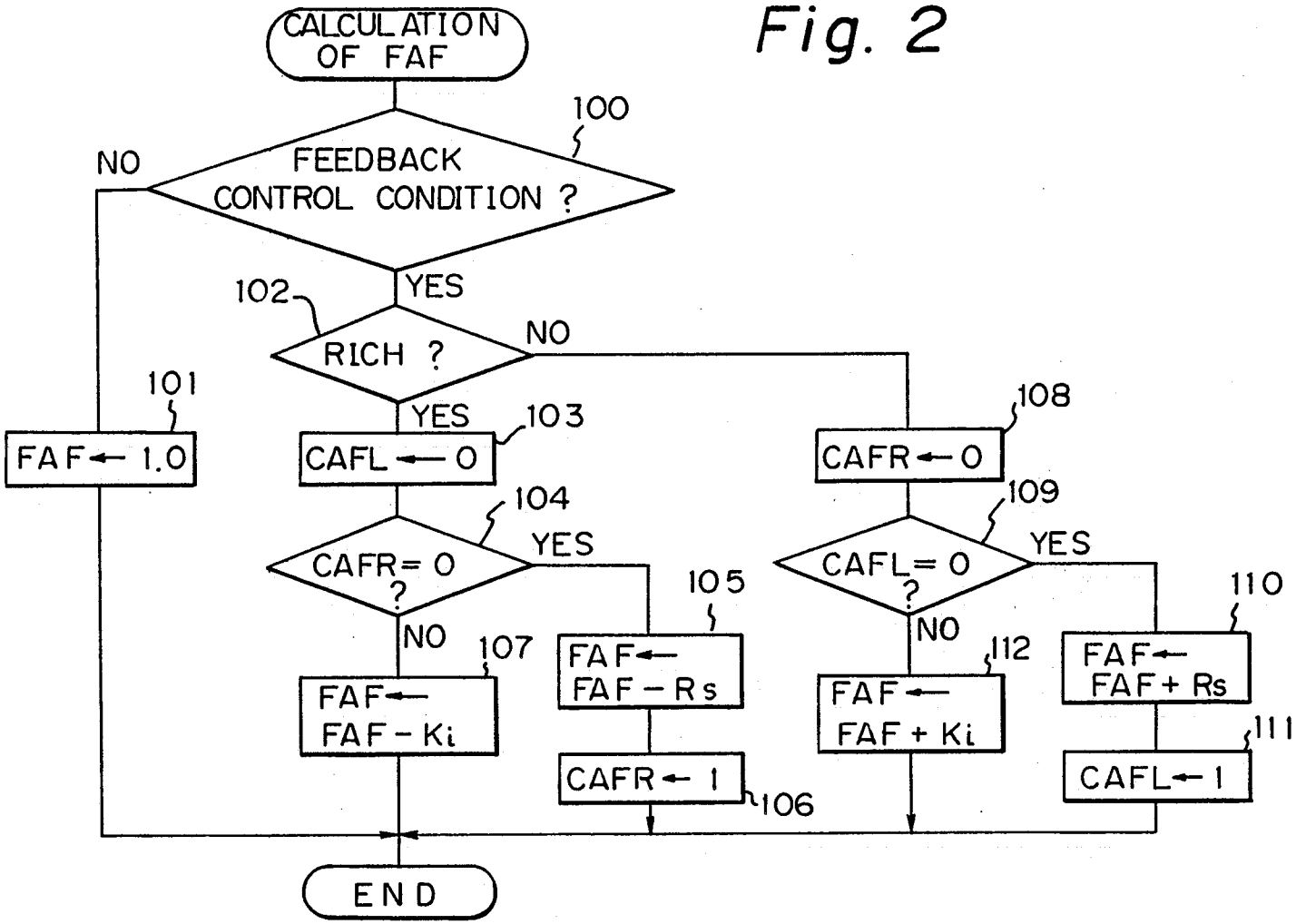
FIG. 2 is a flow chart for calculating the feedback correction coefficient FAF.

FIG. 2 illustrates a routine for calculating the feedback correction coefficient FAF on the basis of the signal output by the $O_2$ sensor 19.

Figure 3:
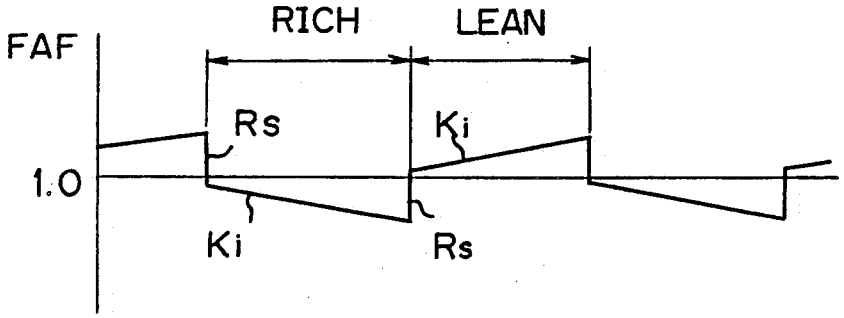
FIG. 3 is a diagram illustrating a change in the feedback correction coefficient FAF.

Referring to FIG. 3, in step 100 it is determined whether or not the feedback control condition is satisfied. It is determined that the feedback control condition is satisfied when the operating state of the engine is not an engine starting state and when the temperature of the engine cooling water is higher than a predetermined temperature. When the feedback control condition is not satisfied, the routine goes to step 101 and the feedback control coefficient FAF becomes 1.0. Consequently, when the feedback control condition is not satisfied and when the cruising operation of the engine is carried out, the fuel injection time is calculated from the following equation.

$$TAU=TP\cdot F$$

When it is determined that the feedback control condition is satisfied, the routine goes to step 102 and it is determined, on the basis of the $O_2$ sensor 19, whether or not the air-fuel mixture fed into the engine cylinder is rich. If the air-fuel mixture was lean in the preceding processing cycle, and if the air-fuel mixture becomes rich in the present processing cycle, the routine goes to step 103 and the flag CAFL is reset. Then, in step 104 it is determined whether or not the flag CAFR, which is reset when the air-fuel mixture changes from rich to lean, has been reset. When the air-fuel mixture changes from lean to rich, since the flag CAFR has been reset, the routine goes to step 105 and a predetermined skip value Rs is subtracted from the feedback control coefficient FAF. Then, in step 106 the flag CAFR is set. Consequently, in the next processing cycle, the routine goes from step 104 to step 107 and a predetermined fixed value Ki($Ki << Rs$) is subtracted from the feedback correction coefficient FAF.

When the air-fuel mixture changes from rich to lean, the routine goes to step 108 and the flag CAFR is reset. Then, in step 109 it is determined whether or not the flag CAFL has been reset. At this time, since the flag CAFL has been reset, the routine goes to step 110, and the predetermined skip value Rs is added to the feedback control coefficient FAF. Then, in step 111, the flag CAFL is set. Consequently, in the next processing cycle, the routine goes from step 109 to step 112 and the predetermined fixed value Ki is added to the feedback correction coefficient FAF. Consequently, the feedback correction coefficient FAF changes as illustrated in FIG. 3. When the air-fuel mixture becomes rich, since the feedback control coefficient FAF becomes small, the fuel injection time TAU becomes short. Conversely, when the air-fuel mixture becomes lean, since the feedback control coefficient FAF becomes large, the fuel injection time TAU becomes long. Thus, the air-fuel ratio of the mixture is controlled so that it becomes equal to the stoichiometric air-fuel ratio.

As mentioned above, when the cruising operation of the engine is carried out, and when the feedback control of the air-fuel ratio is carried out, the air-fuel ratio of the mixture fed into the engine cylinder is controlled so that it becomes equal to the stoichiometric air-fuel ratio. Where the fuel injection time TAU is calculated by using the above-mentioned equation (2), however, when the operating state of the engine is a transition state, such as an acceleration state and a deceleration state, the air-fuel ratio of the mixture deviates from the stoichiometric air-fuel ratio even if the feedback control is carried out and even if a deposit is not adhered to the inner wall of the intake port, etc. Namely, when the engine is accelerated, the air-fuel mixture temporarily becomes lean, and when the engine is decelerated, the air-fuel mixture temporarily becomes rich. Such a deviation of the air-fuel ratio occurring at the time of a transition state of the engine is based, on one hand, on the time lag until the fuel injecting operation is actually carried out after the calculation of the fuel injection time TAU is started, and on the other hand, on the time lag until the liquid fuel adhering to the inner wall of the intake port, etc., flows into the engine cylinder. These time lags, generated at the time of acceleration, will now be described with reference to FIGS. 4 and 5.

Figure 4:
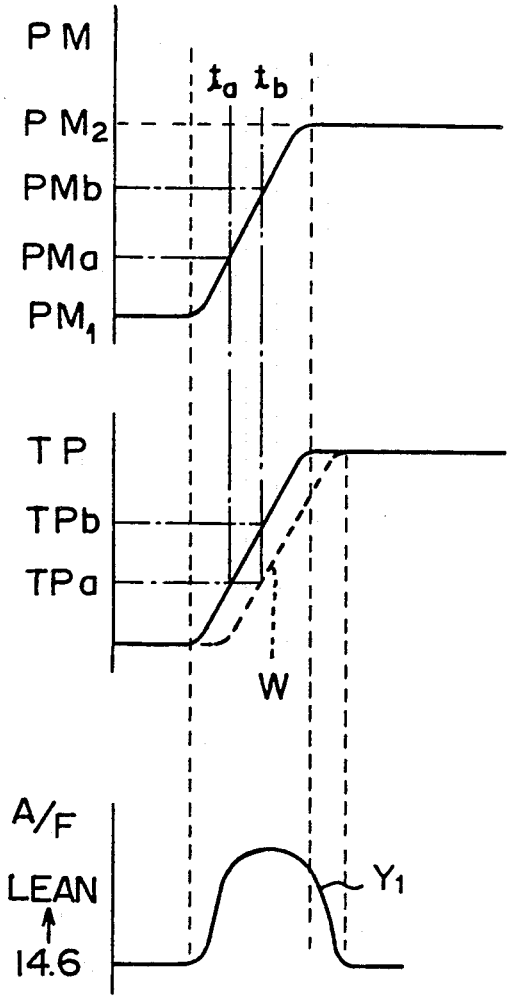
FIG. 4 is a diagram illustrating the deviation of the air-fuel ratio, caused by the delay time of the actual injection.

FIG. 4 illustrates the deviation of the air-fuel ratio based on the time lag until the fuel injecting operation is actually carried out after the calculation of the fuel injection time TAU is started. As illustrated in FIG. 4, if the engine is accelerated, and thus the absolute pressure PM in the surge tank 11 is increased from PMl to PM2, the basic fuel injection time TP calculated from the absolute pressure PM and the engine speed NE is increased accordingly. Assuming that the calculation of the fuel injection time TAU is started at a time ta, since the absolute pressure PM is equal to PMa at this time, the basic fuel injection time TP is calculated based on PMa, and this calculated basic fuel injection time TP is defined as TPa.

The calculation of the fuel injection time TAU is usually started at a predetermined crank angle, and after the crankshaft has rotated through a predetermined angle, the actual fuel injecting operation is started. Namely, in FIG. 4, if the calculation of the fuel injection time TAU is started at a time ta, the actual fuel injection is started at a time tb. At the time tb, however, the absolute pressure PM is increased to PMb, which is higher than PMa, and thus the basic fuel injection time TPb, which is necessary for equalizing the air-fuel ratio of the mixture with the stoichiometric air-fuel ratio at the time tb, becomes longer than the basic fuel injection time TPa. Nevertheless, in the time tb, since fuel is injected by only the time calculated based on the basic fuel injection time TPa, the amount of fuel actually injected by the fuel injector 12 becomes smaller than the amount of fuel necessary for equalizing the air-fuel ratio of mixture with the stoichiometric air-fuel ratio, and thus the air-fuel mixture becomes lean. Namely, in practice, since the basic fuel injection time TP changes along the broken line W in FIG. 4, the air-fuel mixture becomes lean as illustrated by $Y_1$ during the time illustrated by the broken line W.

Figure 5:
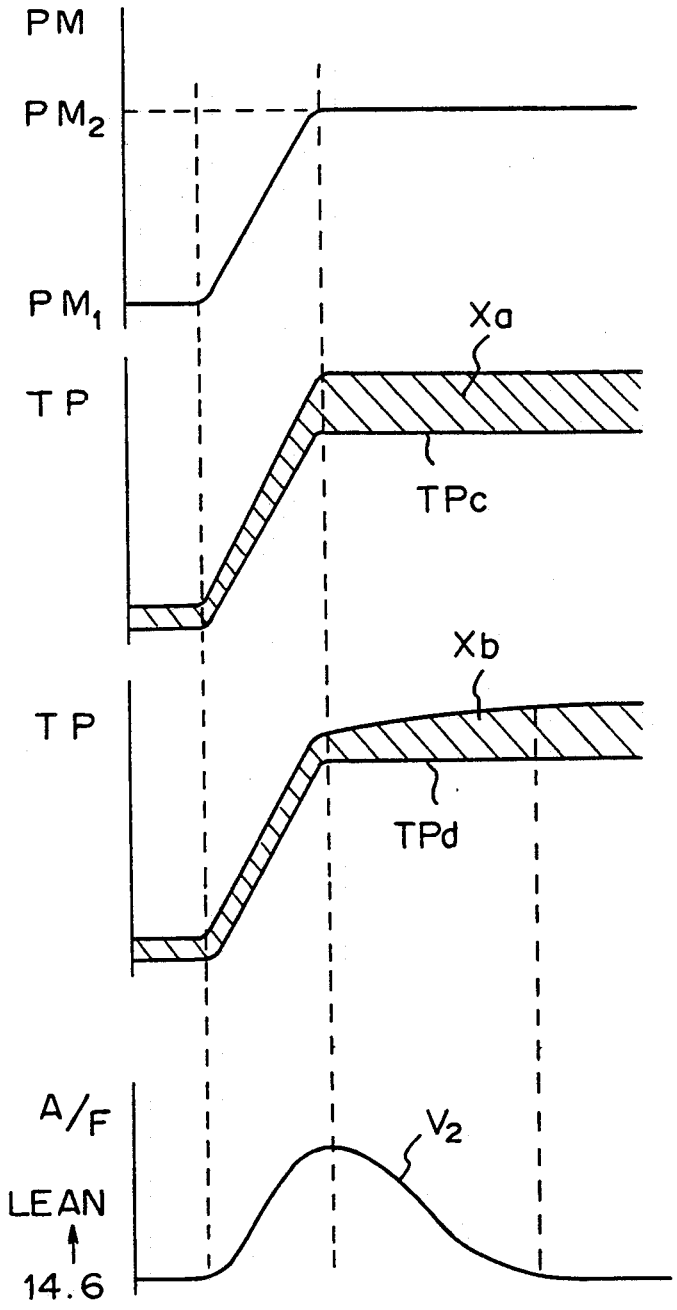
FIG. 5 is a diagram illustrating the deviation of the air-fuel ratio, caused by the delay time of the actual inflow of liquid fuel into the engine cylinder.

FIG. 5 illustrates the deviation of the air-fuel ratio based on the time lag until the liquid fuel adhering to the inner wall of the intake port, etc. flows into the engine cylinder. FIG. 5 also illustrates the case wherein the absolute pressure PM is increased from PMl to PM2. In FIG. 5, the curved lines TPc and TPd indicate a change in the basic fuel injection time TP, and the hatching Xa and Xb indicates the amount of liquid fuel flowing into the engine cylinder, which depends on the amount of fuel injected by the fuel injector 12, i.e., on the amount of liquid fuel adhering to the inner wall of the intake port, etc., and the amount of liquid fuel flowing into the engine cylinder is increased as the amount of fuel injected by the fuel injector 12 is increased, when the cruising operation of the engine is carried out, the amount of liquid fuel flowing into the engine cylinder is maintained at an approximately constant value, and at this time, the amount of liquid fuel flowing into the engine cylinder is increased as the engine load becomes higher. The hatching Xa illustrates the case wherein it is assumed that the amount of fuel flowing into the engine cylinder at each absolute pressure PM is the same as that when the cruising operation of the engine is carried out. In this case, also at the time of acceleration, the air-fuel ratio of mixture fed into the engine cylinder is maintained at the stoichiometric air-fuel ratio. In practice, however, when the accelerating operation of the engine is carried out, even if the amount of liquid fuel adhering to the inner wall of the intake port, etc. is increased, since all of the liquid fuel does not immediately flow into the engine cylinder, the amount of liquid fuel flowing to the engine cylinder at the time of acceleration becomes smaller than that illustrated by the hatching Xa. As the amount of liquid fuel adhering to the inner wall of the intake port, etc. is increased, the amount of liquid fuel flowing into the engine cylinder is gradually increased, and after the completion of the accelerating operation of the engine, the amount of liquid fuel flowing into the engine cylinder becomes equal to that during the cruising operation of the engine. The hatching Xb indicates the amount of liquid fuel which actually flows into the engine cylinder. Consequently, as can be seen from FIG. 5, the amount of liquid fuel Xb flowing into the engine cylinder becomes smaller than that of the amount of liquid fuel Xa flowing during the cruising operation of the engine until some time has elapsed after the completion of the accelerating operation of the engine, and consequently, during this time, the air-fuel mixture becomes lean as illustrated by $Y_2$.

Figure 6:
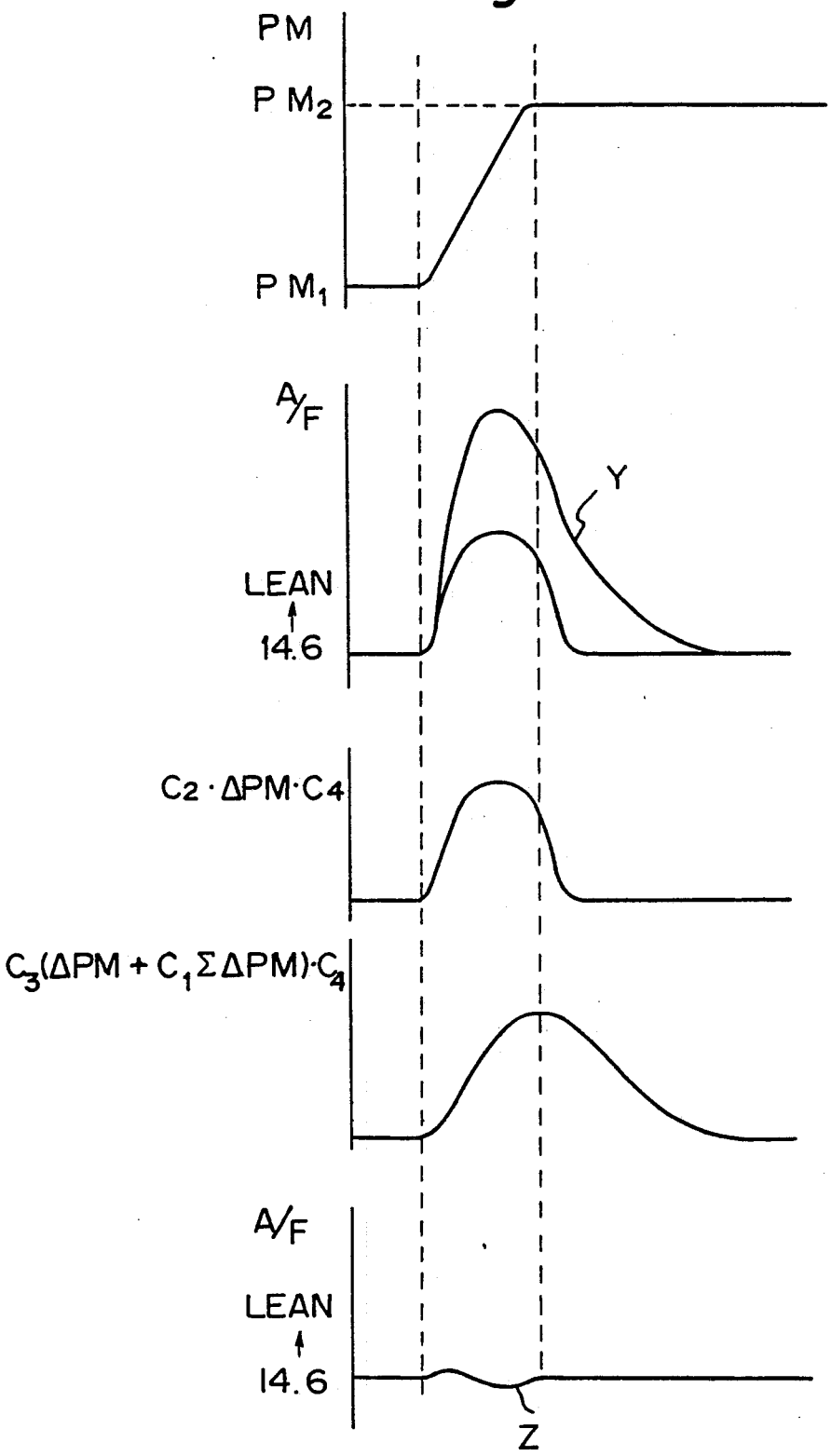
FIG. 6 is a diagram illustrating the amount of fuel to be increased or decreased at the time of acceleration.

Therefore, at the time of acceleration, as illustrated by Y in FIG. 6, the shape of the lean curve is formed by superposing the lean curve $Y_1$ on the lean curve $Y_2$. Accordingly, as illustrated in FIG. 6, if the amount of fuel injected by the fuel injector 12 is increased by an amount $C_2.\Delta PM.C_4$ which corresponds to the lean curve $Y_1$, and at the same time, if the amount of fuel injected by the fuel injector 12 is increased by an amount $C_3.(\Delta PM+C_1.\Delta PM).C_4$ which corresponds to the lean curve $Y_2$, the air-fuel mixture is maintained at approximately the stoichiometric air-fuel ratio as illustrated by Z. In the above-mentioned amounts corresponding to the lean curves $Y_1$ and $Y_2$, $\Delta PM$ indicates a rate of change of the absolute pressure PM, and $C_4$ indicates a coefficient for converting the absolute pressure PM to time.

Namely, in FIG. 4, the shortage (TPb−TPa) of the basic fuel injection time TP is approximately equal to a value obtained by multiplying the time $(t_b-t_a)$ by $\Delta PM.C_4$ which is at $t_a$, and if the time $(t_b-t_a)$ is represented by $C_2$, the shortage of the basic fuel injection time TP can be represented as $C_2.\Delta PM.C_4$. In this case, since the time $(t_b-t_a)$ corresponds to the rotation angle of the crankshaft, $C_2$ is a function of the engine speed NE.

The curved line corresponding to the line curve $Y_2$ can be represented by $C_3.(\Delta P+C_1\Sigma\Delta PM).C_4$. Note, $C_1$ denotes an attenuation coefficient and is smaller than 1.0. This $C_3.(\Delta P+C_1\Sigma\Delta PM).C_4$ is calculated when calculating the fuel injection time TAU. The value of $C_3.(\Delta P+C_1\Sigma\Delta PM).C_4$ is rapidly increased when $\Delta PM$ is large, and the value of $C_3.(\Delta P+C_1\Sigma\Delta PM).C_4$ is gradually reduced when $\Delta PM$ becomes small. When the engine temperature or the temperature of air fed into the engine cylinder becomes low, the amount of liquid fuel adhering to the inner wall of the intake port, etc., is increased, and accordingly, the air-fuel mixture becomes leaner. Consequently, $C_3$ is a function of both the engine temperature and the temperature of air fed into the engine cylinder.

Therefore, if the amount of fuel injected by the fuel injector 12 is increased by an amount equal to the sum of $C_2.\Delta PM.C_4$ and $C_3.(\Delta PM+C_1\Sigma\Delta PM).C_4$ at the time of acceleration, the air-fuel mixture can be maintained at the stoichiometric air-fuel ratio. This amount of fuel to be increased at the time of acceleration represents the correction fuel injection time TPAEW in the above-mentioned equation (1), and thus TPAEW is represented as follows.

$$TPAEW=\{C_2.\Delta PM+C_3.(\Delta PM+C_1\Sigma\Delta M)\}.C_4 \quad (3)$$

In addition, where the fuel injection time tAU is calculated based on the above-mentioned equation (2), at the time of deceleration, the air-fuel mixture becomes rich and changes along the rich curves which are similar to the lean curves $Y_1$ and $Y_2$ illustrated in FIGS. 4 and 5. Consequently, at this time, if using TPAEW shown in the above-mentioned equation (3) during the calculation of the fuel injection time TAU, the air-fuel mixture fed into he engine cylinder is maintained at the stoichiometric air-fuel ratio. At this time, however, since $\Delta PM$ becomes negative, TPAEW also becomes negative.

Consequently, where carbon is not deposited on the inner wall of the intake port, etc., if the fuel injection time TAU is calculated by the following equation, it is possible to maintain the air-fuel mixture at the stoichiometric air-fuel ratio, regardless of the operating state of the engine.

$$TAU=(TP+TPAEW).FAF.F \quad (4)$$

Nevertheless, when the engine has been used for a long time, and thus a carbon deposit is adhered to the inner wall of the intake port, etc., since this deposit has a physical nature of retaining liquid fuel, the amount of liquid fuel adhering to the inner wall of the intake port, etc., is increased, and thus the time required for the liquid fuel to flow into the engine cylinder is prolonged. Consequently, where the deposit is adhered to the inner wall of the intake port, etc., if the above-mentioned equation (4) is used to calculate the fuel injection time TAU, the air-fuel mixture will deviate from the stoichiometric air-fuel ratio. Namely, at the time of acceleration, since the inflow of liquid fuel to the engine cylinder is delayed due to the presence of the deposit, the air-fuel mixture becomes lean, and at the time of deceleration, since the amount of liquid fuel adhering to the inner wall of the intake port, etc., is increased due to the presence of the deposit, the air-fuel mixture becomes rich.

Therefore, to maintain the air-fuel ratio of mixture at the stoichiometric air-fuel ratio even if the deposit is adhered to the inner wall of the intake port, etc., the correction fuel injection time TPAEW is multiplied by the correction coefficient K, and an increase or a decrease in the amount of fuel injected by the fuel injector 12 at the time of acceleration or deceleration, respectively, is corrected by the correction coefficient K. In this case, as indicated by the above-mentioned equation (1), the fuel injection time TAU is calculated from the following equation.

$$TAU=(TP+K.TPAEW).FAF.F$$

Figure 7A:
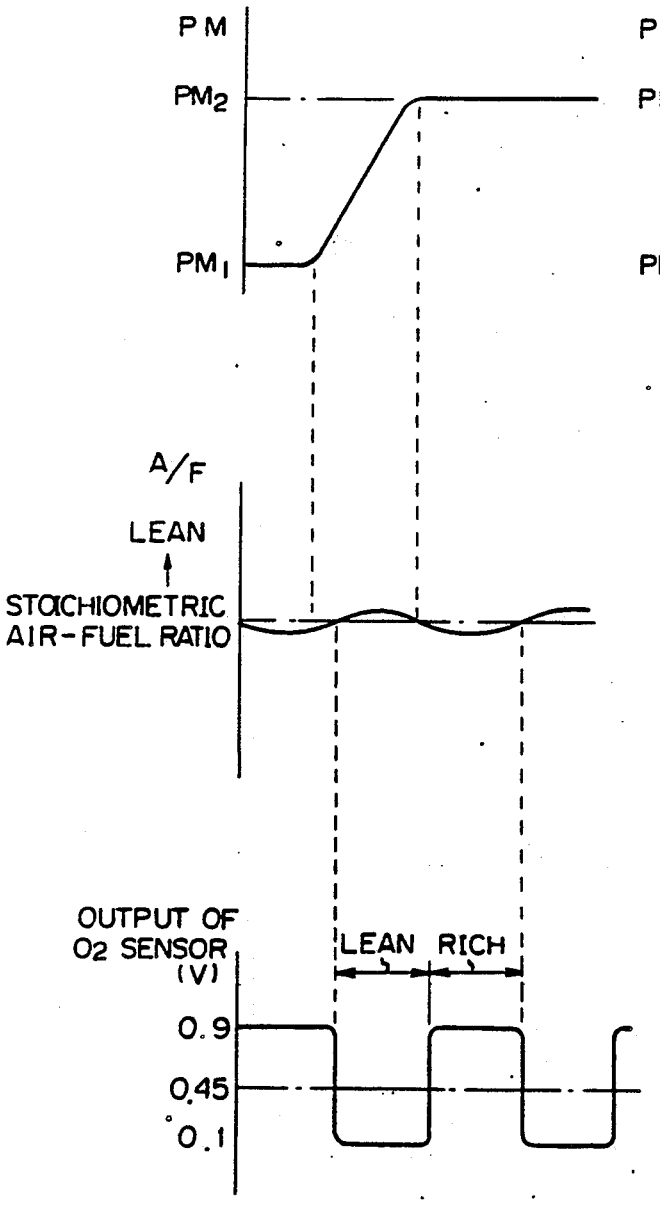
FIGS. 7(A)–7(H) diagrams illustrating the lean state and the rich state of the air-fuel mixture.
Figure 7B:
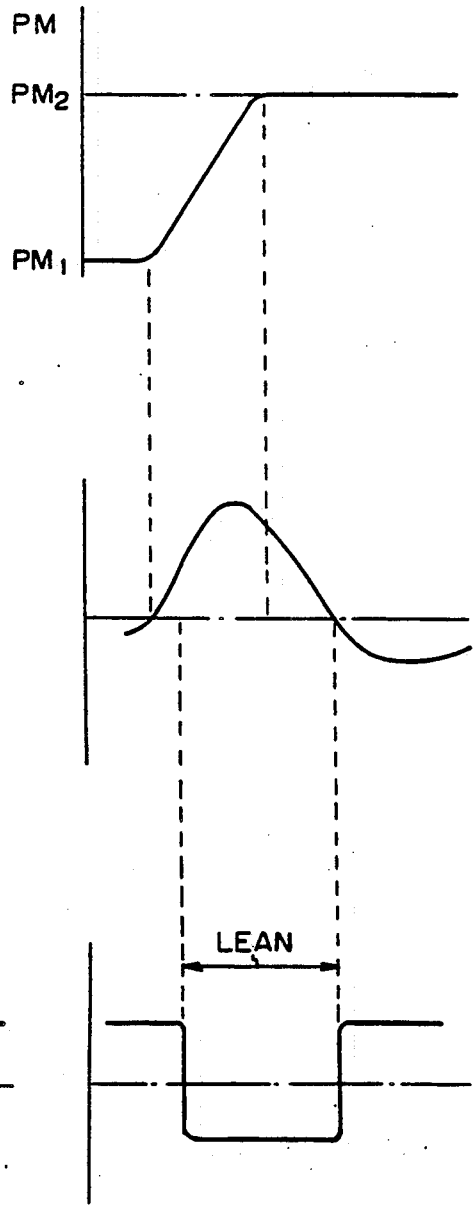

Namely, when a deposit is not adhered to the inner wall of the intake port, etc., and thus the air-fuel ratio of mixture is maintained at the stoichiometric air-fuel ratio even when the accelerating operation of the engine is carried out, as illustrated in FIG. 7(A), the lean state and the rich state of the air-fuel mixture is alternately repeated at almost the same time frequency, after the accelerating operation of the engine is started. Consequently, at this time, the lean time and the rich time become almost the same. Conversely, if the deposit is adhered to the inner wall of the intake port, etc., as illustrated in FIG. 7(B), the air-fuel mixture temporarily becomes lean at the time of acceleration, and as a result as illustrated by FIG. 7(B), the lean time after the start of acceleration becomes longer than the rich time. Conversely, if the air-fuel mixture temporarily becomes rich at the time of deceleration, the rich time after the start of acceleration becomes longer than the lean time. Therefore, by comparing the lean time with the rich time, it is possible to determine whether or not the air-fuel mixture is temporarily lean or rich.

Therefore, generally, if the lean time becomes longer than the rich time, and the difference between the lean time and the rich time exceeds a fixed time at the time of acceleration, the correction coefficient K is increased, and thus an acceleration increasing ratio of the amount of fuel is increased. Conversely, if the rich time becomes longer than the lean time, and the difference between the rich time and the lean time exceeds a fixed time at the time of acceleration, the correction coefficient K is decreased, and thus the acceleration increasing ratio of the amount of fuel is decreased.

On the other hand, if the rich time becomes longer than the lean time, and the difference between the rich time and the lean time exceeds a fixed time at the time of deceleration, the correction coefficient K is increased, and thus a deceleration reducing rate of the amount of fuel is increased. Conversely, if the lean time becomes longer than the rich time, and the difference between the lean time and the rich time exceeds a fixed time, the correction coefficient K is decreased, and thus the deceleration reducing rate of the amount of fuel is decreased.

Next, the routine for calculating the correction coefficient K, i.e., the deposit learning coefficient K, will be described on the basis of the flow chart illustrated in FIGS. 9 and 10 with reference to the time chart illustrated in FIG. 8. This routine is processed by sequential interruptions which are executed at every crankangle of 360°.

Figures 9, 9A:
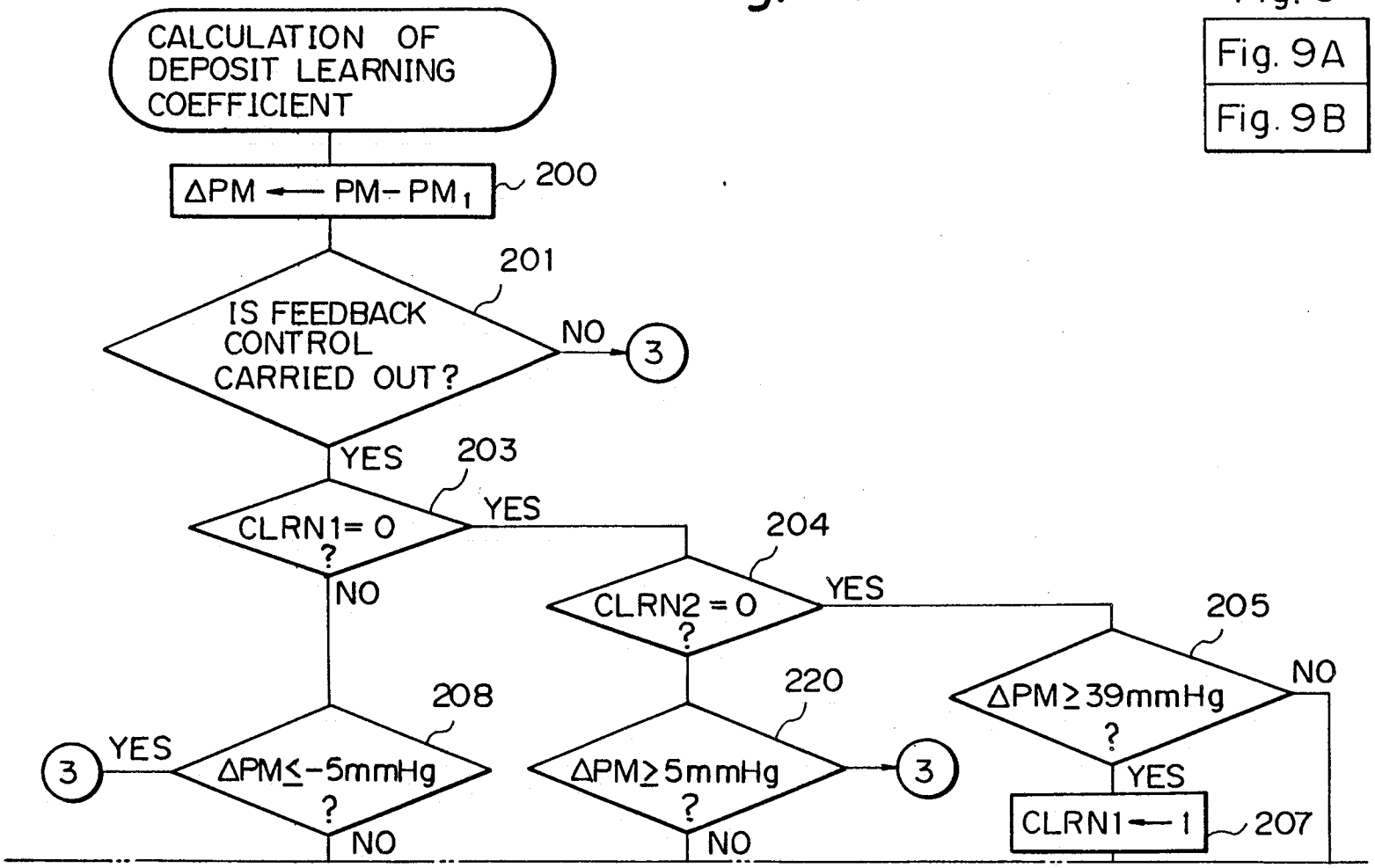
Figure 9B:
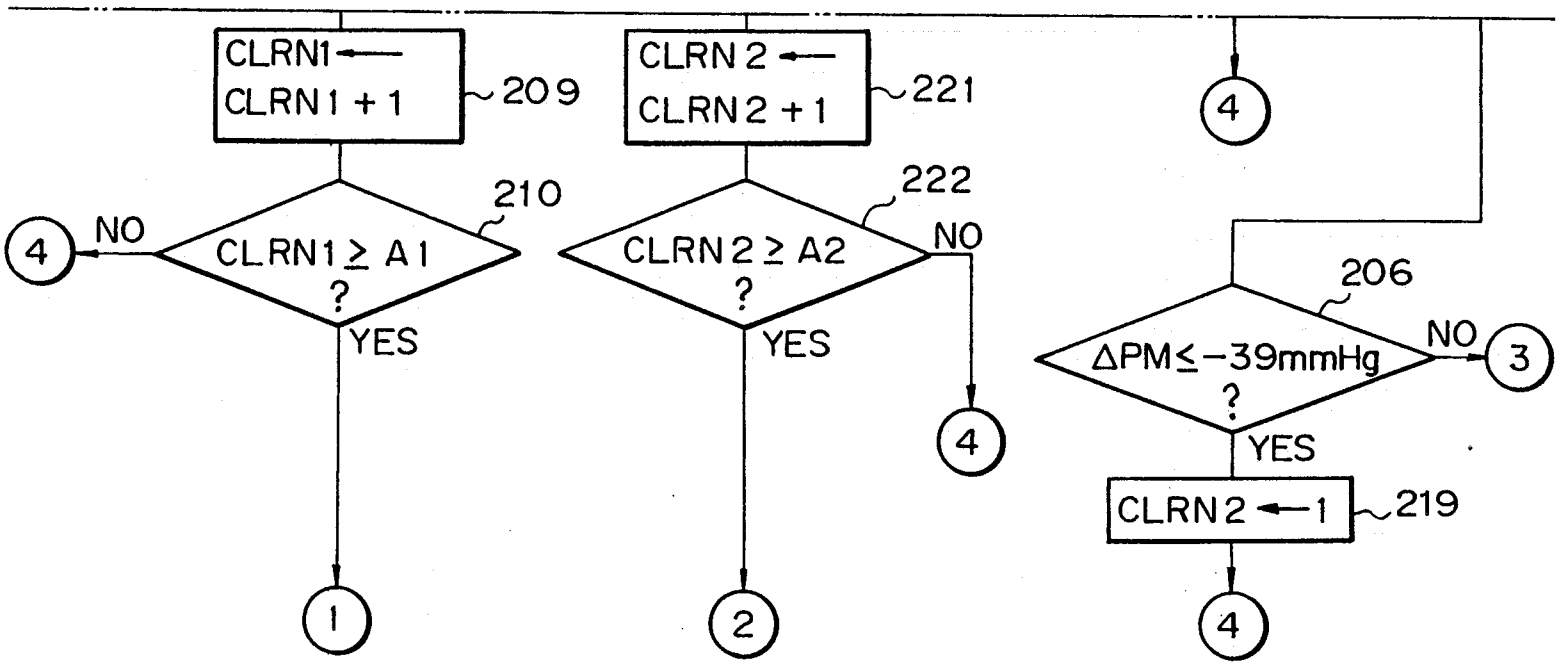
Figure 10:
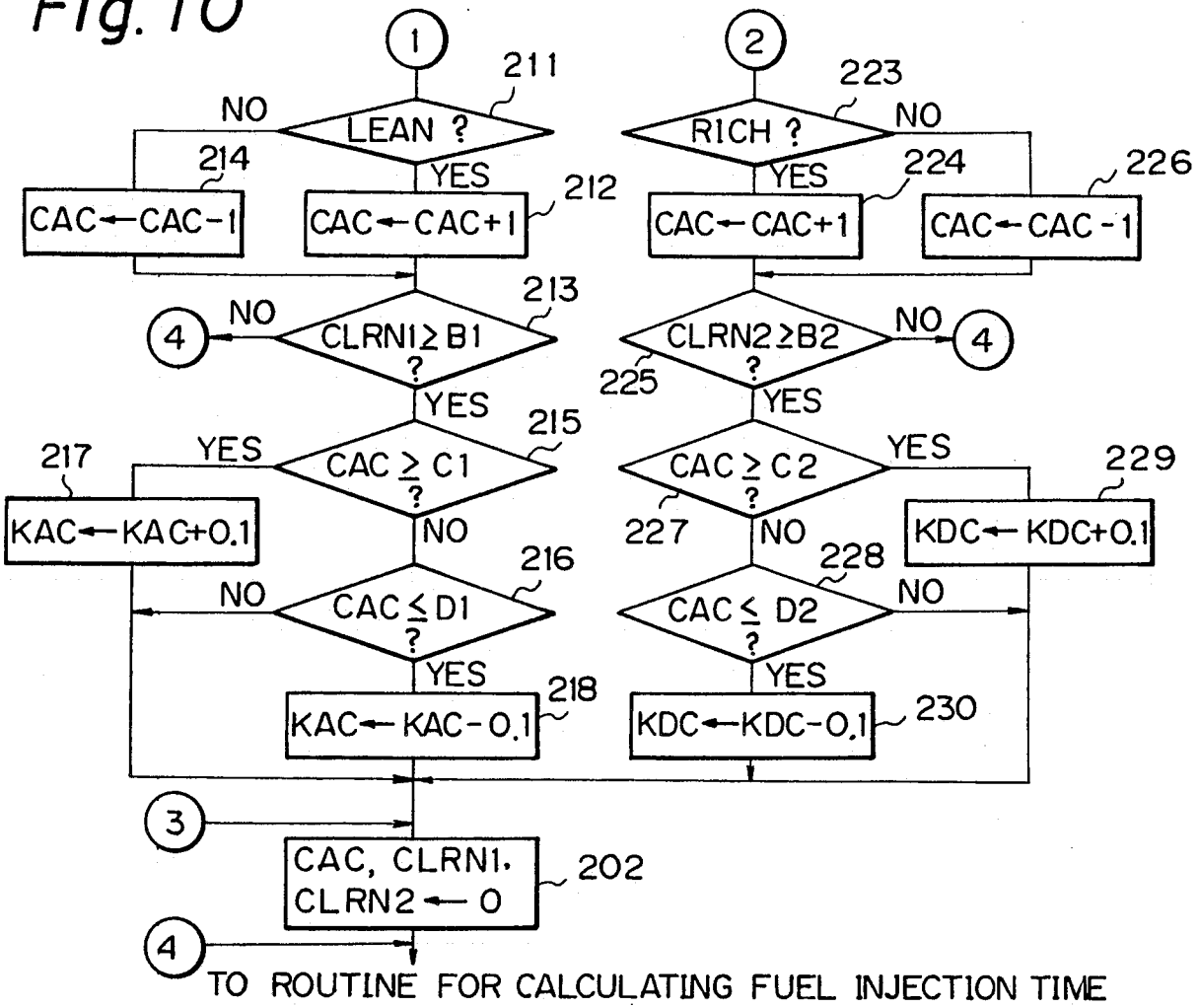

Referring to FIGS. 9 and 10, in step 200 the absolute pressure $PM_1$ in the surge tank 11, which is detected by the absolute pressure sensor 21 in the preceding processing cycle, is subtracted from the present absolute pressure PM in the surge tank 11, and the result of the subtraction $\Delta PM$ is memorized as a changing rate of the absolute pressure $\Delta PM$. Then, in step 201 it is determined, on the basis of the $O_2$ sensor 19, whether or not the feedback control has been carried out. If the feedback control has not been carried out, the routine goes to step 202 and counters CAC, CLRN 1 and CLRN 2 are cleared. When the feedback control is started, the routine goes to step 203 and it is determined whether or not the counter CLRN 1 is cleared. At this time, since the counter CLRN 1 is cleared, the routine goes to step 204 and it is determined whether or not the counter CLRN 2 is cleared. At this time, since the counter CLRN 2 is cleared, the routine goes to step 205. In step 205 it is determined whether or not $\Delta PM$ is larger than a fixed value, for example, 39 mmHg, i.e., an accelerating operation of the engine has been carried out. If $\Delta PM <$ 39 mmHg, it is determined that an accelerating operation of the engine has not been carried out, and the routine goes to step 206. In step 206 it is determined whether or not $\Delta PM$ is smaller than a fixed value, for example $-39$ mmHg, i.e., the decelerating operation of the engine has been carried out. If $\Delta PM < -39$ mmHg, it is determined that the decelerating operation of the engine has not been carried out and the routine goes to step 202. In step 202, the counters CAC, CLRN 1 and CLRN 2 are cleared.

When it is determined in step 205 that $\Delta PM$ is larger than 39 mmHg, i.e., the accelerating operation of the engine has been carried out, the routine goes to step 207 and 1 is set in the counter CLRN 1. Then, the routine goes to a routine for calculating the fuel injection time. In the next processing cycle, the routine goes from step 203 to step 208, and it is determined whether or not $\Delta PM$ has become smaller than $-5$ mmHg, i.e., the engine is decelerated after the accelerating operation of the engine has been started. If $\Delta PM \leqq -5$ mmHg, the routine goes to step 202 and the counters CAC, CLRN 1 and CLRN 2 are cleared.

Conversely, when the accelerating operation of the engine is continuously carried out, since $\Delta PM$ becomes larger than $-5$ mmHg, the routine goes from step 208 to step 209 and the counter CLRN 1 is incremented by one. That is, as illustrated in FIG. 8(A), when the accelerating operation of the engine is started and the absolute pressure PM increases from $PM_1$ to $PM_2$, if $\Delta PM$ exceeds 39 mmHg, the count up operation of the counter CLRN 1 is started.

Then, in step 210 it is determined whether or not the count value of the counter CLRN 1 exceeds a predetermined fixed value Al. If CLRN 1<Al, the routine goes to the routine for calculating the fuel injection time. When CLRN 1 exceeds Al, the routine goes to step 211 and it is determined from the output signal of the $O_2$ sensor 19 whether or not the air-fuel mixture fed into the engine cylinder is lean. When the air-fuel mixture is lean, the routine goes to step 212 and the counter CAC is incremented by one. Then the routine goes to step 213. When the air-fuel mixture is not lean, i.e., is rich, the routine goes to step 214 and the counter CAC is decremented by one. Then the routine goes to step 213. In step 213, it is determined whether or not the count value of the counter CLRN 1 exceeds a predetermined fixed value Bl. If CLRN 1<Bl, the routine goes to the routine for calculating the fuel injection time. That is, as illustrated in FIG. 8(A), it is determined whether the air-fuel mixture is lean or rich during the time in which the count value of the counter CLRN 1 increases from Al to Bl. During this time, when the air-fuel mixture becomes lean the counter CAC is counted up, and when the air-fuel mixture becomes rich the counter CAC is counted down. Thus, during the time in which the count value of the counter CLRN 1 increases from Al to Bl, if the lean time becomes longer than the rich time the count value of the counter CAC is increased, and if the rich time becomes longer than the lean time the count value of the counter CAC is reduced. Consequently, from the count value of the counter CAC at the moment when the count valve of the counter CLRN 1 reaches B1, it is possible to determine whether the air-fuel mixture has become lean or rich at the time of acceleration.

As mentioned above, in the embodiment illustrated in FIG. 8, during the time in which the count value of the counter CLRN 1 increases from Al to Bl it is determined whether or not the air-fuel mixture has become lean or rich, and accordingly, the time in which the count value of the counter CLRN 1 increases from Al to Bl becomes a lean-rich discriminating time.

Next, this lean-rich discriminating time will be described with reference to FIGS. 7(C), (D), (E), (F), (G) and (H). In these Figures, the lean-rich discriminating time is indicated by L, L′ or L″.

Figure 7C:
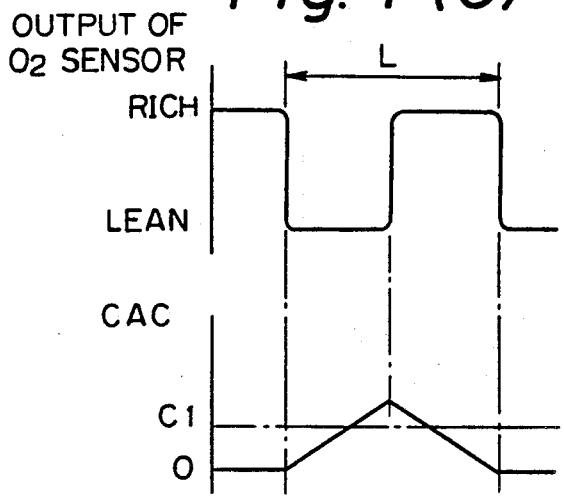
Figure 7D:
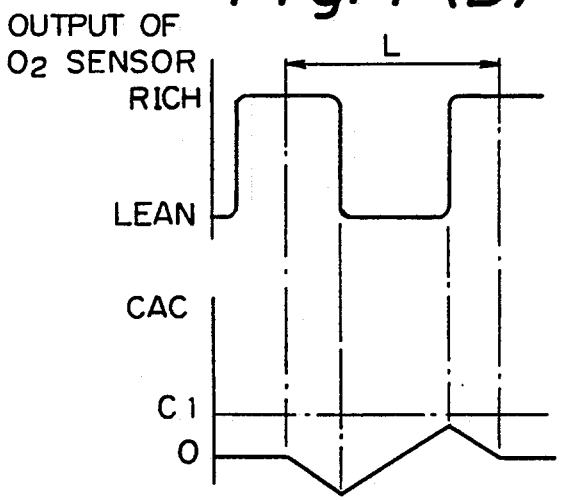

FIGS. 7(C), (D) and (E) illustrate changes in the output voltage of the $O_2$ sensor 19 and in the count value of the counter CAC when the engine is accelerated, when a deposit is not adhered to the inner wall of the intake port, etc. In this case, as illustrated in FIGS. 7(C), (D) and (E), the lean state and the rich state are alternately repeated at almost the same time frequency, even if the accelerating operation of the engine is carried out. In the embodiment illustrated in FIG. 8, as illustrated in FIG. 7(C), the lean-rich discriminating time L is determined so that it becomes equal to a time in which the lean state or the rich state occurs when the accelerating operation of the engine is carried out. Namely, the predetermined values Al and Bl for the counter CLRN 1 are determined so that the time in which the counter value of the counter CLRN 1 increases from Al to Bl becomes equal to a time in which the lean state or the rich state occurs at the time of acceleration. If the lean-rich discriminating time L is determined as mentioned above, when a deposit is adhered to the inner wall of the intake port, etc., the lean time and the rich time in the lean-rich discriminating time L become almost the same, as illustrated in FIGS. 7(C) and (D). Consequently, when the lean-rich discriminating time L ends, the count value of the counter CAC becomes equal to zero.

Figure 7E:
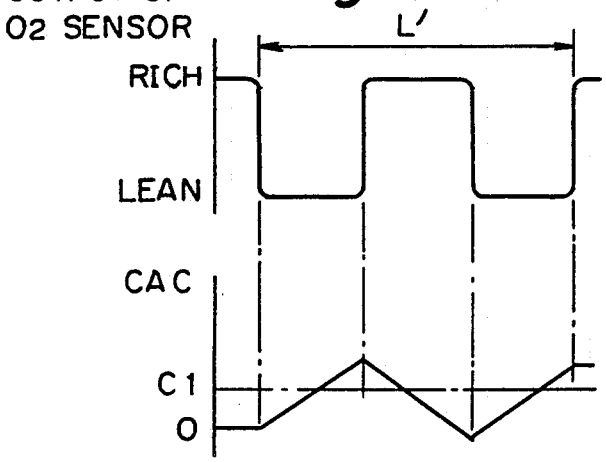

Conversely, as illustrated in FIG. 7(E), if the lean-rich discriminating time L' is determined so that it becomes equal to one and a half times the time in which the lean state or rich state occur, the lean time becomes longer than the rich time in the lean-rich discriminating time L'. Consequently, when the lean-rich discriminating time L' ends, the count value of the counter CAC becomes large. Therefore, if the routine for calculating the deposit learning coefficient is programmed to determine that, if the count value of the counter CAC exceeds Cl when the lean-rich discriminating time L' ends, the air-fuel mixture becomes lean, the wrong determination is obviously made. To avoid this wrong determination, as illustrated in FIGS. 7(C) and (D), the lean-rich discriminating time L must be determined so that it becomes equal to a time in which the lean state or the rich state occur, as illustrated in FIG. 7(C) and (D).

As mentioned above, in the embodiment illustrated in FIG. 8, the lean-rich discriminating time L corresponds to the time in which the counter value of the counter CLRN 1 increases from Al to Bl. Accordingly, since the injecting operation of fuel is normally started at a predetermined crankangle, and the routine illustrated in FIGS. 9 and 10 is processed by sequential interruptions executed at every crankangle of 360°, the fuel injecting operation is carried out at fixed times regardless of the engine speed during the time in which the count value of the counter CLRN 1 increases from Al to Bl. Namely, the fuel injecting operation is effected at fixed times, regardless of the engine speed within the lean-rich discriminating time L. The air-fuel ratio of mixture changes each time the fuel injecting operation is carried out, and since the feedback control of the air-fuel ratio is carried out for such a change in the air-fuel ratio, the time in which the lean state or the rich state occurs depends on the number of fuel injections. Consequently, the lean-rich discriminating time L becomes approximately equal to a time in which the lean state and the rich state occur, regardless of the engine speed, i.e., regardless of the degree of acceleration.

Figure 7F:
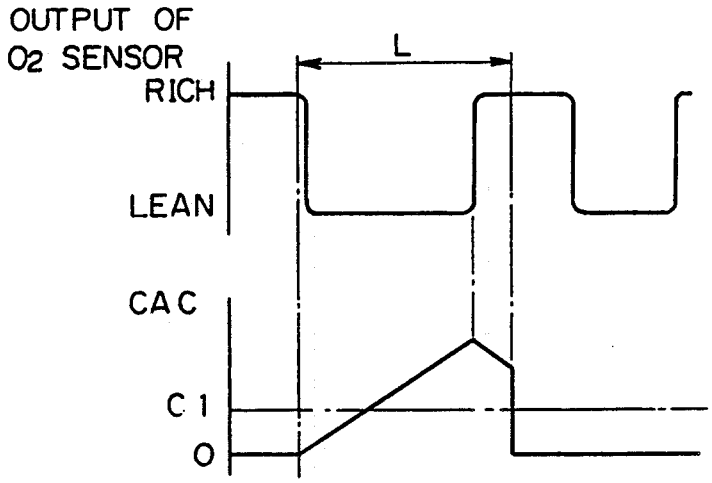
Figure 7G:
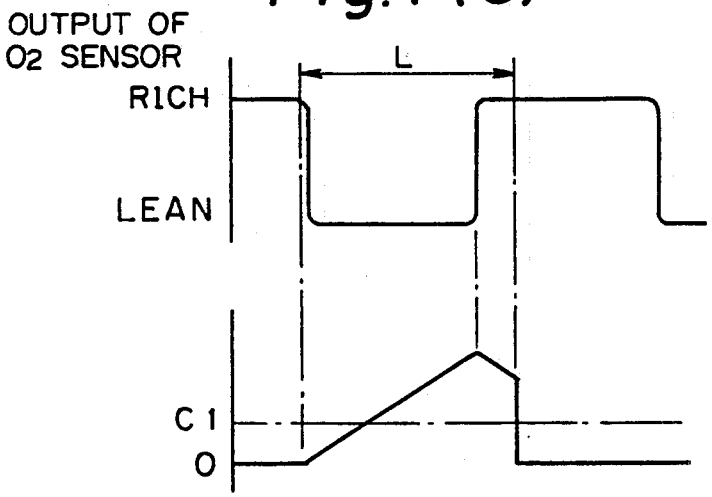
Figure 7H:
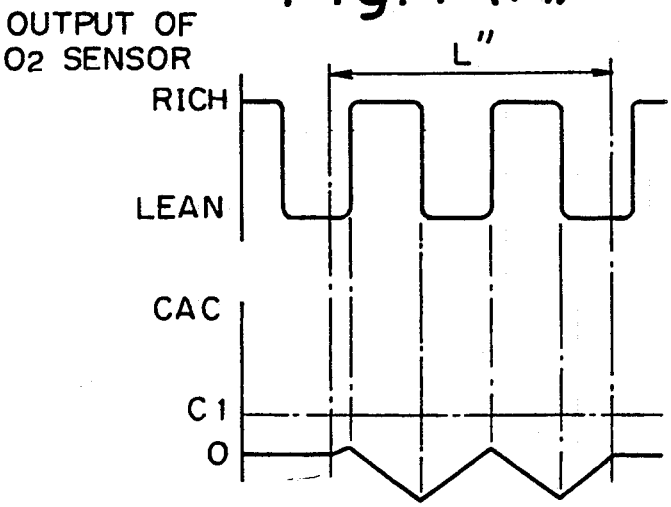

If the deposit is adhered to the inner wall of the intake port, etc., when the engine is accelerated, the air-fuel mixture becomes lean. Consequently, at this time, as illustrated in FIGS. 7(F) and (G), the lean time becomes long compared with the case illustrated in FIG. (C) and (D). Therefore, the lean time becomes longer than the rich time in the lean-rich discriminating time L, and thus when the lean-rich discriminating time L ends, the count value of the counter CAC becomes large. Consequently, it is possible to determine that the air-fuel mixture has become lean at the time of acceleration, because the count value of the counter CAC exceeds Cl. As illustrated in FIGS. 7(F) and (G), when the lean-rich discriminating time L ends, the air-fuel mixture is in the rich time. This rich time becomes short as illustrated in FIG. 7(F), or becomes long as illustrated in FIG. 7(G), due to the control system for the fuel injection. But if the lean-rich discriminating time L is determined so that it becomes approximately equal to a time in which the lean state or the rich state occur, where a deposit is not adhered to the inner wall of the intake port, etc., it is possible to correctly determine that the air-fuel mixture has become lean due to the presence of the deposit, regardless of whether the rich time in which the lean-rich discriminating time L ends is short or long, as illustrated in FIGS. 7(F) or (G), respectively.

Where the control system for the fuel injection is constructed so that the rich time in which the lean-rich discriminating time L ends becomes short as illustrated in FIG. 7(F), it is possible to determine the lean-rich discriminating time L'' so that it becomes equal to an integral number of times, for example, twice as long as a time in which the lean time or the rich time occurs at the time of acceleration, where a deposit is not adhered to the inner wall of the intake port, etc., as illustrated in FIG. 7(H).

As illustrated in FIG. 8, the discrimination of lean and rich is not carried out before the count value of the counter CLRN 1 reaches Al. This is because a fixed time must pass before the air-fuel mixture becomes an exhaust gas and then reaches the $O_2$ sensor 19.

Turning to FIG. 10, if it is determined in step 213 that the count value of the counter CLRN 1 becomes larger than Bl, the routine goes to step 215 and it is determined whether or not the count value of the counter CAC is larger than a predetermined positive fixed value Cl. If $CAC \leqq Cl$, the routine goes to step 216 and it is determined whether or not the count value of the counter CAC is smaller than a predetermined negative fixed value D1. If $CAC > D1$, the routine goes to step 202 and the counters CAC, CLRN 1 and CLRN 2 are cleared. If it is determined in step 215 that the count value of the counter CAC is larger than Cl, i.e., when the air-fuel mixture becomes lean at the time of acceleration, the routine goes to step 217, and in step 217 a predetermined fixed value, for example, 0.1, is added to the acceleration correction coefficient KAC, and thus the acceleration correction coefficient KAC is increased. Conversely, if it is determined in step 216 that the count value of the counter CAC is smaller than D1, the routine goes to step 218, and in step 218 a predetermined fixed value, for example, 0.1, is subtracted from the acceleration correction coefficient KAC, and thus the acceleration correction coefficient KAC is reduced. Turning to FIG. 9, when it is determined in step 206 that $\Delta PM$ is smaller than $-39$ mmHg, i.e., the decelerating operation of the engine has been carried out, the routine goes to step 219 and 1 is set in the counter CLRN 2. Then, the routine goes to the routine for calculating the fuel injection time. In the next processing cycle, the routine goes from step 204 to step 220, and it is determined whether or not $\Delta PM$ has become larger than 5 mmHg, i.e., the engine has been accelerated after the decelerating operation of the engine is started. If $\Delta PM \geqq 5$ mmHg, the routine goes to step 202 and the counters CAC, CLRN 1 and CLRN 2 are cleared.

Conversely, when the decelerating operation of the engine is continuously carried out, since $\Delta PM$ becomes smaller than 5 mmHg, the routine goes from step 220 to step 221 and the counter CLRN 2 is incremented by one. That is, as illustrated in FIG. 8(B), when the decelerating operation of the engine is started, and the absolute pressure PM decreases from $PM_2$ to $PM_1$, if $\Delta PM$ becomes smaller than $-39$ mmHg, the count up operation of the counter CLRN 2 is started.

Then, in step 222 it is determined whether or not the count value of the counter CLRN 2 exceeds a predetermined fixed value A2. If CLRN $2 < A2$, the routine goes to the routine for calculating the fuel injection time. When CLRN 2 exceeds A2, the routine goes to step 233 and it is determined from the output signal of the $O_2$ sensor 19 whether or not the air-fuel mixture fed into the engine cylinder is rich. When the air-fuel mixture is rich, the routine goes to step 224 and the counter CAC is incremented by one. Then the routine goes to step 225. When the air-fuel mixture is not rich, i.e., is lean, the routine goes to step 226 and the counter CAC is decremented by one. Then the routine goes to step 225. In step 225, it is determined whether or not the count value of the counter CLRN 2 exceeds a predetermined fixed value B2. If CLRN $2 < B2$, the routine goes to the routine for calculating the fuel injection time. That is, as illustrated in FIG. 8(B), it is determined whether the air-fuel mixture is rich or lean during the time in which the count value of the counter CLRN 2 increases from A2 to B2, i.e., within the lean-rich discriminating time for the decelerating operation, which is the same as the lean-rich discriminating time L illustrated in FIG. 7(C). During this time, when the air-fuel mixture becomes rich, the counter CAC is counted up, and when the air-fuel mixture becomes lean, the counter CAC is counted down. Thus, during the time in which the count value of the counter CLRN 2 increases from A2 to B2, i.e., within the lean-rich discriminating time, if the rich time becomes longer than the lean time, the count value of the counter CAC is increased, and if the lean time becomes longer than the rich time, the count value of the counter CAC is reduced. Consequently, from the count value of the counter CAC at the moment when the count valve of the counter CLRN 2 reaches B2, it is possible to determine whether the air-fuel mixture has become rich or lean at the time of deceleration.

In step 225, if it is determined that the count value of the counter CLRN 2 becomes larger than B2, the routine goes to step 227 and it is determined whether or not the count value of the counter CAC is larger than a predetermined positive fixed value C2. If $CAC \leqq C2$, the routine goes to step 228 and it is determined whether or not the count value of the counter CAC is smaller than a predetermined negative fixed value D2. If $CAC > D2$, the routine goes to step 202 and the counters CAC, CLRN 1 and CLRN 2 are cleared. If it is determined in step 227 that the count value of the counter CAC is larger than C2, i.e., when the air-fuel mixture becomes rich at the time of deceleration, the routine goes to step 229, and in step 229, a predetermined fixed value, for example, 0.1, is added to the deceleration correction coefficient KDC, and thus the deceleration correction coefficient KDC is increased. Conversely, if it is determined in step 228 that the count value of the counter CAC is smaller than D2, the routine goes to step 230, and in step 230, a predetermined fixed value, for example, 0.1, is subtracted from the deceleration correction coefficient KDC, and thus the deceleration correction coefficient KDC is reduced.

The acceleration correction coefficient KAC and the deceleration correction coefficient KDC represent the correction coefficient K for the correction fuel injection time TPAEW due to the presence of the deposit. Consequently, if the air-fuel mixture becomes lean at the time of acceleration due to the presence of the deposit, the correction coefficient K is increased, and if the air-fuel mixture becomes rich at the time of deceleration due to the presence of the deposit, the correction coefficient K is also increased.

FIG. 11 illustrates a routine for calculating the fuel injection time, which routine is executed successively after the execution of the routine illustrated in FIGS. 9 and 10.

Referring to FIG. 11, in step 300 the basic fuel injection time TP is calculated from the output signals of the absolute pressure sensor 21 and the engine speed sensor 23. Then in step 301 $\Sigma\Delta PM$ is calculated from the following equation.

$$\Sigma\Delta PM = \Delta PM + C_1 \Sigma\Delta PM \quad (5)$$

Then in step 302 the correction fuel injection time TPAEW is calculated from the following equation.

$$TPAEW = (C_2 \cdot \Delta PM + C_3 \cdot \Sigma\Delta PM) \cdot C_4 \quad (6)$$

If the above equations (5) and (6) are combined, the resulting equation becomes as follows.

$$TPAEW = \{C_2 . \Delta PM + C_3 . (\Delta PM + C_1 \Sigma\Delta PM)\} . C_4$$

This equation represents the above-mentioned equation (3), and thus represents an increase or a reduction in the amount of fuel necessary to maintain the air-fuel ratio of the mixture at the stoichiometric air-fuel ratio in a transition operating state, where a deposit is not adhered to the inner wall of the intake port, etc.

Then, in step 303 it is determined whether or not $\Delta PM$ is positive or equal to zero. When it is determined in step 303 that $\Delta PM$ is equal to zero, or it is determined that $\Delta PM$ is positive, i.e., the accelerating operation of the engine is carried out, the routine goes to step 304, and the acceleration correction coefficient KAC is memorized as the correction coefficient K. Then the routine goes to step 306. Conversely, when it is determined in step 304 that $\Delta PM$ is negative, i.e., the decelerating operation of the engine is carried out, the routine goes to step 305, and the deceleration correction coefficient KDC is memorized as the correction coefficient K. Then the routine goes to step 306.

In step 306, the fuel injection time TAU is calculated from the following equation.

$$TAU = (TP + K.TPEAW).FAF.F$$

If the air-fuel mixture becomes lean at the time of acceleration due to the presence of the deposit, the correction coefficient K is increased. Consequently, when the next accelerating operation is carried out, since K.TPAEW, i.e., the acceleration increasing rate of the amount of fuel is increased, the air-fuel ratio of mixture is maintained at the stoichiometric air-fuel ratio.

Conversely, if the air-fuel mixture becomes rich at the time of deceleration due to the presence of the deposit, the correction coefficient K is increased. Consequently, when the next decelerating operation is carried out, since K.TPAEW, i.e., the deceleration reducing rate of the amount of fuel is increased, the air-fuel ratio of mixture is maintained at the stoichiometric air-fuel ratio. Therefore, even if the deposit is adhered to the inner wall of the intake port, etc., it is possible to maintain the air-fuel ratio of mixture at the stoichiometric air-fuel ratio regardless of the operating state of the engine. The above-mentioned acceleration correction coefficient KAC and deceleration correction coefficient KDC are stored in the back-up RAM 33*a*.

When the cruising operation of the engine is carried out, the lean state and the rich state are alternately repeated at approximately the fixed time frequency, and at this time, the lean time is almost the same as the rich time. When the accelerating operation of the engine is carried out, if a deposit is not adhered to the inner wall of the intake port, etc., although the lean time also becomes approximately equal to the rich time, the time frequency of the lean time and the rich time becomes shorter than that in the cruising operation of the engine. Consequently, in the embodiment hereinbefore described, the lean-rich discriminating time L, L″ is determined so that it becomes equal to a fixed time which is shorter than a time of the generation of the lean state or the rich state.

Note, it has been proven that, when the accelerating operation of the engine is carried out, the time of the generation of the lean time or the rich time becomes short as the velocity of air fed into the engine cylinder becomes high. Consequently, to more precisely determine whether or not the air-fuel mixture becomes lean, preferably the lean-rich discriminating time L, L″ is shortened as the velocity of air fed into the engine cylinder becomes high at the time of acceleration.

FIGS. 12 through 17 illustrate another embodiment in which the lean-rich discriminating time L, L″ is changed in accordance with a change in the velocity of air fed into the engine cylinder at the time of acceleration.

Next, the routine for calculating the correction coefficient K, i.e., the deposit learning coefficient K, will be described on the basis of the flow chart illustrated in FIGS. 13 and 14 with reference to the time chart illustrated in FIG. 12. This routine is processed by sequential interruptions executed at every crankangle of 360°.

Figures 13, 13A, 13B:
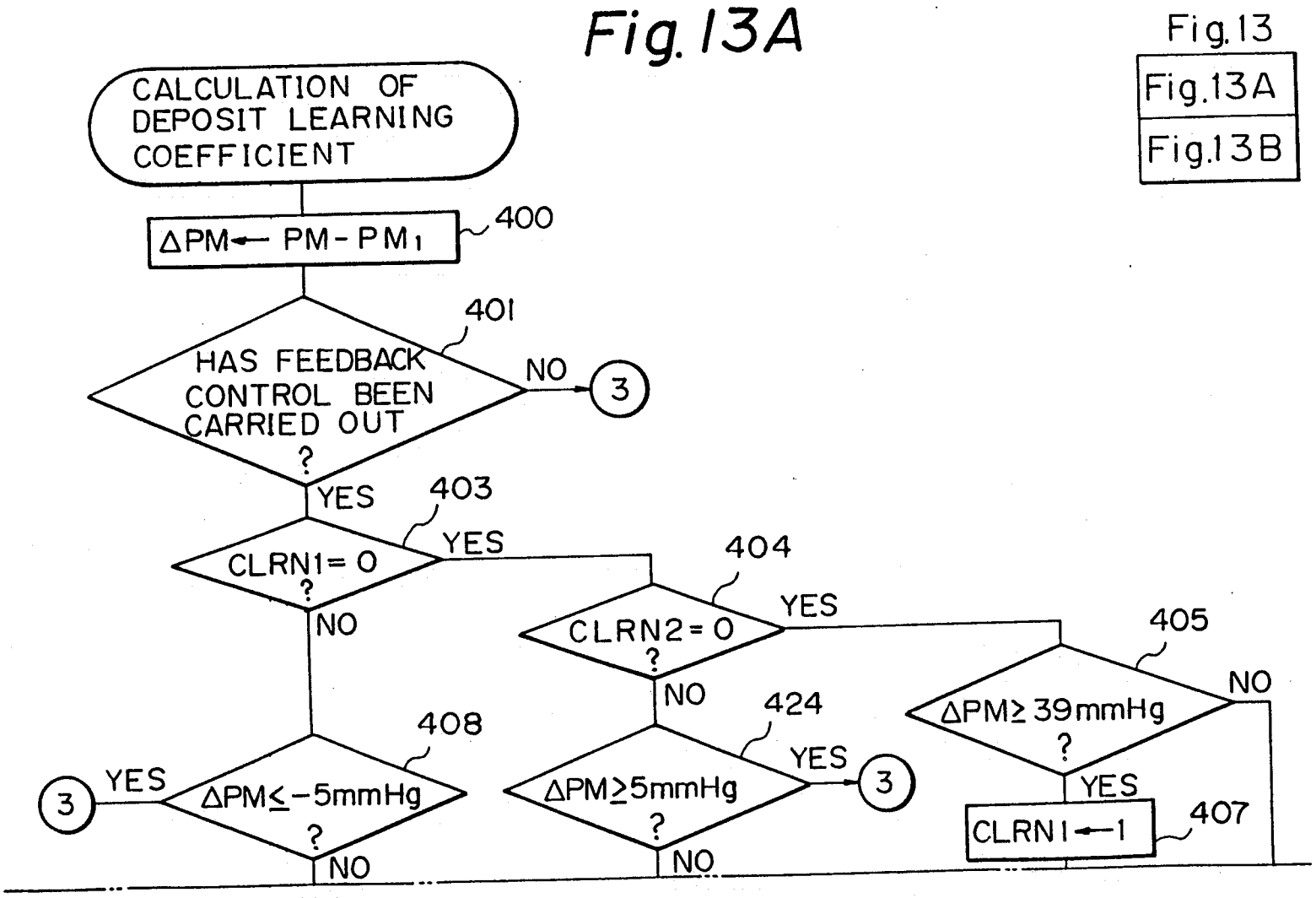
Figure 13B:
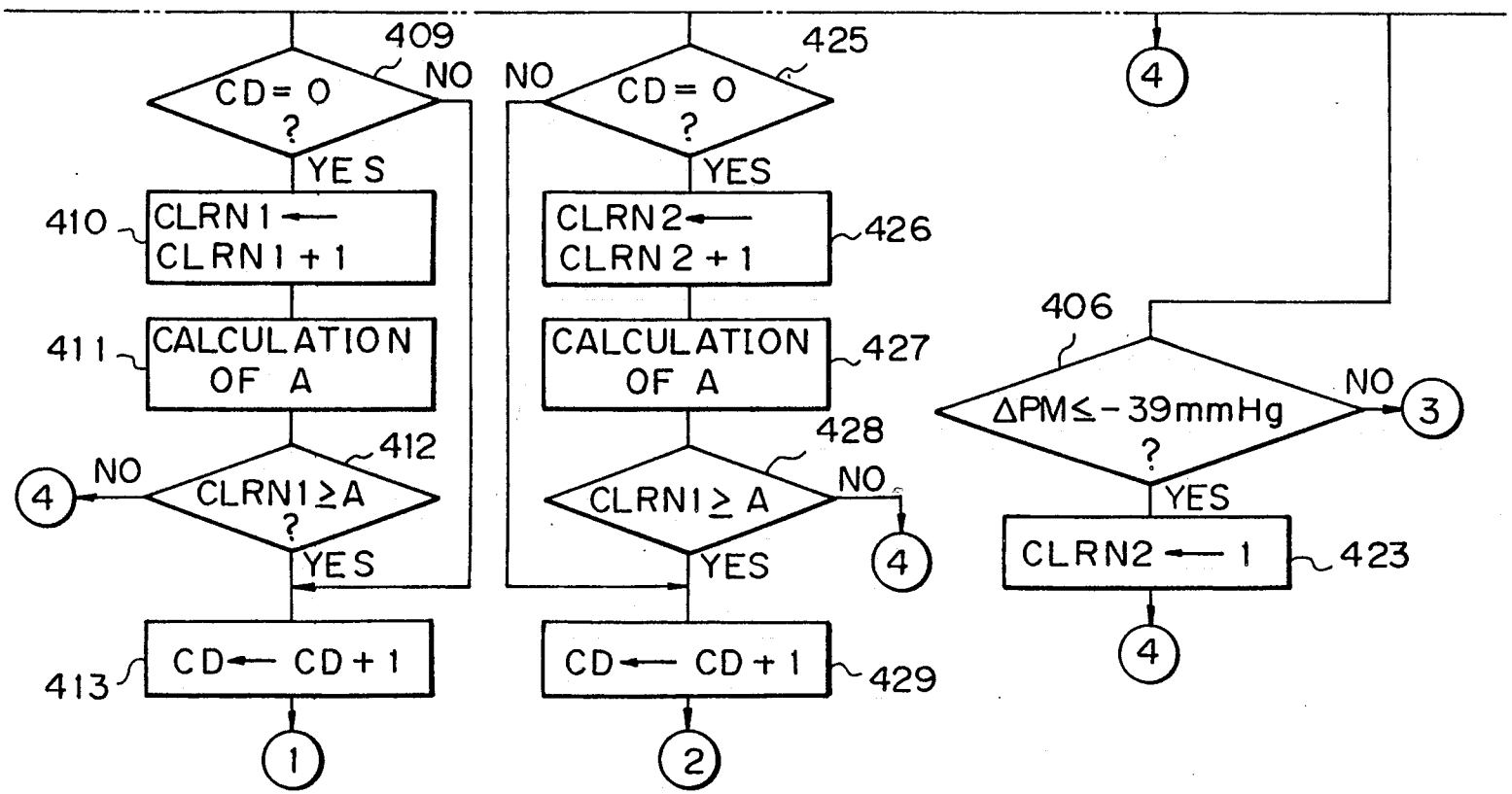
Figure 14:
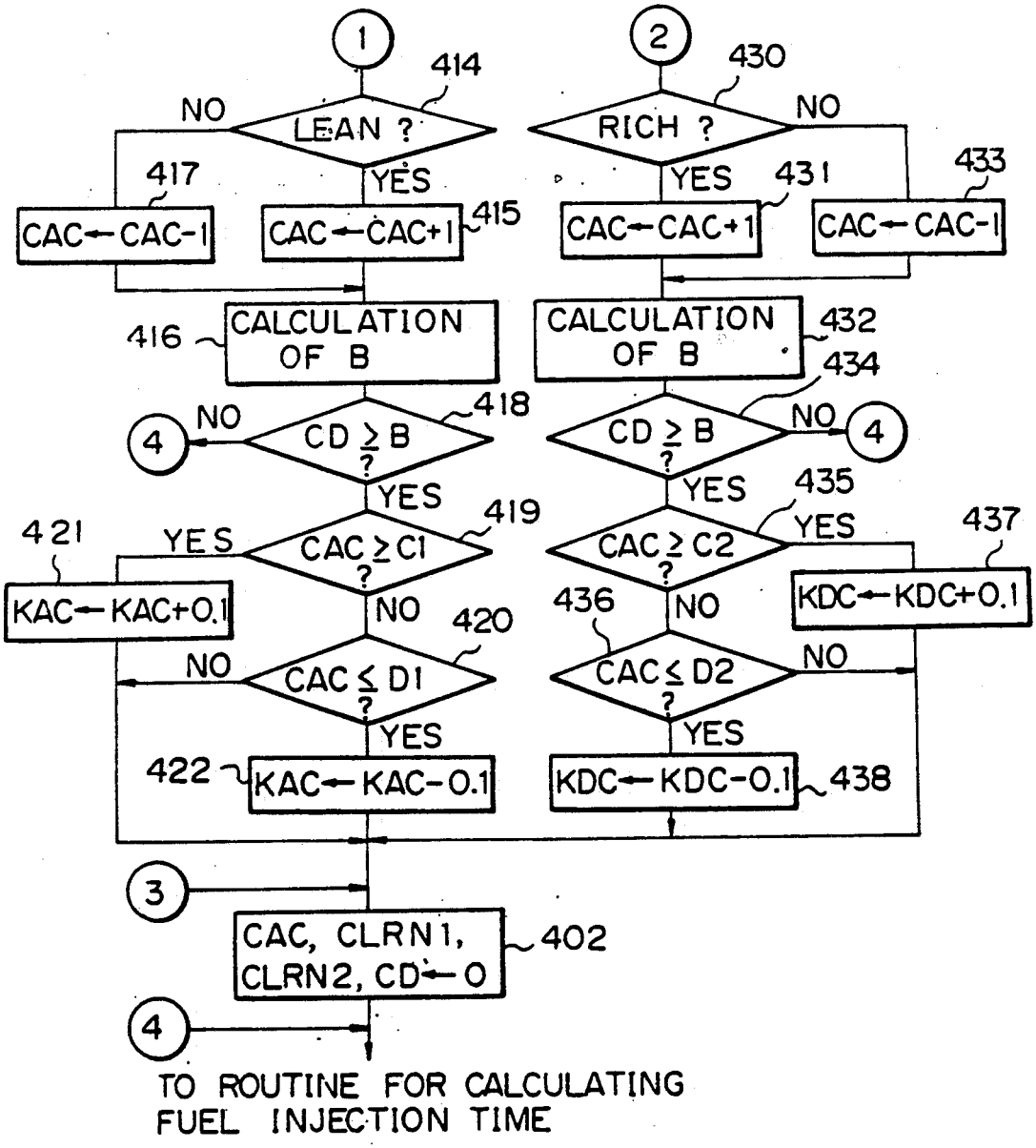

Referring to FIGS. 13 and 14, in step 400 the absolute pressure $PM_1$ in the surge tank 11, which is detected by the absolute pressure sensor 21 in the preceding processing cycle, is subtracted from the present absolute pressure PM in the surge tank 11, and the result of the subtraction ΔPM is memorized as a changing rate of the absolute pressure ΔPM. Then, in step 401 it is determined, on the basis of the $O_2$ sensor 19, whether or not the feedback control has been carried out. If the feedback control has not been carried out, the routine goes to step 402 and counters CAC, CLRN 1, CLRN 2 and CD are cleared. When the feedback control is started, the routine goes to step 403 and it is determined whether or not the counter CLRN 1 is cleared. At this time, since the counter CLRN 1 is cleared, the routine goes to step 404 and it is determined whether or not the counter CLRN 2 is cleared. At this time, since the counter CLRN 2 is cleared, the routine goes to step 405. In step 405, it is determined whether or not ΔPM is larger than a fixed value, for example, 39 mmHg, i.e., the accelerating operation of the engine has been carried out. If $\Delta PM < 39$ mmHg, it is determined that the accelerating operation of the engine has not been carried out and the routine goes to step 406. In step 406, it is determined whether or not ΔPM is smaller than a fixed value, for example −39 mmHg, i.e., the decelerating operation of the engine has been carried out. If $\Delta PM < -39$ mmHg, it is determined that the decelerating operation of the engine has not been carried out and the routine goes to step 402, and in step 402 the counters CAC, CLRN 1, CLRN 2 and CD are cleared.

When it is determined in step 405 that ΔPM is larger than 39 mmHg, i.e., the accelerating operation of the engine has been carried out, the routine goes to step 407 and 1 is set in the counter CLRN 1. Then the routine goes to a routine for calculating the fuel injection time. In the next processing cycle, the routine goes from step 403 to step 408, and it is determined whether or not ΔPM has become smaller than −5 mmHg, i.e., the engine is decelerated after the accelerating operation of the engine is started. If $\Delta PM \leqq -5$ mmHg, the routine goes to step 402 and the counters CAC, CLRN 1, CLRN 2 and CD are cleared.

Conversely, when the accelerating operation of the engine is continuously carried out, since ΔPM becomes larger than −5 mmHg, the routine goes from step 408 to step 409, and it is determined whether or not the count value of the discriminating time period counter CD is equal to zero. At this time, since the discriminating time counter CD is cleared, the routine goes to step 410 and the counter CLRN 1 is incremented by one. Namely, as illustrated in FIG. 12(A), when the accelerating operation of the engine is started, and the absolute pressure PM increases from $PM_1$ to $PM_2$, if ΔPM exceeds 39 mmHg, the count up operation of the counter CLRN 1 is started.

Then, in step 411 the delay count value A is calculated on the basis of the present absolute pressure PM. As illustrated in FIG. 16, the delay count value A becomes small as the absolute pressure PM becomes high. This delay count value A is renewed on the basis of PM each time the routine goes to step 411. Then, in step 412 it is determined whether or not the count value of the counter CLRN 1 exceeds a predetermined fixed value A. If CLRN 1<A the routine goes to the routine for calculating the fuel injection time. That is, the time elapsing until the count value of the counter CLRN 1 reaches A is considered a delay time, and when the count value of the counter CLRN 1 exceeds A, the deposit learning process is executed. This is because, even if ΔPM exceeds 39 mmHg and thus it is determined that the accelerating operation has been carried out, a delay occurs until a change in the air-fuel ratio in the combustion chamber 4 detected by the $O_2$ sensor 19. Since this delay time is reduced as the absolute pressure PM becomes high, A becomes small as the absolute pressure PM becomes high, as illustrated in FIG. 16.

If the count value of the counter CLRN 1 exceeds A, the routine goes to step 413 and the discriminating time period counter CD is incremented by one. In the next processing cycle, the routine jumps from step 409 to step 413, i.e., if the routine once enters the discriminating time, the determination of the delay time is not carried out.

In step 414, it is determined from the output signal of the $O_2$ sensor 19 whether or not the air-fuel mixture fed into the engine cylinder is lean. When the air-fuel mixture is lean, the routine goes to step 415 and the counter CAC is incremented by one. Then the routine goes to step 416. When the air-fuel mixture is not lean, i.e., is rich, the routine goes to step 417 and the counter CAC is decremented by one. Then the routine goes to step 416. In step 416, the discriminating count value B is calculated on the basis of the present absolute pressure PM.

In step 418, it is determined whether or not the count value of the discriminating time counter CD exceeds the discriminating count value B. If CD<B, the routine goes to the routine for calculating the fuel injection time. That is, as illustrated in FIG. 12(A), it is determined whether the air-fuel mixture is lean or rich during the time in which the count value of the discriminating time counter CD increases from zero to B. During this time, when the air-fuel mixture becomes lean the counter CAC is counted up, and when the air-fuel mixture becomes rich, the counter CAC is counted down. Thus, during the time in which the count value of the counter CD increases from zero to B, if the lean time becomes longer than the rich time, the count value of the counter CAC is increased, and if the rich time becomes longer than the lean time, the count value of the counter CAC is reduced. Consequently, from the count value of the counter CAC at the moment when the count value of the counter CD reaches B, it is possible to determine whether the air-fuel mixture has become lean or rich at the time of acceleration.

As mentioned above, in the embodiment illustrated in FIG. 12, during the time in which the count value of the counter CD increases from zero to B, it is determined whether or not the air-fuel mixture has become lean or rich, and accordingly, the time in which the count value of the counter CD increases from zero to B becomes a lean-rich discriminating time L, L".

As mentioned above, to more precisely determine whether or not the air-fuel mixture has become lean, preferably the lean-rich discriminating time L, L" is shortened as the velocity of air fed into the engine cylinder becomes high at the time of acceleration. In this regard, the velocity of air fed into the engine cylinder becomes high as the absolute pressure PM becomes high. In addition, the lean-rich discriminating time L, L" becomes short as the discriminating count value B becomes small. Consequently, in the embodiment illustrated in FIG. 12, the discriminating count value B is reduced as the absolute pressure PM becomes high, as illustrated in FIG. 17, so that the lean-rich discriminating time L becomes equal to a time of the generation of the lean state or the rich state at the time of acceleration. The discriminating count value B is renewed on the basis of PM each time the routine goes to step 416. Consequently, the lean-rich discriminating time L becomes equal to a time of the generation of the lean state or the rich state, regardless of whether the velocity of air fed into the engine cylinder is high or low at the time of acceleration.

In this case, the lean-rich discriminating time L may be controlled on the basis of a detected value other than PM, for example, an engine load, which can be represented by the engine speed and the amount of air fed into the engine cylinder.

Turning to FIG. 14, if it is determined in step 418 that the count value of the counter CD has become larger than B, the routine goes to step 419, and it is determined whether or not the count value of the counter CAC is larger than a predetermined positive fixed value Cl. If CAC≦Cl, the routine goes to step 420, and it is determined whether or not the count value of the counter CAC is smaller than a predetermined negative fixed value D1. If CAC>D1, the routine goes to step 402 and the counters CAC, CLRN 1, CLRN 2 and CD are cleared. If it is determined in step 419 that the count value of the counter CAC is larger than Cl, i.e., when the air-fuel mixture becomes lean at the time of acceleration, the routine goes to step 421, and in step 421, a predetermined fixed value, for example, 0.1 is added to the acceleration correction coefficient KAC, and thus the acceleration correction coefficient KAC is increased. Conversely, if it is determined in step 420 that the count value of the counter CAC is smaller than D1, the routine goes to step 422, and in step 422, a predetermined fixed value, for example, 0.1, is subtracted from the acceleration correction coefficient KAC, and thus the acceleration correction coefficient KAC is reduced.

In step 406 of FIG. 13, if it is determined that ΔPM is smaller than −39 mmHg, i.e., the decelerating operation of the engine has been carried out, the routine goes to step 423, and 1 is set in the counter CLRN 2. Then the routine goes to the routine for calculating the fuel injection time. In the next processing cycle, the routine goes from step 404 to step 424 and it is determined whether or not ΔPM has become larger than 5 mmHg, i.e., the engine has been accelerated after the decelerating operation of the engine is started. If ΔPM≧5 mmHg, the routine goes to step 402 and the counters CAC, CLRN 1, CLRN 2, and CD are cleared.

Conversely when the decelerating operation of the engine is continuously carried out, since ΔPM becomes smaller than 5 mmHg, the routine goes from step 424 to step 425 and it is determined whether or not the discriminating time counter CD is equal to zero. At this time, since the counter CD is cleared, the routine goes to step 426, and the counter CLRN 2 is incremented by one. That is, as illustrated in FIG. 12(B), when the decelerating operation of the engine is started, and the absolute pressure PM decreases from $PM_2$ to $PM_1$, if ΔPM becomes smaller than −39 mmHg, the count up operation of the counter CLRN 2 is started.

Then, in step 427 the delay count value A is calculated from the relationship shown in FIG. 16, on the basis of the present absolute pressure PM. Then, in step 428 it is determined whether or not the count value of the counter CLRN 2 exceeds the delay count value A. If CLRN 2<A, the routine goes to the routine for calculating the fuel injection time. When CLRN 2 exceeds A, the routine goes to step 429 and the discriminating time counter CD is incremented by one. In the next processing cycle, the routine goes from step 425 to step 429.

Then, in step 430 it is determined, from the output signal of the $O_2$ sensor 19, whether or not the air-fuel mixture fed into the engine cylinder is rich. When the air-fuel mixture is rich, the routine goes to step 431 and the counter CAC is incremented by one. Then the routine goes to step 432. When the air-fuel mixture is not rich, i.e., is lean, the routine goes to step 433 and the counter CAC is decremented by one. Then the routine goes to step 432. In step 432, the discriminating count value B is calculated from the relationship shown in FIG. 17, on the basis of the present absolute pressure PM. Then, in step 434 it is determined whether or not the count value of the counter CD exceeds B. If CD<B, the routine goes to the routine for calculating the fuel injection time. That is, as illustrated in FIG.

12(B), it is determined whether the air-fuel mixture is rich or lean during the time in which the count value of the counter CD increases from zero to B, i.e., during the lean-rich discriminating time L, which is the same as used for the accelerating operation of the engine. During this time, when the air-fuel mixture becomes rich the counter CAC is counted up and when the air-fuel mixture becomes lean the counter CAC is counted down. Thus, during the time in which the count value of the counter CD increases from zero to B, i.e., during the lean-rich discriminating time, if the rich time becomes longer than the lean time the count value of the counter CAC is increased, and if the lean time becomes longer than the rich time the count value of the counter CAC is reduced. Consequently, from the count value of the counter CAC at the moment when the count value of the counter CD reaches B, it is possible to determine whether the air-fuel mixture has become rich or lean at the time of deceleration.

In step 434, if it is determined that the count value of the counter CD becomes larger than B, the routine goes to step 435 and it is determined whether or not the count value of the counter CAC is larger than a predetermined positive fixed value C2. If CAC≦C2, the routine goes to step 436 and it is determined whether or not the count value of the counter CAC is smaller than a predetermined negative fixed value D2. If CAC>D2, the routine goes to step 402 and the counters CAC, CLRN 1, CLRN 2 and CD are cleared. If it is determined in step 435 that the count value of the counter CAC is larger than C2, i.e., when the air-fuel mixture becomes rich at the time of acceleration, the routine goes to step 437, and in step 437, a predetermined fixed value, for example, 0.1, is added to the deceleration correction coefficient KDC, and thus the deceleration correction coefficient KDC is increased. Conversely, if it is determined in step 436 that the count value of the counter CAC is smaller than D2, the routine goes to step 438, and in step 438, a predetermined fixed value, for example, 0.1, is subtracted from the deceleration correction coefficient KDC, and thus the deceleration correction coefficient KDC is reduced.

FIG. 15 illustrates a routine for calculating the fuel injection time, which routine is executed successively after the execution of the routine illustrated in FIGS. 13 and 14. This routine is the same as that illustrated in FIG. 11, and therefore, a description of the routine illustrated in FIG. 15 is omitted.

In the routine illustrated in FIGS. 13 through 15, the fuel injection time TAU may be calculated in such a way that the deposit learning value is obtained only at the time of acceleration, and that at the time of deceleration, the correction fuel injection time TPAEW is corrected by using the deposit learning value obtained at the time of acceleration. Namely, the fuel injection time TAU may be calculated from the following equation, regardless of whether the accelerating operation or the decelerating operation is carried out, by obtaining only the acceleration correction coefficient KAC.

$$TAU=(TP+KAC.TPAEW).FAF.F$$

The above has the following advantage. Namely, where the deposit learning values are separately obtained at the time of acceleration and deceleration, and TPAEW is separately corrected by the acceleration correction coefficient KAC and the deceleration correction coefficient KDC at the time of acceleration and deceleration, respectively, since the basic fuel injection time TP becomes short at the time of deceleration, even if TPAEW slightly deviates from an optimum value, the air-fuel ratio of the mixture is considerably changed, and as a result, the deposit learning coefficient is also considerably changed, and thus it is difficult to precisely correct TPAEW. Nevertheless, since the basic fuel injection time TP becomes long at the time of acceleration, even if TPAEW slightly deviates from the optimum value, little change of the deposit correction coefficient occurs due to the deviation of TPAEW. Consequently, it is possible to precisely correct TPAEW by correcting TPAEW at the time of deceleration, by correcting TPAEW by the deposit correction coefficient obtained at the time of acceleration.

In addition, in a fuel injection control system in which the learning of the air-fuel ratio is executed when the cruising operation of the engine is carried out, the learning of the air-fuel ratio may be prohibited while the deposit learning process is executed. That is, in the routine illustrated in FIGS. 13 and 14, the learning of the air-fuel ratio may be prohibited until the counter CLRN 1 or CLRN 2 is cleared after the counting operation thereof is started. In this case, it is possible to prevent the execution of both a wrong learning of the air-fuel ratio and a wrong learning of the deposit.

In addition, in a fuel injection control system in which, at the time of acceleration, the amount of fuel injected by the fuel injector is increased by carrying out an asynchronous injection, the asynchronous injection time may be corrected by the acceleration correction coefficient KAC.

As mentioned above, when the cruising operation of the engine is carried out, the lean state and the rich state are alternately repeated at approximately a fixed time frequency, and at this time, the lean time is almost the same as the rich time. When the accelerating operation of the engine is carried out, if a deposit is not adhered to the inner wall of the intake port, etc., the time frequency of the lean time and the rich time becomes shorter than that in the cruising operation of the engine.

In practice, however, the time frequency of the lean time and the rich time differs for each $O_2$ sensor, and in addition, if the $O_2$ sensor has been used for a long time, the time frequency of the lean time and the rich time gradually becomes long regardless of whether the cruising operation or the accelerating operation of the engine is carried out. Consequently, the optimum lean-rich discriminating time differs with each $O_2$ sensor and the length of time for which the $O_2$ sensor has been used.

FIGS. 18 through 23 illustrate a further embodiment in which, when the cruising operation of the engine is carried out, the actual time frequency of the lean state and the rich state is detected and the lean-rich discriminating time period is determined on the basis of that actual time frequency.

Next, the routine for calculating the correction coefficient K, i.e., the deposit learning coefficient K, will be described on the basis of the flow chart illustrated in FIGS. 19 and 20 with reference to the time chart illustrated in FIG. 18. This routine is processed by sequential interruptions which are executed at every crankangle of 360°.

Figures 19, 19A, 19B:
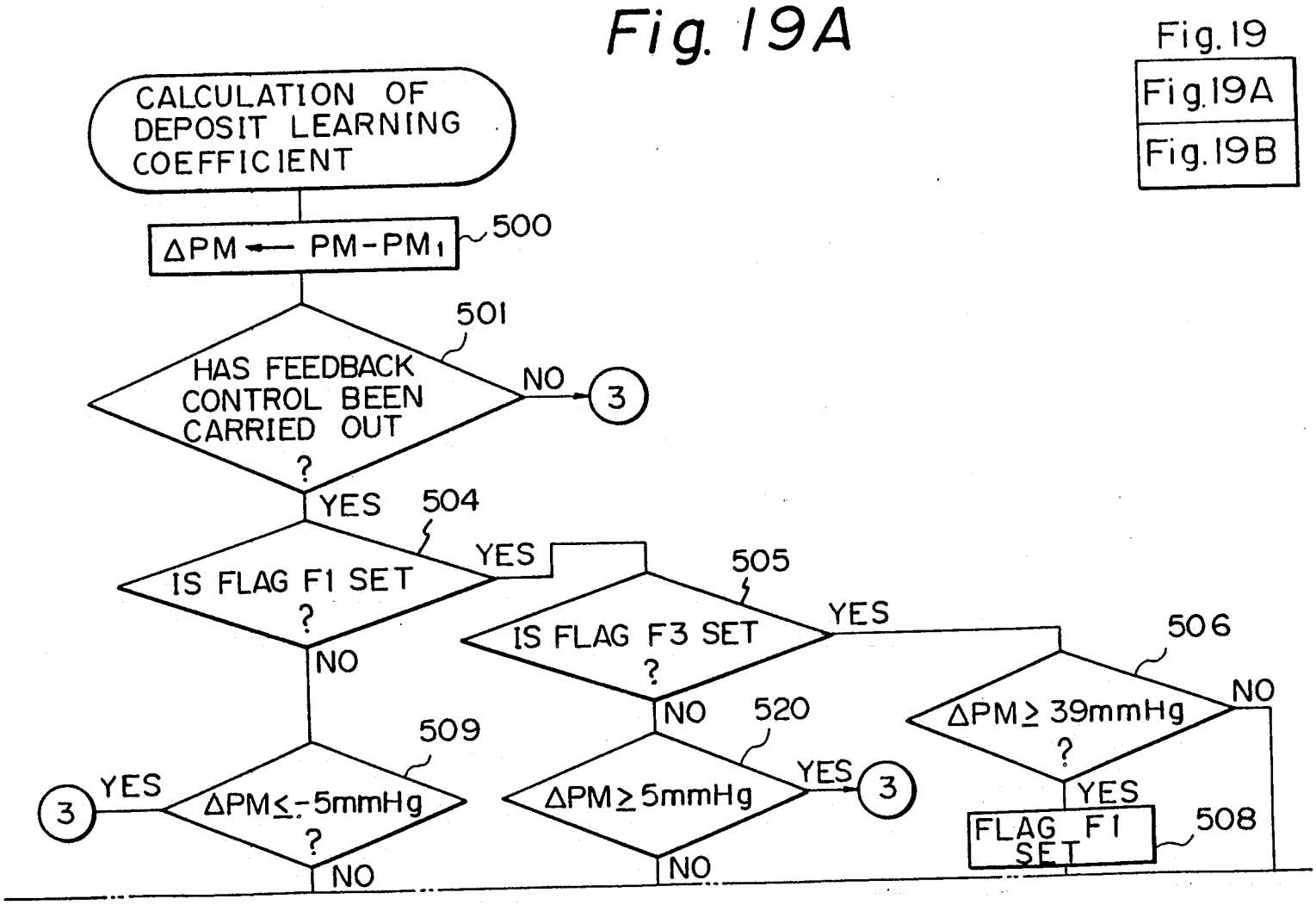
Figure 19B:
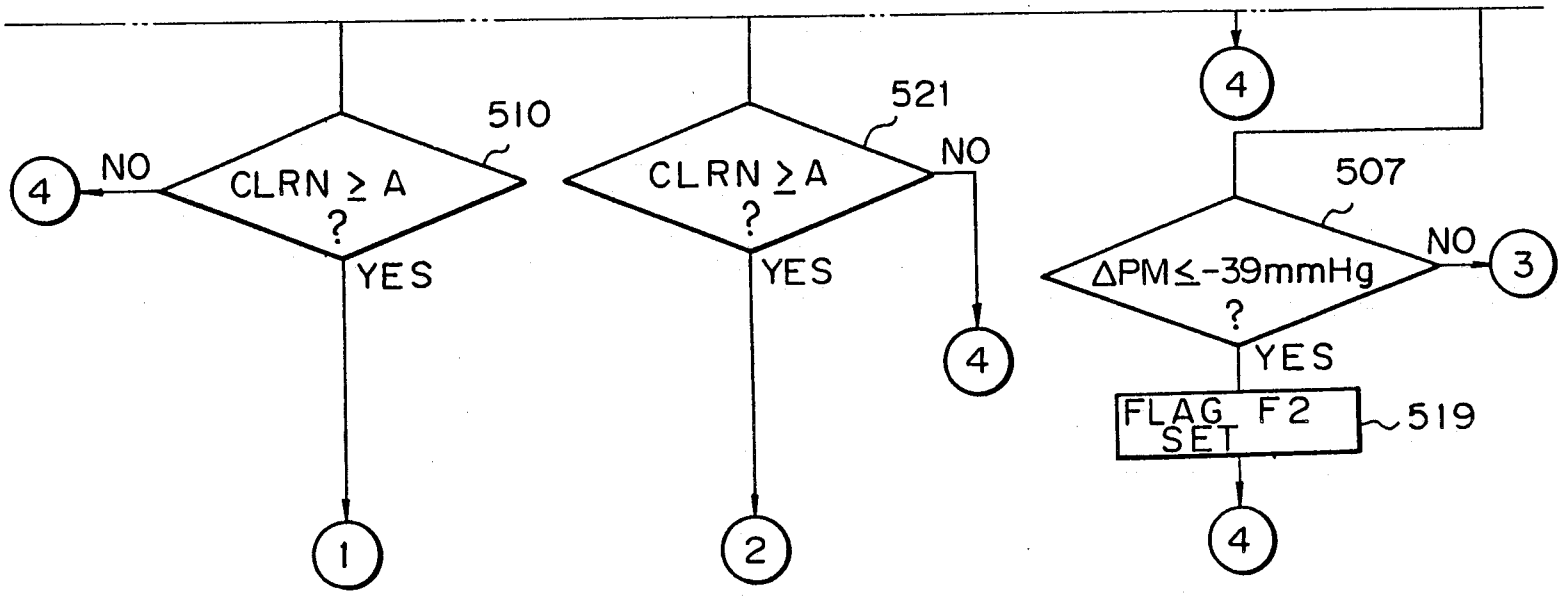
Figures 20, 20A, 20B:
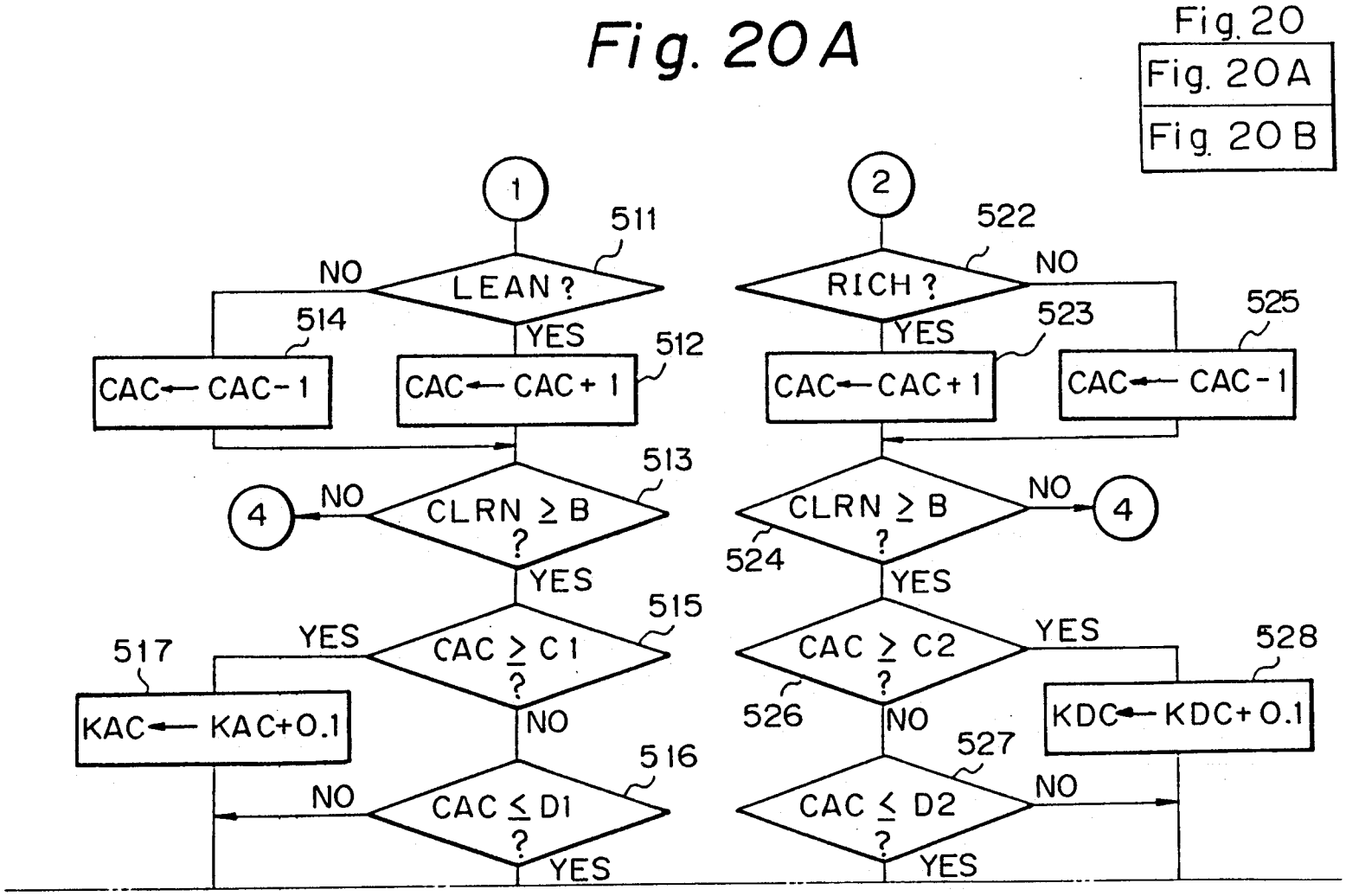
Figure 20B:
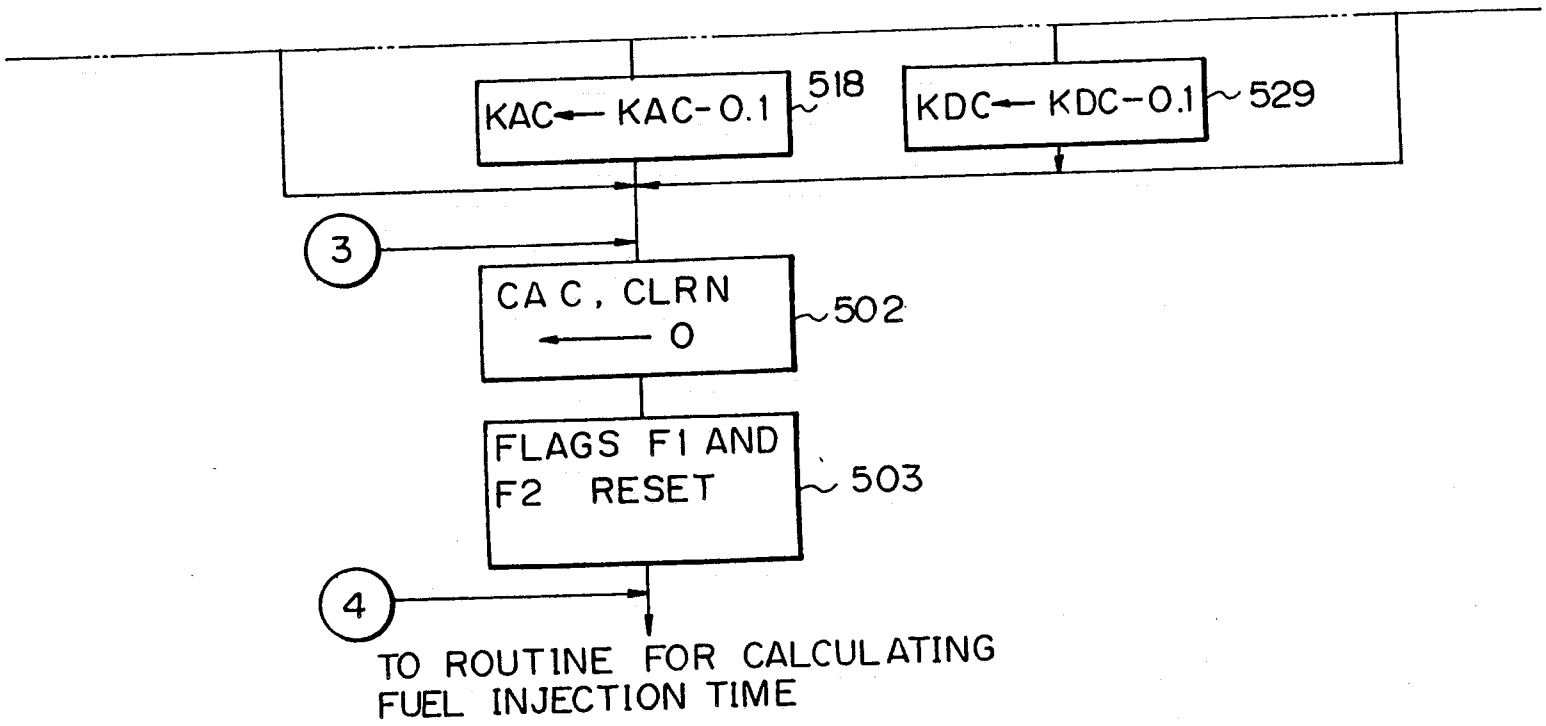

Referring to FIGS. 19 and 20, in step 500 the absolute pressure $PM_1$ in the surge tank 11, which is detected by the absolute pressure sensor 21 in the preceding processing cycle, is subtracted from the present absolute pressure PM in the surge tank 11, and the result of the subtraction ΔPM is memorized as a changing rate of the absolute pressure ΔPM. Then, in step 501 it is determined, on the basis of the $O_2$ sensor 19, whether or not the feedback control has been carried out. If the feedback control has not been carried out, the routine goes to step 502 and counters CAC and CLRN are cleared, and in steps 503, flags Fl and F2 are reset. When the feedback control is started, the routine goes to step 504 and it is determined whether or not the flag Fl is set. At this time, since the flag Fl is reset, the routine goes to step 505 and it is determined whether or not the flag F2 is set. At this time, since the flag F2 is reset, the routine goes to step 506, and in step 506, it is determined whether or not ΔPM is larger than a fixed value, for example, 39 mmHg, i.e., the accelerating operation of the engine has been carried out. If ΔPM<39 mmHg, it is determined that the accelerating operation of the engine has not been carried out, and the routine goes to step 507. In step 507, it is determined whether or not ΔPM is smaller than a fixed value, for example, −39 mmHg, i.e., the decelerating operation of the engine has been carried out. If ΔPM<−39 mmHg, it is determined that the decelerating operation of the engine has not been carried out and the routine goes to step 502, and in step 502 the counters CAC and CLRN are cleared. Then, in step 503 the flags Fl and F2 are reset.

When it is determined in step 506 that ΔPM is larger than 39 mmHg, i.e., the accelerating operation of the engine has been carried out, the routine goes to step 508 and the flag Fl is set. Then the routine goes to a routine for calculating the fuel injection time. If the flag Fl is set, the count up operation of the counter CLRN is started in a count control routine illustrated in FIG. 23.

FIG. 23 illustrates a routine for controlling the counting operation of the counter CLRN, and this routine is processed by sequential interruptions executed at predetermined time intervals, for example, every 4 msec.

Referring to FIG. 23, in step 650 it is determined whether or not the flag Fl is set. If the flag Fl is set, the routine jumps to step 652 and the count value of the counter CLRN is incremented by one. Conversely, if the flag Fl is not set, the routine goes to step 651 and it is determined whether or not the flag F2 is set. If the flag F2 is set, the routine goes to step 652 and the count value of the counter CLRN is incremented by one. Consequently, if the flag Fl or F2 is set, the count up operation of the counter CLRN is started, and this count up operation continues for the time in which the flag Fl or F2 is set. The routine illustrated in FIG. 23 is executed at the predetermined time interval, and thus the count value of the counter CLRN represents a time elapsed after the flag Fl or F2 is set.

Turning to FIG. 19, when the accelerating operation of the engine is started, and thus the flag Fl is set, the count up operation of the counter CLRN is started as mentioned above. In the next processing cycle, the routine goes from step 504 to step 509, and it is determined whether or not ΔPM has become smaller than −5 mmHg, i.e., the engine has been decelerated after the accelerating operation of the engine is started. If ΔPM < −5 mmHg, the routine goes to step 502, and the counters CAC and CLRN are cleared. Then, in step 503 the flags Fl and F2 are reset.

Conversely, when the accelerating operation of the engine is continuously carried out, since ΔPM becomes larger than −5 mmHg, the routine goes from step 509 to step 510. That is, as illustrated in FIG. 18(A), when the accelerating operation of the engine is started, and the absolute pressure PM increases from $PM_1$ to $PM_2$, if ΔPM exceeds 39 mmHg, the flag Fl is set and the count up operation of the counter CLRN is started.

Then, in step 510 it is determined whether or not the count value of the counter CLRN exceeds a predetermined fixed value A. If CLRN<A, the routine goes to the routine for calculating the fuel injection time. When CLRN exceeds A, the routine goes to step 511 and it is determined, from the output signal of the $O_2$ sensor 19, whether or not the air-fuel mixture fed into the engine cylinder is lean. When the air-fuel mixture is lean, the routine goes to step 512 and the counter CAC is incremented by one. Then the routine goes to step 513. When the air-fuel mixture is not lean, i.e., is rich, the routine goes to step 514 and the counter CAC is decremented by one. Then, the routine goes to step 513 and in step 513 it is determined whether or not the count value of the counter CLRN exceeds a hereinafter described upper limit B. If CLRN<B, the routine goes to the routine for calculating the fuel injection time. That is, as illustrated in FIG. 18(A), it is determined whether the air-fuel mixture is lean or rich during the time in which the count value of the counter CLRN increases from A to B. During this time, when the air-fuel mixture becomes lean the counter CAC is counted up, and when the air-fuel mixture becomes rich the counter CAC is counted down. Thus, during the time in which the count value of the counter CLRN increases from A to B, if the lean time becomes longer than the rich time the count value of the counter CAC is increased, and if the rich time becomes longer than the lean time the count value of the counter CAC is reduced. Consequently, from the count value of the counter CAC at the moment when the count value of the counter CLRN reaches B, it is possible to determine whether the air-fuel mixture has become lean or rich at the time of acceleration.

As mentioned above, in the embodiment illustrated in FIG. 18, during the time in which the count value of the counter CLRN increases from A to B, it is determined whether or not the air-fuel mixture has become lean or rich, and accordingly, the time in which the count value of the counter CLRN increases from A to B becomes the lean-rich discriminating time L, L″.

As mentioned above, if the lean-rich discriminating time is determined so that it becomes equal to, for example, a time of the generation of the lean state or the rich state in an accelerating operation state, it is possible to more precisely determine whether or not the air-fuel mixture has become lean or rich at the time of acceleration. Nevertheless, as mentioned above, the time frequency of the lean time and the rich time differs for each $O_2$ sensor, and in addition, if the $O_2$ sensor has been used for a long time, the time frequency of the lean time and the rich time gradually becomes long. Consequently, to equalize the lean-rich discriminating time with a time of the generation of the lean state and the rich state, preferably the time frequency of the lean time and the rich time is actually detected.

FIG. 22 illustrates a routine for determining the lean-rich discriminating time, and this routine is processed by sequential interruptions executed at predetermined time intervals, for example, every 4 msec.

Referring to FIG. 22, in step 600 it is determined whether or not the condition for determining the lean-rich discriminating time is satisfied, i.e., it is determined whether or not the time frequency of the generation of the lean state and the rich state is stable. For example, when the cruising operation of the engine is carried out, and the absolute pressure PM in the surge tank 11 is in the range of 300 through 400 mmHg, it can be considered that the time frequency of the generation of the lean time and the rich time is stable. Of course, at this time, the feedback control by the $O_2$ sensor 19 must be carried out. Consequently, when the feedback operation by the $O_2$ sensor 19 is carried out, and the absolute pressure PM is in the range of 300 through 400 mmHg in a cruising operating state of the engine, i.e., when the condition for determining the lean-rich discriminating time is satisfied, the routine goes to step 601. In step 601 the count value of the counter CT is incremented by one, and then in step 602, it is determined, from the output signal of the $O_2$ sensor 19, whether or not the air-fuel mixture is rich. If the air-fuel mixture is lean, the routine jumps to step 605. Conversely, if the air-fuel mixture is rich, the routine goes to step 603 and it is determined whether or not the air-fuel mixture is changed from lean to rich, i.e., whether or not the air-fuel mixture was lean in the preceding processing cycle but is rich in the present processing cycle. If the air-fuel mixture was also rich in the preceding processing cycle, the routine jumps to step 605. Conversely, if the air-fuel mixture has changed from lean to rich, the routine goes to step 604 and the count value of the counter CF is incremented by one. That is, the count value of the counter CF is incremented by one each time the air-fuel mixture is changed from lean to rich.

Then, in step 605 it is determined whether or not the count value of the counter CF has reached a predetermined fixed value M, i.e., it is determined whether or not the air-fuel mixture has changed from lean to rich M times. If CF>M, the routine goes to step 606 and the upper limit B for the counter CLRN (FIG. 18) is calculated from the following equation.

$$B=S.CT$$

In this equation, CT represents a time elapsed after the condition for determining the lean-rich discriminating time is satisfied, and S is a value which is near 1/M, i.e., the upper limit B corresponds to a time of the generation of the rich time. As mentioned above, since the time frequency of the generation of the lean time and the rich time in an accelerating operation state of the engine becomes slightly shorter than that in a cruising operation state of the engine, the above S has a value which is slightly smaller than 1/M. Thus, the time during which the count value of the counter CLRN increases from A to B becomes equal to a time of the generation of the rich state and the lean state in an accelerating operation state of the engine. If the calculation of the upper limit B is completed in step 606, the routine goes to step 607 and the counters CT and CF are cleared, and then the calculation of the upper limit B is started again.

Turning to FIG. 20, if it is determined, in step 513, from the upper limit B thus calculated, that the count value of the counter CLRN has become larger than Bl, i.e., if it is determined that the lean-rich discriminating time L has elapsed after the count value of the counter CLRN exceeds A, the routine goes to step 515, and it is determined whether or not the count value of the counter CAC is larger than a predetermined positive fixed value Cl. If CAC≦Cl, the routine goes to step 516 and it is determined whether or not the count value of the counter CAC is smaller than a predetermined negative fixed value D1. If CAC>D1, the routine goes to step 502 and the counters CAC and CLRN are cleared. Then in step 503 the flags Fl and F2 are reset. Conversely, if it is determined in step 515 that the count value of the counter CAC is larger than Cl, i.e., when the air-fuel mixture becomes lean at the time of acceleration, the routine goes to step 517, and in step 517 a predetermined fixed value, for example, 0.1, is added to the acceleration correction coefficient KAC, and thus the acceleration correction coefficient KAC is increased. Conversely, if it is determined in step 516 that the count value of the counter CAC is smaller than D1, the routine goes to step 518, and in step 518, a predetermined fixed value, for example, 0.1, is subtracted from the acceleration correction coefficient KAC, and thus the acceleration correction coefficient KAC is reduced. In FIG. 9, the broken line indicates the case where the air-fuel ratio of the mixture is maintained at the stoichiometric air-fuel ratio at the time of acceleration.

In FIG. 19, when it is determined in step 507 that ΔPM is lower than −39 mmHg, i.e., the decelerating operation of the engine has been carried out, the routine goes to step 207 and the flag F2 is set. At this time, as mentioned above, the count up operation of the counter CLNR is started. Then the routine goes to the routine for calculating the fuel injection time. In the next processing cycle, the routine goes from step 505 to step 520, and it is determined whether or not ΔPM becomes larger than 5 mmHg, i.e., the engine has been accelerated after the decelerating operation of the engine is started. If ΔPM >5 mmHg, the routine goes to step 502 and the counters CAC and CLRN are cleared. Then in step 503 the flags Fl and F2 are reset.

Conversely, when the decelerating operation of the engine is continuously carried out, since ΔPM becomes smaller than 5 mmHg, the routine goes from step 520 to step 521. That is, as illustrated in FIG. 18(B), when the decelerating operation of the engine is started, and the absolute pressure PM decreases from $PM_2$ to $PM_1$, if ΔPM becomes lower than −39 mmHg, the flag F2 is set and the count up operation of the counter CLRN is started.

Then, in step 521 it is determined whether or not the count value of the counter CLRN exceeds the predetermined fixed value A. If CLRN<A, the routine goes to the routine for calculating the fuel injection time. When CLRN exceeds A, the routine goes to step 522 and it is determined, from the output signal of the $O_2$ sensor 19, whether or not the air-fuel mixture fed into the engine cylinder is rich. When the air-fuel mixture is rich, the routine goes to step 523 and the counter CAC is incremented by one. Then the routine goes to step 524. When the air-fuel mixture is not rich, i.e., is lean, the routine goes to step 525 and the counter CAC is decremented by one. Then the routine goes to step 524. In step 524, it is determined whether or not the count value of the counter CLRN exceeds the upper limit B obtained by the routine illustrated in FIG. 22. If CLRN<B the routine goes to the routine for calculating the fuel injection time. That is, as illustrated in FIG. 18(B), it is determined whether the air-fuel mixture is rich or lean during the time in which the count value of the counter CLRN increases from A to B. During this time, when the air-fuel mixture becomes rich the counter CAC is counted up, and when the air-fuel mixture becomes lean the counter CAC is counted down. Thus, during the time in which the count value of the counter CLRN increases from A to B, if the rich time becomes longer than the lean time the count value of the counter CAC is increased, and if the lean time becomes longer than the rich time the count value of the counter CAC is reduced. Consequently, from the count value of the counter CAC at the moment when the count value of the counter CLRN reaches B, it is possible to determine whether the air-fuel mixture has become rich or lean at the time of deceleration.

In step 524, if it is determined that the count value of the counter CLRN becomes larger than B, the routine goes to step 526 and it is determined whether or not the count value of the counter CAC is larger than a predetermined positive fixed value C2. If CAC<C2, the routine goes to step 527 and it is determined whether or not the count value of the counter CAC is smaller than a predetermined negative fixed value D2. If CAC>D2, the routine goes to step 502 and the counters CAC and CLRN are cleared. Then in step 503 the flags Fl and F2 are reset. If it is determined in step 526 that the count value of the counter CAC is larger than C2, i.e., when the air-fuel mixture becomes rich at the time of deceleration, the routine goes to step 528, and in step 528, a predetermined fixed value, for example, 0.1, is added to the deceleration correction coefficient KDC, and thus the deceleration correction coefficient KDC is increased. Conversely, if it is determined in step 527 that the count value of the counter CAC is smaller than D2 the routine goes to step 529. In step 529, a predetermined fixed value, for example, 0.1, is subtracted from the deceleration correction coefficient KDC, and thus the deceleration correction coefficient KDC is reduced.

FIG. 21 illustrates a routine for calculating the fuel injection time, which routine is executed successively after the execution of the routine illustrated in FIGS. 19 and 20. This routine is the same as that illustrated in FIG. 11, and therefore, a description of the routine illustrated in FIG. 21 is omitted.

In the embodiments hereinbefore described, even if the deposit is adhered to the inner wall of the intake port, etc., it is possible to maintain the air-fuel ratio of the mixture at the stoichiometric air-fuel ratio at the time of acceleration. If, however, the amount of the deposit is rapidly increased for some reason, the air-fuel mixture becomes lean to a great extent at the time of acceleration and the air-fuel mixture becomes rich to a great extent at the time of deceleration. In this case, although the acceleration correction coefficient KAC is increased each time the accelerating operation is carried out, and the deceleration correction coefficient KDC is increased each time the decelerating operation is carried out, any increase in these correction coefficients KAC and KDC is small. Consequently, once the amount of the deposit is abruptly increased, the air-fuel mixture becomes lean for a while at the time of acceleration, and the air-fuel mixture becomes rich for a while at the time of deceleration.

Figures 25, 25A, 25B:
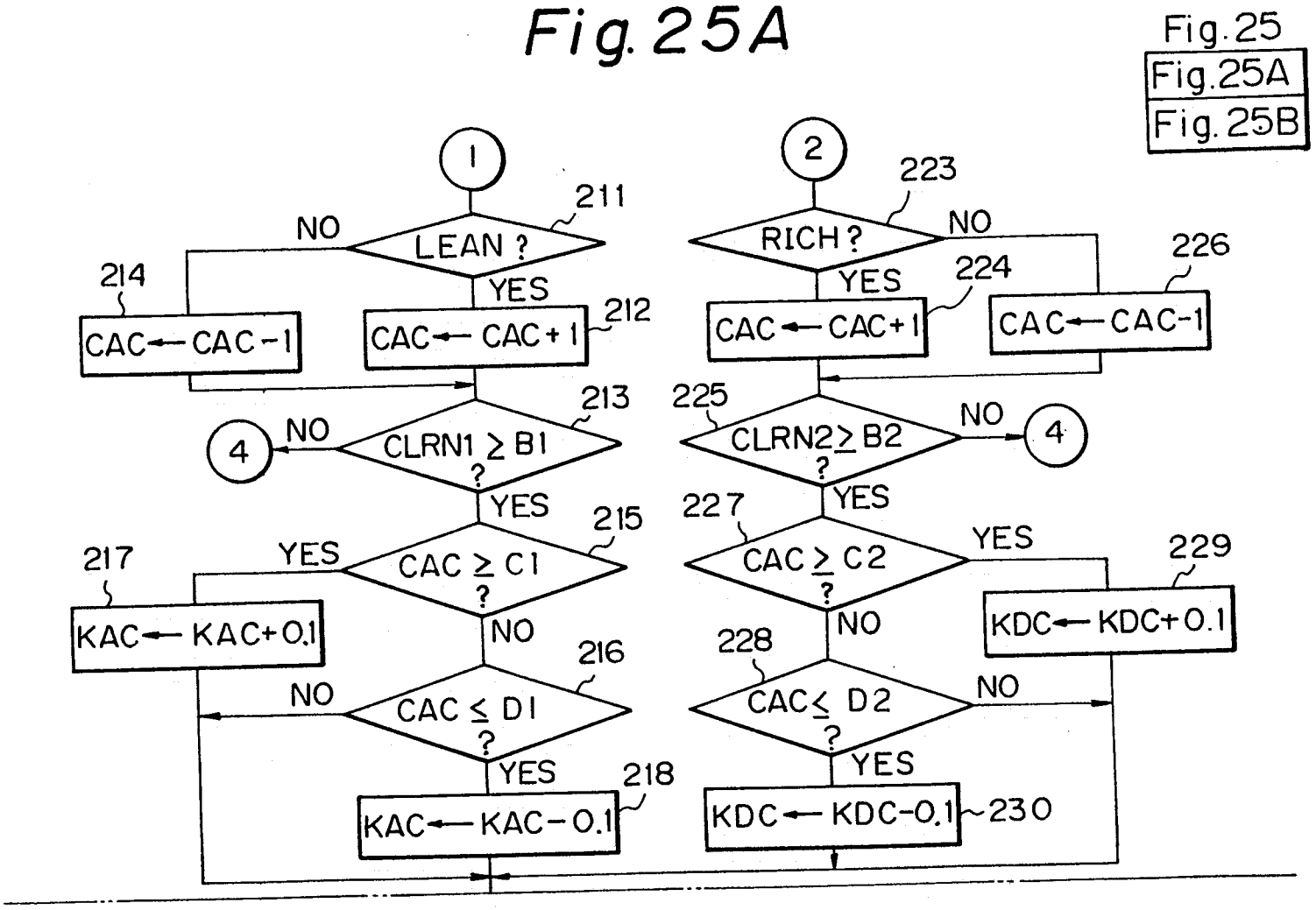
Figure 25B:
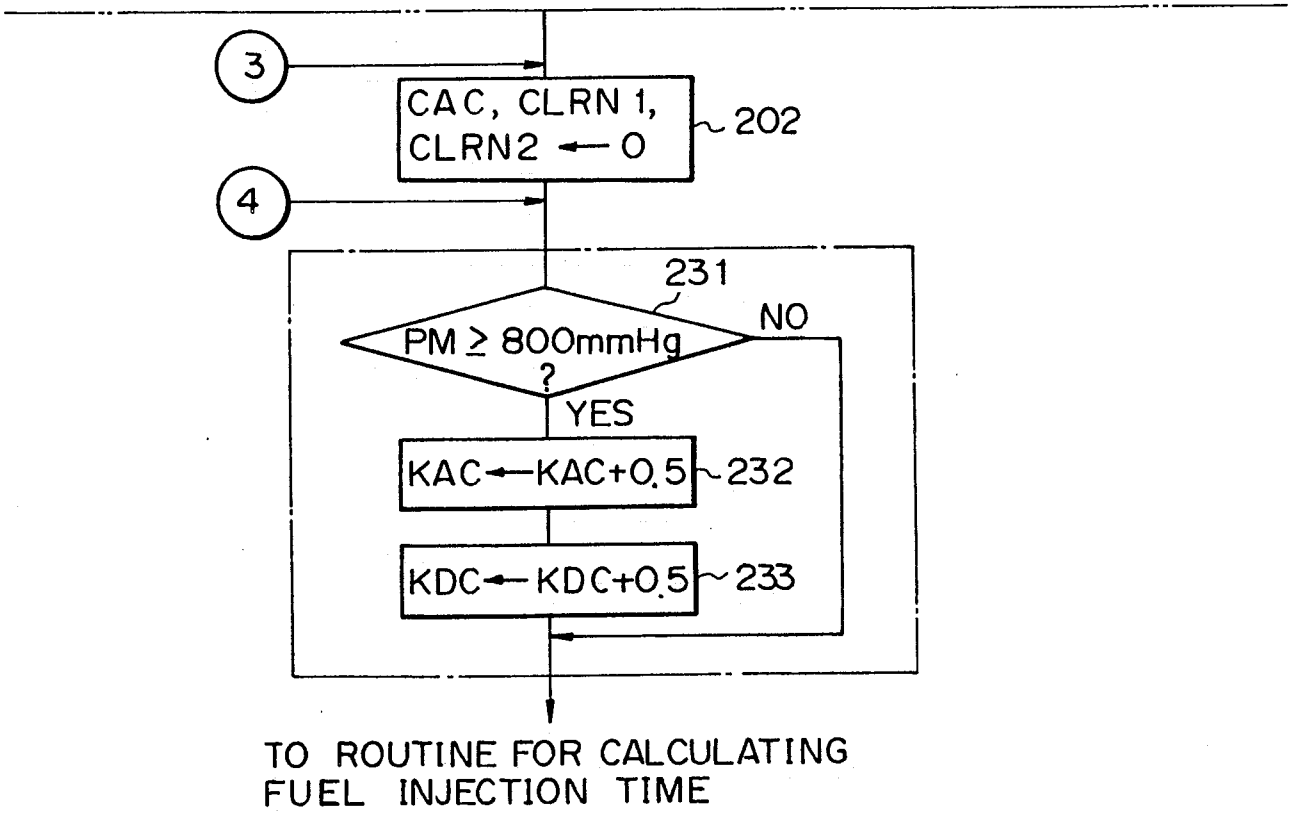

FIGS. 24 through 26 illustrate a still further embodiment of the routines by which the air-fuel mixture is prevented from becoming lean and rich to a great extent and then continuing to be lean and rich for a while at the time of acceleration and deceleration, respectively.

These routines illustrated in FIGS. 24 through 26 are almost the same as the routines illustrated in FIGS. 9 through 11, except for steps 231 through 232 enclosed by the dotted-dashed line in FIG. 25. Consequently, only the proceedings executed in steps 231 through 235 in FIG. 25 will be hereinafter described.

Referring to FIG. 25, in step 231 it is determined whether or not the absolute pressure PM in the surge tank 11 exceeds a fixed value which is slightly higher than the atmospheric pressure, for example, 800 mmHg. That is, if the air-fuel mixture becomes lean to a great extent, since the combustion time becomes long, the combustion continues to be carried out. As a result, when the intake valve 6 opens, a high temperature burning gas is blown back into the intake port 7 and the fuel in the intake port 7 is burned to explode, i.e., a backfire occurs. That is, the occurrence of the backfire means that a large amount of the deposit is adhered, and thereby the air-fuel mixture is made lean to a great extent. If a backfire occurs, since the absolute pressure in the intake port 7 as well as the surge tank 11 becomes higher than the atmospheric pressure, it is possible to determine from the absolute pressure in the surge tank 11 whether or not a backfire has occurred.

Consequently, if it is determined in step 231 that the absolute pressure PM in the surge tank 11 is lower than 800 mmHg, it is determined that a backfire has not occurred, and at this time the routine goes to the routine for calculating the fuel injection time. Conversely, if PM>800 mmHg, it is determined that a backfire has occurred, and at this time the routine goes to step 232. In step 232, a large fixed value, for example, 0.5, is added to the acceleration correction coefficient KAC, and then in step 233 a large fixed value, for example, 0.5, is added to the deceleration correction coefficient KDC. That is, if a backfire occurs, the correction coefficients KAC and KDC are instantaneously increased to a great extent. Consequently, for example, if a backfire occurs when the accelerating operation of the engine is started, since the acceleration correction coefficient KAC is instantaneously increased to a great extent, it is possible to prevent the air-fuel mixture from becoming lean to a great extent, and thereafter, it is possible to make the air-fuel ratio of the mixture the same as the stoichiometric air-fuel ratio, in a short time.

FIGS. 27 through 30 illustrate an alternative embodiment of FIGS. 24 through 26. FIG. 27 illustrates an engine in the same manner as illustrated in FIG. 1, and accordingly, in FIG. 27 similar components are indicated by the same reference numerals as used in FIG. 1.

Referring to FIG. 27, an air flow meter 24 is provided between the intake duct 13 and the air cleaner 14. This air flow meter 24 produces an output voltage proportional to the amount of air fed into the engine cylinder, and this output voltage is input to the input port 35 via an AD converter 42. In addition, a throttle sensor 25 is attached to the throttle valve 15. This throttle sensor 25 produces an output voltage proportional to the degree of opening of the throttle valve 15, and this output voltage is input to the input port 35 via an AD converter 43.

FIGS. 28 and 29 illustrate a routine for calculating the deposit learning coefficient used for the engine shown in FIG. 27, and FIG. 30 illustrates a routine for calculating the fuel injection time used for the engine shown in FIG. 27.

In the routine illustrated in FIGS. 28 and 29, similar steps are indicated by the same reference numerals used in the routine shown in FIGS. 24 and 25.

Referring to FIGS. 28 and 29, in step 199, Q (amount of air fed into the engine cylinder)/N (engine speed) is calculated from the output signals of the air flow meter 24 and the engine speed sensor 23. This Q/N represents the amount of air fed into the engine cylinder per one revolution of the engine, and thus this Q/N represents the engine load. The absolute pressure PM in the purge tank 11 also represents the engine load, and thus both Q/N and PM represent the engine load. Consequently, in the routine illustrated in FIGS. 28 and 29, ΔQ/N is used instead of ΔPM, and a suffix a is added to the reference numerals of steps in which ΔQ/N is used instead of ΔPM. Note, L in steps 205*a* and 206*a* is a fixed value corresponding to 39 mmHg in steps 205 and 206 of FIG. 24, and M in steps 208*a* and 220*a* is a fixed value corresponding to 5 mmHg in steps 208 and 220 of FIG. 24.

In steps from 200*a* to 230 of FIGS. 28 and 29, a similar calculation is carried out as in steps from 200 to 230 of FIGS. 24 and 25. Therefore, the description regarding steps from 220*a* to 230 is omitted here, and the description will be started from step 240.

Usually, when the degree of opening of the throttle valve 15 is changed, the measuring plate 24*a* of the air flow meter 24 rotates, and accordingly, the output voltage of the air flow meter 24 is changed. If a backfire occurs, however, and thus the pressure in the surge tank 11 is abruptly increased, although the degree of opening of the throttle valve 15 is little changed, measuring plate 24*a* of the air flow meter 24 rotates in the counterclockwise direction in FIG. 27, and thus the output voltage of the air flow meter 24 is abruptly changed. In the routine illustrated in FIGS. 28 and 29, the backfire is detected by using the above characteristic.

That is, in step 240, the absolute value of the difference $\Delta\theta$ between the degree of opening $\theta$ of the throttle valve 25 in the present processing cycle and the degree of opening $\theta_1$ of the throttle valve 25 in the preceding processing cycle is calculated from the output signal of the throttle sensor 25. Then, in step 241 it is determined whether or not $\Delta\theta$ is smaller than a predetermined fixed value $\theta_0$. If $\Delta\theta > \theta_0$, the routine goes to the routine for calculating the fuel injection time. Conversely, if $\Delta\theta < \theta_0$, the routine goes to step 242 and the absolute valve of difference $\Delta V$ between the output voltage V of the air flow meter 24 in the present processing cycle and the output voltage $V_1$ of the air flow meter 24 in the preceding processing cycle is calculated. Then, in step 243 it is determined whether or not $\Delta V$ is larger than a predetermined fixed value $V_0$. If $\Delta V < V_0$, the routine goes to step for calculating the fuel injection time. Conversely, if $\Delta V > V_0$, the routine goes to step 244 and a predetermined fixed value, for example, 0.5, is added to the acceleration correction coefficient KAC. Then, in step 245 a predetermined fixed value, for example, 0.5, is added to the deceleration correction coefficient KDC. That is, if $\Delta\theta < \theta_0$, and $\Delta V > V_0$, it is determined that a backfire has occurred, and at this time, the correction coefficients KAC and KDC are instantaneously increased to a great extent.

Referring to FIG. 30, in step 300*a*, the basic fuel injection time TP is calculated on the basis of the engine speed N and the amount of air Q fed into the engine cylinder. In steps 301*a* and 302*a*, Δ(Q/N) is merely used instead of ΔPM as in steps 301 and 302 of FIG. 26, and steps 303 through 306 in FIG. 30 are the same as in FIG. 26. Consequently, the description of steps 301*a* to 306 is omitted.

According to the present invention, it is possible to correctly determine that the air-fuel ratio of the mixture has deviated from a desired air-fuel ratio in a transition operating state of the engine.

While the invention has been described by reference to specific embodiments chosen for purposes of illustration, it should be apparent that numerous modifications could be made thereto by those skilled in the art without departing from the basic concept and scope of the invention.

We claim:

1. A fuel injection control device of an engine having an intake passage and an exhaust passage, said device comprising:

an oxygen concentration detector arranged in the exhaust passage and producing an output signal indicating whether an air-fuel mixture fed into the engine is lean or rich;

feedback control means for controlling an amount of fuel fed into the engine in response to the output signal of said oxygen concentration detector, to bring an air-fuel ratio of the mixture to a desired air-fuel ratio;

acceleration detecting means for detecting an accelerating operation of the engine;

fuel increasing means for increasing the amount of fuel fed into the engine when the accelerating operation of the engine is carried out;

time calculating means for calculating a lean time and a rich time of the air-fuel mixture on the basis of the output signal of said oxygen concentration detector during a predetermined lean-rich discriminating time when the accelerating operation of the engine is carried out, said lean-rich discriminating time being an integral number of times of a time of the occurrence of either one of said lean time and said rich time when the air-fuel ratio of mixture is maintained at the desired air-fuel ratio due to an increase in the amount of fuel by said fuel increasing means;

difference calculating means for calculating a difference between said lean time and said rich time; and correction means for correcting an increase in the amount of fuel, which increase is caused by said fuel increasing means, to increase said increase in the amount of fuel when said lean time is longer than said rich time and when said difference is larger than a predetermined value, and to reduce said increase in the amount of fuel when said rich time is longer than said lean time and when said difference is larger than a predetermined value.

2. A fuel injection control device according to claim 1, wherein said lean-rich discriminating time is a fixed value which is stored in a memory.

3. A fuel injection control device according to claim 2, wherein said lean-rich discriminating time is determined on the basis of a time frequency of an occurrence of either one of said lean time and said rich time when a cruising operation of the engine is carried out.

4. A fuel injection control device according to claim 3, wherein said lean-rich discriminating time is slightly shorter than a time of an occurrence of either one of said lean time and said rich time when the cruising operation of the engine is carried out.

5. A fuel injection control device according to claim 1, where said integral number is one.

6. A fuel injection control device according to claim 1, wherein said time calculating means stops calculating said lean time and said rich time when the engine is decelerated immediately after the accelerating operation of the engine is started.

7. A fuel injection control device according to claim 1, wherein said time calculating means begins to calculate said lean time and said rich time when a predetermined time has elapsed after the accelerating operation of the engine is started.

8. A fuel injection control device according to claim 1, wherein said increase in the amount of fuel by said fuel increasing means is increased for a short time after the accelerating operation of the engine is started, and a reduction in said increase in the amount of fuel is begun after said short time has elapsed and continues even after the accelerating operation of the engine is completed.

9. A fuel injection control device according to claim 8, wherein said increase in the amount of fuel is controlled on the basis of a rate of change of an engine load, and said increase in the amount of fuel is increased when said rate of change is relatively high, said increase in the amount of fuel being reduced when said rate of change is relatively low.

10. A fuel injection control device according to claim 9, wherein said engine load is represented by an absolute pressure PM in the intake passage.

11. A fuel injection control device according to claim 9, wherein said engine load is represented by Q/N. Where, Q indicates an amount of air fed into the engine and N indicates an engine speed.

12. A fuel injection control device according to claim 9, wherein said increase in the amount of fuel is calculated from the following equation:

$$TPAEW=\{C_2\cdot\Delta L+C_3\cdot(\Delta L+C_1\cdot\Sigma\Delta L)\}\cdot C_4$$

where

TPAEW: said increase in the amount of fuel $\Delta L$: said rate of change the engine load $C_1$, $C_2$, $C_3$, $C_4$ coefficients.

13. A fuel injection control device according to claim 12, wherein said correction means corrects said TPAEW.

14. A fuel injection control device according to claim 1, further comprising: deceleration detecting means for detecting a decelerating operation of the engine; fuel decreasing means for decreasing the amount of fuel fed into the engine when the decelerating operation of the engine is carried out; time calculating means used during a deceleration operation for calculating a lean time and a rich time of the air-fuel mixture on the basis of the output signal of said oxygen concentration detector during a predetermined lean-rich discriminating time when the decelerating operation of the engine is carried out; and correction means used during a deceleration operation for correcting an decrease in the amount of fuel, which decrease is caused by said fuel decreasing means, to increase said decrease in the amount of fuel when said rich time is longer than said lean time and when said difference is larger than a predetermined value, and to reduce said decrease in the amount of fuel when said lean time is longer than said rich time and when said difference is larger than a predetermined value.

15. A fuel injection control device according to claim 14, wherein said time calculating means used during a deceleration operation stops calculating said lean time and said rich time when the engine is accelerated immediately after the decelerating operation of the engine is started.

16. A fuel injection control device according to claim 14, wherein said time calculating means used during a deceleration operation begins to calculate said lean time and said rich time when a predetermined time has elapsed after the decelerating operation of the engine is started.

17. A fuel injection control device according to claim 14, wherein said decrease in the amount of fuel by said fuel decreasing means is increased for a short time after the decelerating operation of the engine is started, and a reduction in said decrease in the amount of fuel is begun after said short time has elapsed and continues even after the decelerating operation of the engine is completed.

18. A fuel injection control device according to claim 17, wherein said decrease in the amount of fuel is controlled on the basis of a rate of change of an engine load, and said decrease in the amount of fuel is increased when said rate of change is relatively high, said decrease in the amount of fuel being reduced when said rate of change is relatively low.

19. A fuel injection control device according to claim 18, wherein said engine load is represented by an absolute pressure PM in the intake passage.

20. A fuel injection control device according to claim 18, wherein said engine load is represented by Q/N, where Q indicates an amount of air fed into the engine and N indicates an engine speed.

21. A fuel injection control device according to claim 18, wherein said decrease in the amount of fuel is calculated from the following equation:

$$TPAEW=\{C_2.\Delta L+C_3.(\Delta L+C_1.\Sigma\Delta L)\}.C_4$$

where

TPAEW: said decrease in the amount of fuel $\Delta L$: said rate of change of the engine load $C_1$, $C_2$, $C_3$, $C_4$ coefficients.

22. A fuel injection control device according to claim 21, wherein said correction means used during a deceleration operation corrects said TPAEW.

23. A fuel injection control device according to claim 1, wherein said lean-rich discriminating time is controlled by a velocity of air fed into the engine.

24. A fuel injection control device according to claim 23, wherein said velocity of air is represented by an absolute pressure in the intake passage.

25. A fuel injection control device according to claim 23, wherein said lean-rich discriminating time is shortened as said velocity of air is increased.

26. A fuel injection control device according to claim 23, wherein said time calculating means begins to calculate said lean time and said rich time when a predetermined time has elapsed after the accelerating operation of the engine is started, and said predetermined time is shortened as said velocity of air is increased.

27. A fuel injection control device according to claim 1, wherein a correction means used during a deceleration operation is provided for correcting a decrease in an amount of fuel fed into the engine when a decelerating operation of the engine is carried out, and an amount of a correction of said decrease in the amount of fuel is equal to an amount of a correction of said increase in the amount of fuel.

28. A fuel injection control device according to claim 1, wherein time detecting means is provided for detecting a time frequency of an occurrence of either one of said lean time and said rich time in a predetermined operating state of the engine, and said lean-rich discriminating time is determined on the basis of said time frequency.

29. A fuel injection control device according to claim 28, wherein said lean-rich discriminating time is determined by an average of a plurality of said time frequencies detected by said time detecting means.

30. A fuel injection control device according to claim 28, wherein said predetermined operating state of the engine is a cruising state.

31. A fuel injection control device according to claim 30, wherein said lean-rich discriminating time is slightly shorter than a time of an occurrence of either one of said lean time and said rich time.

32. A fuel injection control device according to claim 1, wherein a backfire detecting means is provided for detecting an occurrence of a backfire, and said correction means further increases said increase in the amount of fuel when a backfire occurs.

33. A fuel injection control device according to claim 32, further comprising: deceleration detecting means for detecting a decelerating operation of the engine; fuel decreasing means for decreasing the amount of fuel fed into the engine when the decelerating operation of the engine is carried out; time calculating means used during a deceleration operation for calculating a lean time and a rich time of the air-fuel mixture on the basis of the output signal of said oxygen concentration detector during a predetermined lean-rich discriminating time when the decelerating operation of the engine is carried out; and correction means used during a for deceleration operation for correcting an decrease in the amount of fuel, which decrease is caused by said fuel decreasing means, to increase said decrease in the amount of fuel when said rich time is longer than said lean time and when said difference is larger than a predetermined value, and to reduce said decrease in the amount of fuel when said lean time is longer than said rich time and when said difference is larger than a predetermined value, said correction means used during a deceleration operation further increasing said decrease in the amount of fuel when a backfire occurs.

34. A fuel injection control device according to claim 32, wherein said backfire detecting means comprises a pressure sensor for detecting a pressure in the intake passage, and determines that a backfire has occurred when said pressure in the intake passage exceeds a predetermined pressure which is higher than the atmospheric pressure.

35. A fuel injection control device according to claim 32, wherein said backfire detecting means comprises a throttle sensor for detecting a degree of opening of a throttle valve, and an air flow meter producing an output voltage proportional to an amount of air fed into the engine, and said backfire detecting means determines that a backfire has occurred when a change in the degree of opening of the throttle valve is within a predetermined range and when a change in the output voltage of the air flow meter is outside a predetermined range.

36. A fuel injection control device according to claim 1, wherein said time calculating means determines whether the air-fuel mixture is lean or rich at a predetermined crankangle, to calculate said lean time and said rich time.

37. A fuel injector control device according to claim 1, wherein said lean-rich discriminating time is a time in which the engine rotates by a predetermined number of revolutions.

* * * * *

UNITED STATES PATENT AND TRADEMARK OFFICE
CERTIFICATE OF CORRECTION

PATENT NO. : 4,991,559

DATED : February 12, 1991

INVENTOR(S) : Kouichi OSAWA, et al.

It is certified that error appears in the above-identified patent and that said Letters Patent is hereby corrected as shown below:

Cover sheet, Item [75], change "Sinji Kato" to --Senji Kato--.

Column 3, line 64, between "7(H)" and "diagrams" insert --are--.

Column 4, line 1, delete "9".

Col. 4, line 6, change "12'(B)" to --12(B)--.

Column 4, line 9, delete "13,".

Column 4, line 23, delete "19,".

Column 4, line 32, delete "24,".

Column 4, line 39, delete "28," and "29,".

Column 9, line 67, change "tAU to --TAU--.

Col. 18, line 55, between "chamber 4" and "detected" insert --is--.

Column 23, line 62, change "<" to --<--.

Column 25, line 34, change ">" to -->--.

Column 26, line 31, change "?" to -->--.

UNITED STATES PATENT AND TRADEMARK OFFICE

CERTIFICATE OF CORRECTION

PATENT NO. : 4,991,559

DATED : February 12, 1991

INVENTOR(S) : Kouichi OSAWA, et al.

It is certified that error appears in the above-identified patent and that said Letters Patent is hereby corrected as shown below:

Column 27, line 14, change "$<$" to --$\leq$--.

Column 28, line 24, change "$>$" to --$\geq$--.

Column 29, line 24, between "changed," and "measuring" insert --the--.

Column 29, line 40, change " 0," to -- $\theta_o$,--.

Column 29, line 46, change "$<$" to --$\leq$--.

Column 31, line 33, between "change" and "the" insert --of--.

Column 31, line 34, change "$C_4$" to --$C_4$:--.

Column 31, line 50, change "an" to --a--.

Column 32, line 34, change "$C_4$" to --$C_4$:--.

Column 33, line 28, delete "for".

UNITED STATES PATENT AND TRADEMARK OFFICE

CERTIFICATE OF CORRECTION

PATENT NO. : 4,991,559

DATED : February 12, 1991

INVENTOR(S) : Kouichi OSAWA, et al.

It is certified that error appears in the above-identified patent and that said Letters Patent is hereby corrected as shown below:

Column 33, line 29, change "an" to --a--.

Signed and Sealed this

Twentieth Day of April, 1993

*Attest:*

MICHAEL K. KIRK

*Attesting Officer*

*Acting Commissioner of Patents and Trademarks*